US011944173B2

(12) United States Patent
Antonyan et al.

(10) Patent No.: US 11,944,173 B2
(45) Date of Patent: Apr. 2, 2024

(54) TAKEOUT FOOD CONTAINER

(71) Applicants: Karren Antonyan, Los Angeles, CA (US); David Movsisian, Glendale, CA (US)

(72) Inventors: Karren Antonyan, Los Angeles, CA (US); David Movsisian, Glendale, CA (US)

( * ) Notice: Subject to any disclaimer, the term of this patent is extended or adjusted under 35 U.S.C. 154(b) by 25 days.

(21) Appl. No.: 17/359,417

(22) Filed: Jun. 25, 2021

(65) Prior Publication Data

US 2022/0053900 A1 Feb. 24, 2022

Related U.S. Application Data

(60) Provisional application No. 63/044,316, filed on Jun. 25, 2020.

(51) Int. Cl.

| | |
|---|---|
| ***A45C 11/20*** | (2006.01) |
| ***B65D 5/52*** | (2006.01) |
| ***B65D 25/04*** | (2006.01) |
| ***B65D 25/24*** | (2006.01) |
| ***B65D 25/28*** | (2006.01) |
| ***B65D 43/16*** | (2006.01) |

(52) U.S. Cl.

CPC ..... *A45C 11/20* (2013.01); *B65D 5/5206* (2013.01); *B65D 25/04* (2013.01); *B65D 25/24* (2013.01); *B65D 25/28* (2013.01); *B65D 43/162* (2013.01)

(58) Field of Classification Search

CPC ..... B65D 5/6605; B65D 43/12; B65D 43/16; A45C 11/20

USPC ..... 206/549, 541

See application file for complete search history.

(56) References Cited

U.S. PATENT DOCUMENTS

| | | | | | |
|---|---|---|---|---|---|
| 4,946,057 | A * | 8/1990 | Connolly | B65D 43/12 | 220/345.3 |
| 5,181,649 | A * | 1/1993 | Frost | A47G 21/001 | 426/115 |
| 5,366,106 | A * | 11/1994 | Kahl | A45C 11/20 | 220/756 |
| 5,375,702 | A * | 12/1994 | Fiallo | B65D 5/54 | 206/45.21 |
| 5,443,174 | A * | 8/1995 | Bauer | B65D 17/4011 | 220/276 |
| 5,632,379 | A * | 5/1997 | Frost | A47G 21/001 | 206/541 |
| 5,816,405 | A * | 10/1998 | Carriger, Jr. | A47B 3/10 | 206/542 |
| 6,305,533 | B1 * | 10/2001 | Welty | B65D 5/5206 | 206/278 |
| 9,527,623 | B1 * | 12/2016 | Padden | B65D 25/04 | |
| D823,692 | S * | 7/2018 | Greenberg | D9/761 | |
| D836,461 | S * | 12/2018 | Greenberg | D9/761 | |
| 2016/0007806 | A1 * | 1/2016 | Rosen | A47J 47/14 | 206/541 |
| 2017/0225844 | A1 * | 8/2017 | Prakailerdluk | B65D 43/12 | |
| 2018/0251256 | A1 * | 9/2018 | Baryshyan | B65D 5/4266 | |

(Continued)

*Primary Examiner* — Ernesto A Grano
*Assistant Examiner* — Symren K Sanghera
(74) *Attorney, Agent, or Firm* — Milord A. Keshishian

(57) ABSTRACT

The present invention discloses a disposable takeout food container, comprising a first sleeve cover, and a second sleeve cover. The first sleeve cover and the second sleeve cover when oriented perpendicular to a tray and engaged with the tray, support the tray at an elevated position, functioning as serving tray stands to form a stable table-tray.

9 Claims, 91 Drawing Sheets

(56) References Cited

U.S. PATENT DOCUMENTS

| | | | | |
|---|---|---|---|---|
| 2019/0002154 | A1* | 1/2019 | Hugley | B65D 5/0254 |
| 2020/0069092 | A1* | 3/2020 | Amisial | B65D 11/188 |

* cited by examiner

TAKEOUT FOOD CONTAINER

CROSS-REFERENCE TO RELATED APPLICATIONS

This Application claims the benefit of priority of U.S. Utility Provisional Patent Application 63/044,316, filed Jun. 25, 2020, the entire disclosure of which is expressly incorporated by reference in its entirety herein.

All documents mentioned in this specification are herein incorporated by reference to the same extent as if each individual document was specifically and individually indicated to be incorporated by reference.

It should be noted that throughout the disclosure, where a definition or use of a term in any incorporated document(s) is inconsistent or contrary to the definition of that term provided herein, the definition of that term provided herein applies and the definition of that term in the incorporated document(s) does not apply.

BACKGROUND OF THE INVENTION

Field of the Invention

One or more embodiments of the present invention relate to a takeout food container and more particularly, to a portable, disposable (one-time use) takeout food container that also functions as a table-tray.

Description of Related Art

Conventional food delivery and takeout containers are well known and have been in use for a number of years. Regrettably, most are only containers, requiring consumers to place the container on a table prior to consumption of food. Others are extremely complex to manufacture, and require too many pieces to assemble. Still others require additional containers to be used with the food delivery and takeout container. Yet others require too many cumbersome steps to operate by a consumer.

Accordingly, in light of the current state of the art and the drawbacks to current food delivery and takeout containers mentioned above, a need exists for a takeout food container that would be portable, disposable, and have a compact, small form factor for storage prior to its use.

Further, a need exists for a takeout food container that would be simple to manufacture, would not require too many pieces for assembly, would be easy to assemble, and easy to operate by a consumer.

Still further, a need exists for a takeout food container that would not require additionally (auxiliary containers) to deliver food within and for proper use (for example, to prevent leakage of food material).

Additionally, a need exists for a takeout food container that may be used as a table-tray for consumption of food or, alternatively, used as an elevated table-tray for a more convenient consumption of food.

BRIEF SUMMARY OF THE INVENTION

A non-limiting, exemplary aspect of an embodiment of the present invention provides a disposable takeout food container, comprising:

a tray;

a first sleeve cover; and a second sleeve cover;

the first sleeve cover and the second sleeve cover fully cover over the tray when in a closed position;

the first sleeve cover and the second sleeve cover move away from one another to an open position to uncover and provide access to the tray;

the first sleeve cover and the second sleeve cover when oriented perpendicular to the tray and engaged with the tray, support the tray at an elevated position, functioning as serving tray stands to form a stable table-tray.

Another non-limiting, exemplary aspect of an embodiment of the present invention provides a disposable takeout food container, comprising:

a first sleeve cover; and a second sleeve cover;

the first sleeve cover and the second sleeve cover when oriented perpendicular to a tray and engaged with the tray, support the tray at an elevated position, functioning as serving tray stands to form a stable table-tray.

Yet another non-limiting, exemplary aspect of an embodiment of the present invention provides a disposable takeout food container, comprising:

a sleeve cover comprised of:

a single-piece, planar sheet cut-outs forming a sleeve cover piece that is folded about fold-marks to form the sleeve cover;

the sleeve cover piece include:

a middle portion;

a first laterally extending flange that extends laterally from a first side of an upper portion of the middle portion;

a second laterally extending flange that extends laterally from a second side of the upper portion of the middle portion;

the first and the second laterally extending flanges are identical.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

FIGS. 4 to 4B-21 are non-limiting, exemplary illustrations of a tray piece, progressively illustrating a non-limiting, exemplary method of assembly thereof in accordance with one or more embodiments of the present invention;

FIGS. 7A to 8F are non-limiting, exemplary illustrations of a takeout food container that includes additional optional features in accordance with one or more embodiments of the present invention.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention. Stated otherwise, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

One or more embodiments of the present invention may use the phrase form factor as the physical size and or shape of various members of the one or more embodiments of the present invention.

Throughout the disclosure the term fold lines or fold marks (or markings) may be scored lines, perforated lines, or simply indicated by markings such as printed indicia. Further, Throughout the disclosure the terms fold lines and fold marks (or fold markings) are equivalent and interchangeable.

One or more embodiments of the present invention provide a takeout food container that is portable, disposable, and has a compact, small form factor for storage prior to its use.

Further, one or more embodiments of the present invention provide a takeout food container that is simple to manufacture, does not require too many pieces for assembly, is easy to assemble, and easy to operate by a consumer.

Still further, one or more embodiments of the present invention provide a takeout food container that does not require additionally (auxiliary containers) to deliver solid food within and for proper use.

Additionally, one or more embodiments of the present invention provide a takeout food container that may be used as a tray for consumption of food or, alternatively, used as an elevated table-tray for a more convenient consumption of food.

Figure 1A:
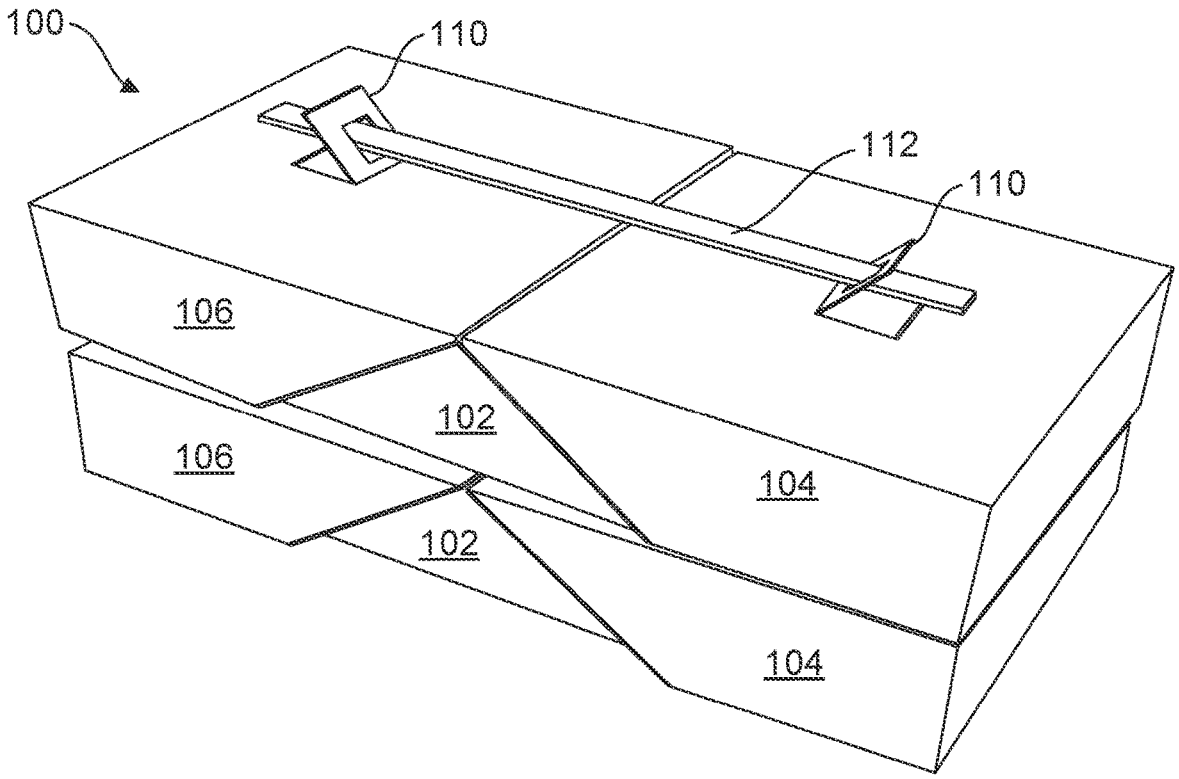
FIGS. 1A to 1R are non-limiting, exemplary illustrations of a takeout food container, progressively illustrating non-limiting, exemplary methods of opening and closing the takeout container in accordance with one or more embodiments of the present invention.
Figure 1B:
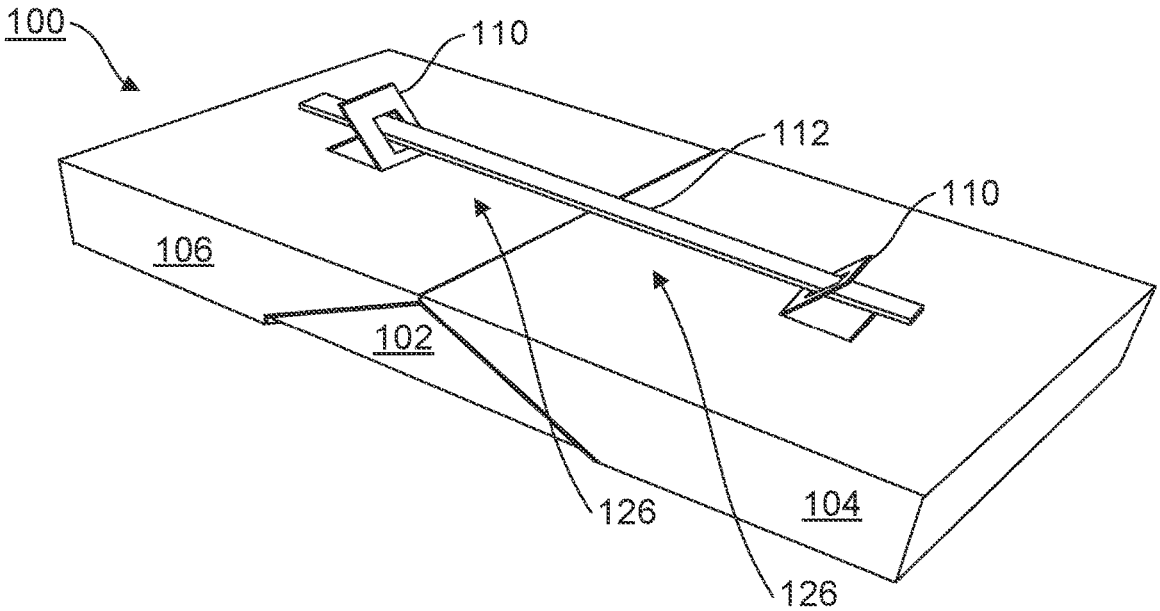
FIGS. 5A-1 to 5C-7 are non-limiting, exemplary illustrations of a set of divider pieces, progressively illustrating a non-limiting, exemplary method of assembly thereof to form dividers in accordance with one or more embodiments of the present invention.
Figure 1C:
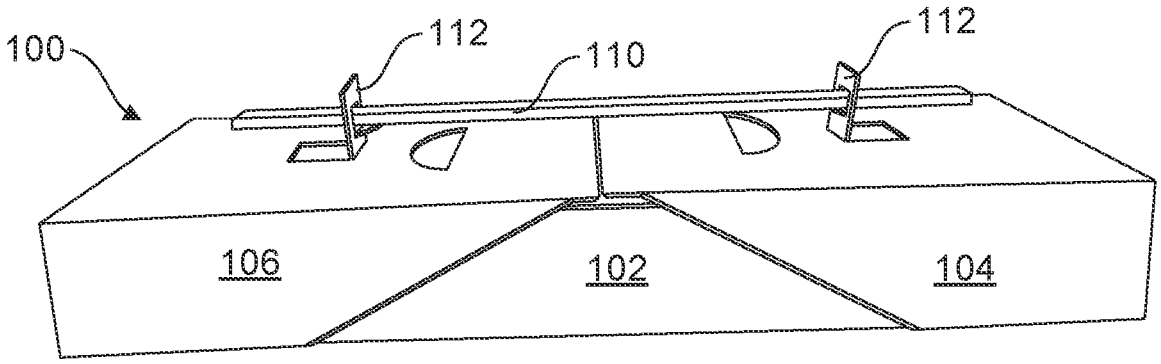
Figure 1D:
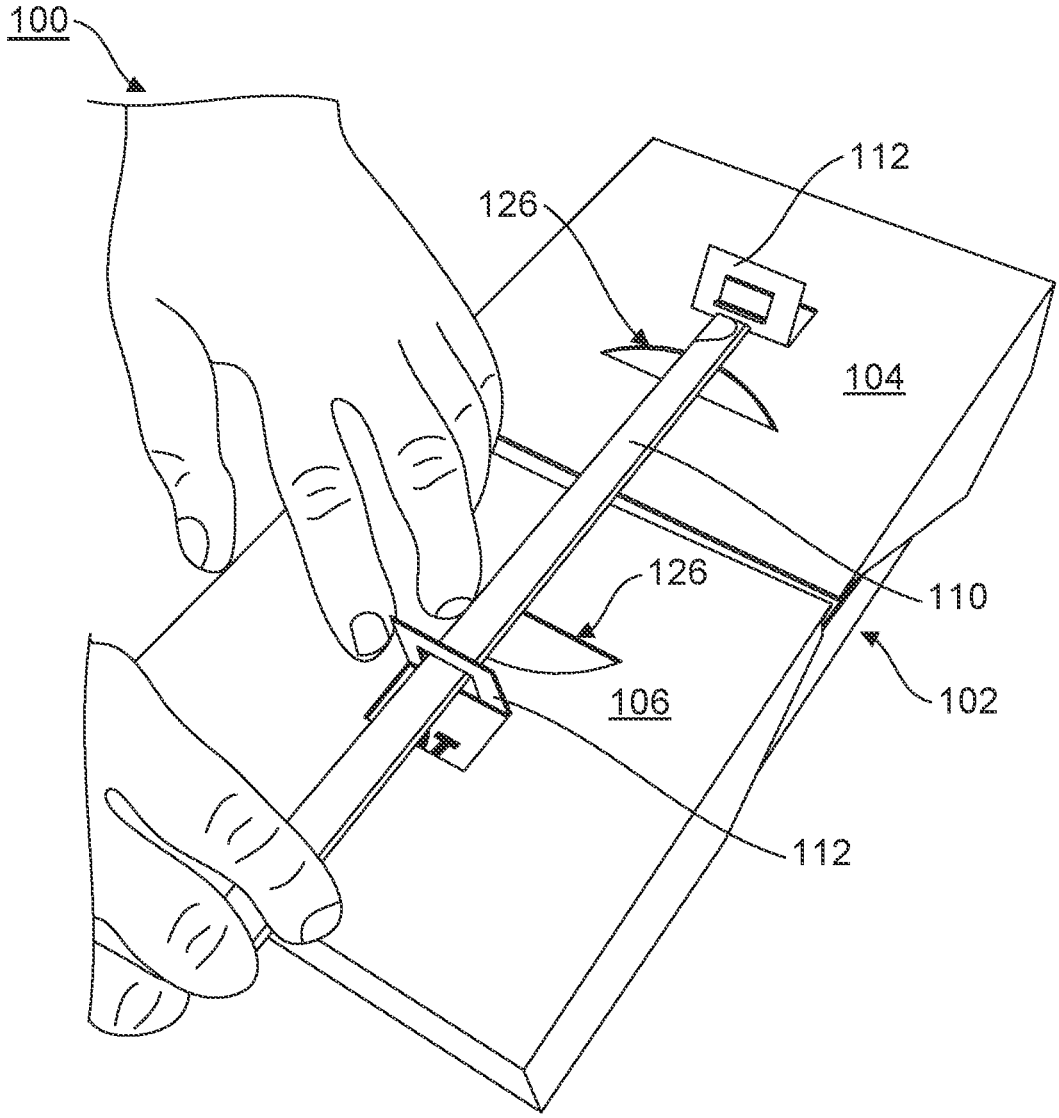
Figure 1E:
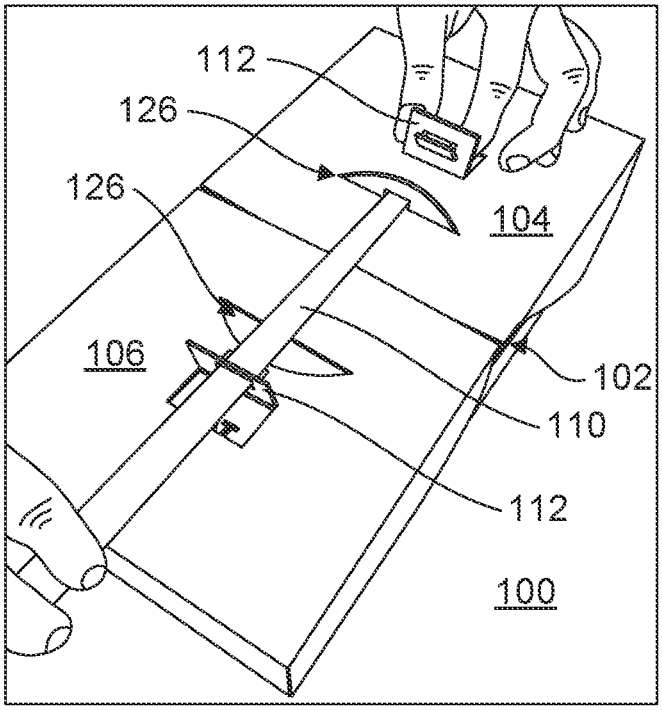
Figure 1F:
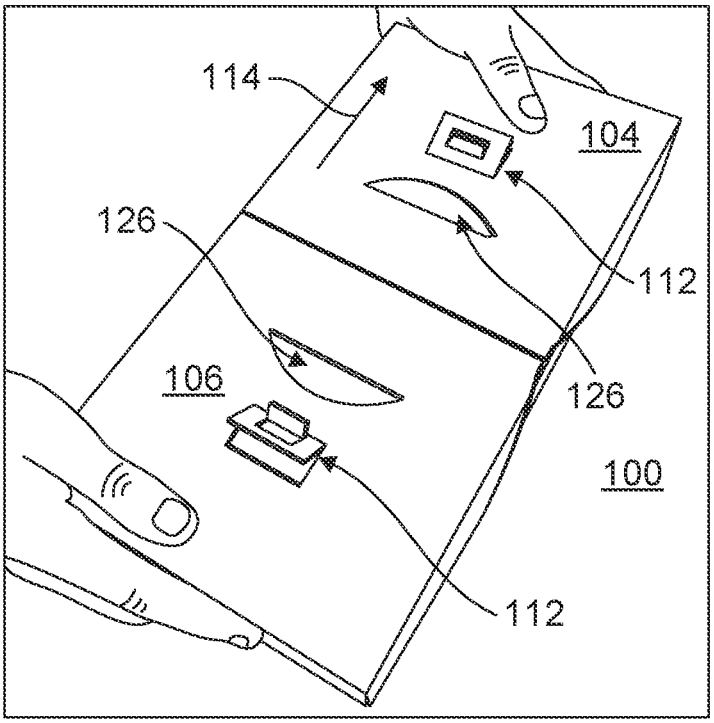
Figures 1, 1G:
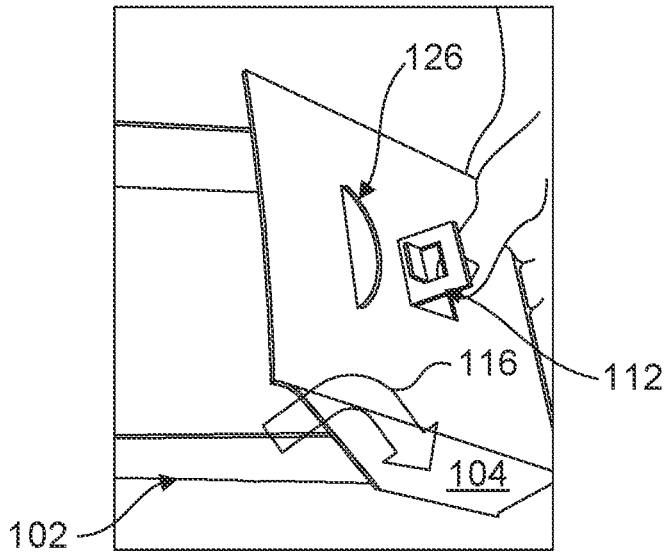
Figures 1, 1G, 2:
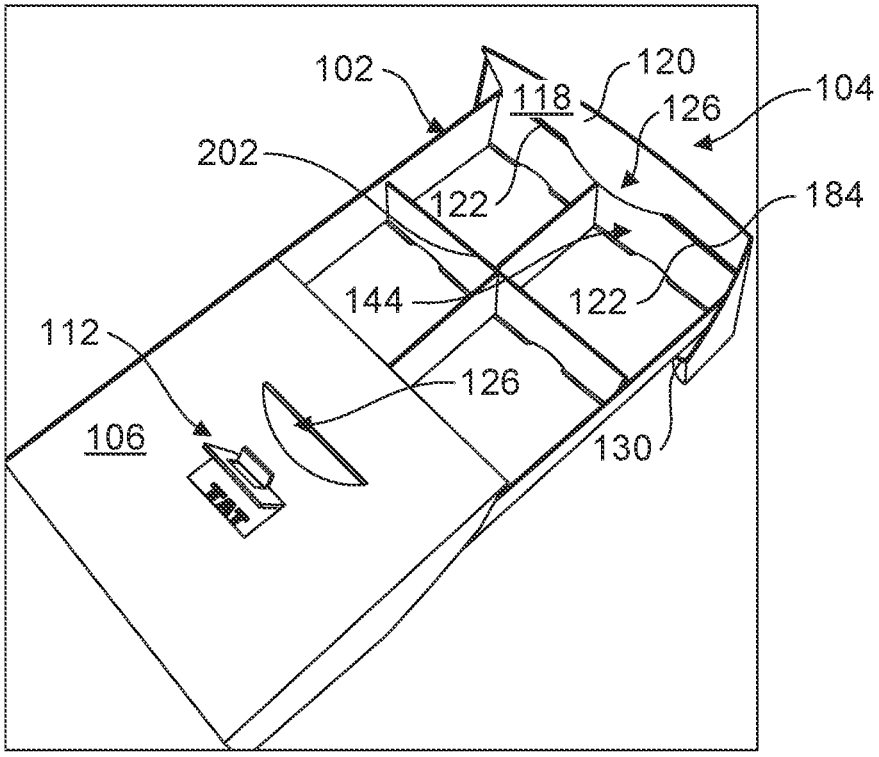
Figure 1H:
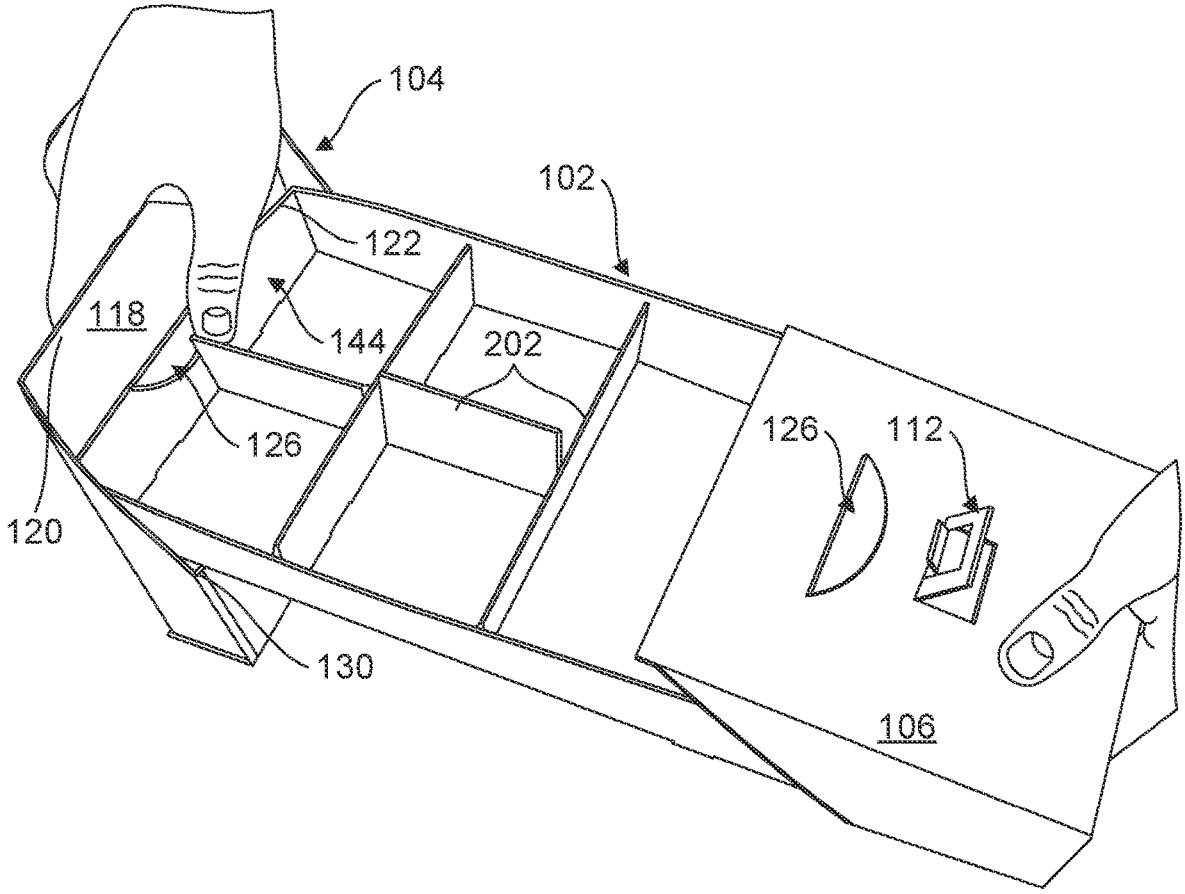
Figure 1I:
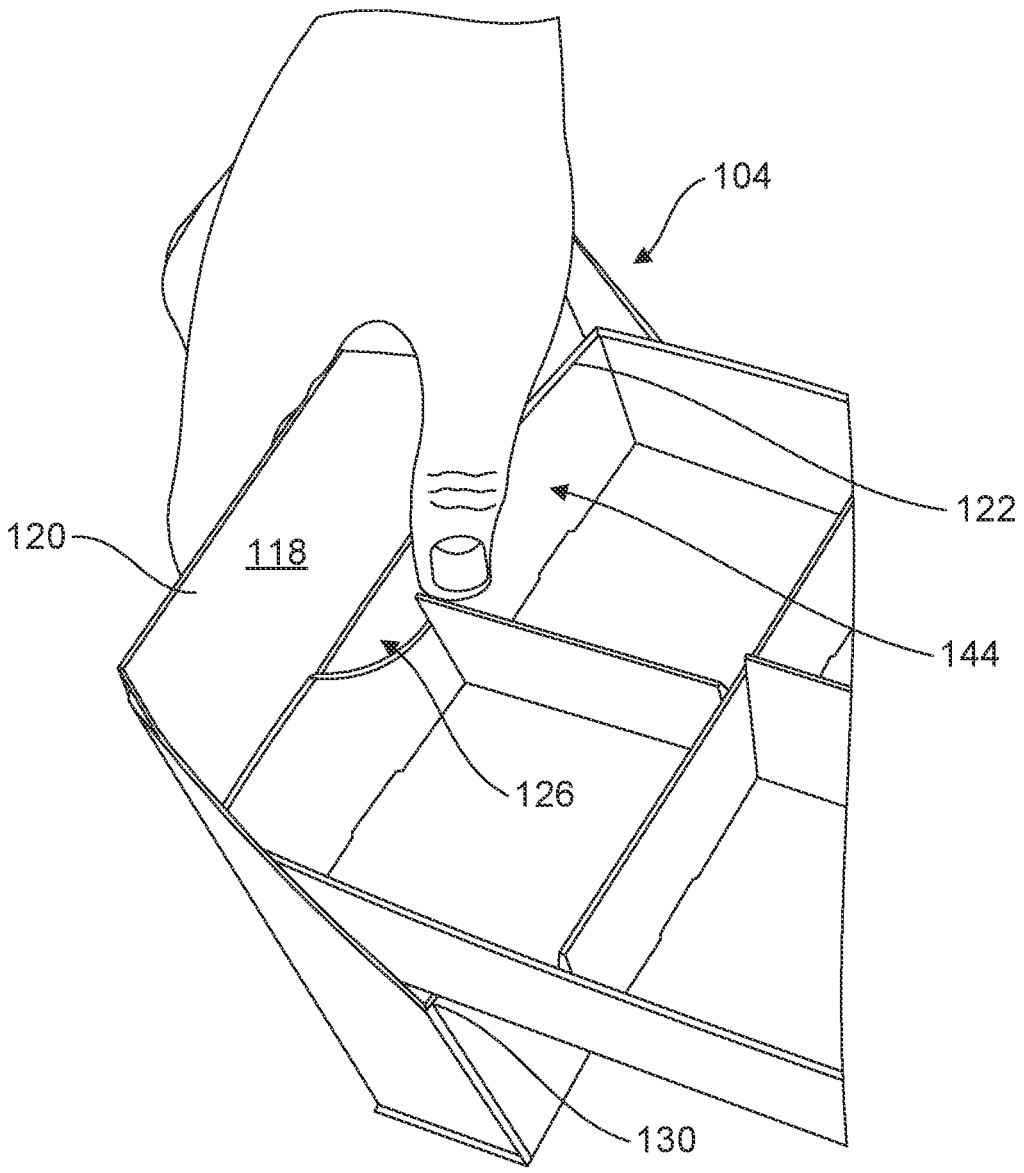
Figure 1J:
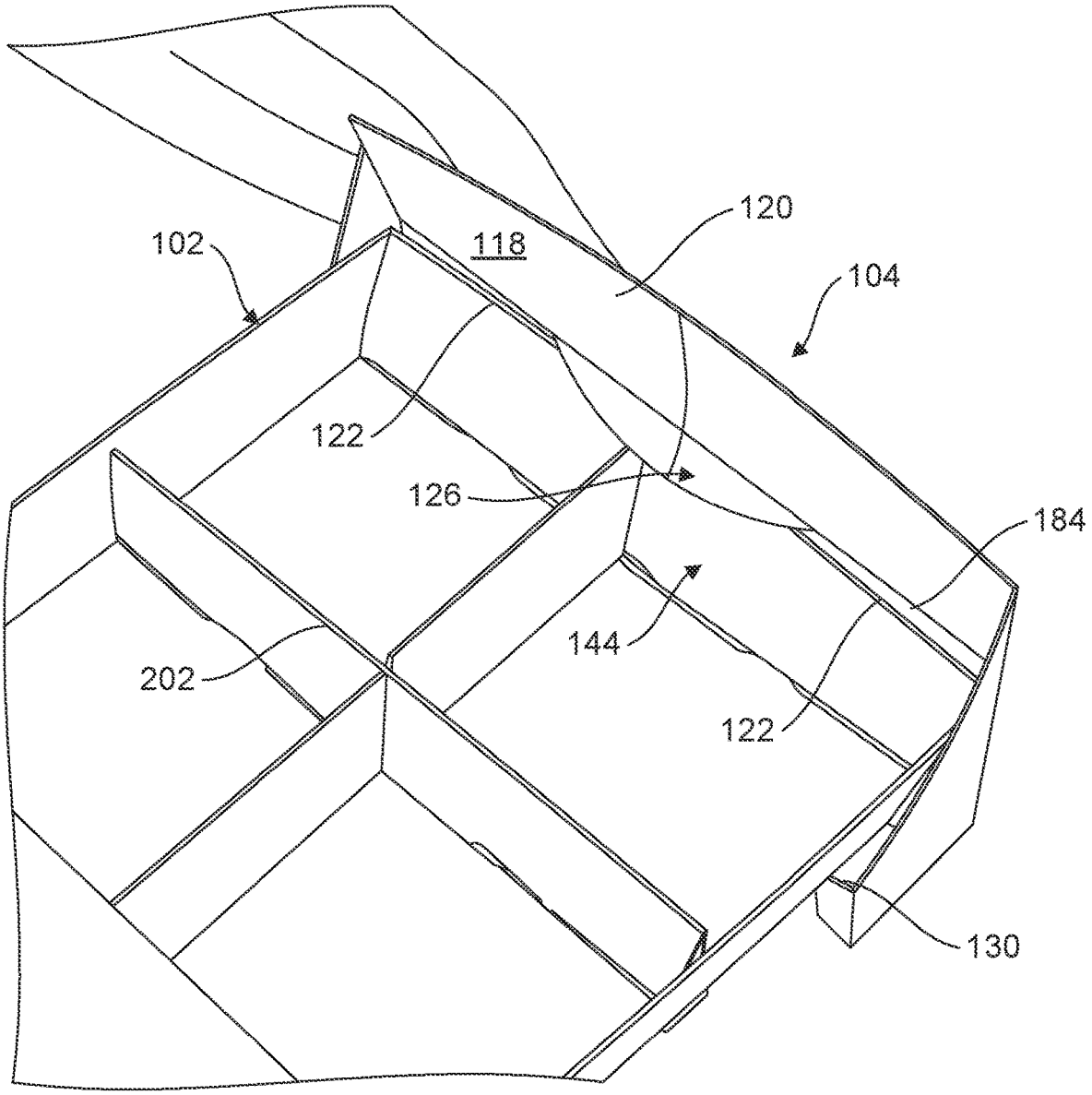
Figure 1K:
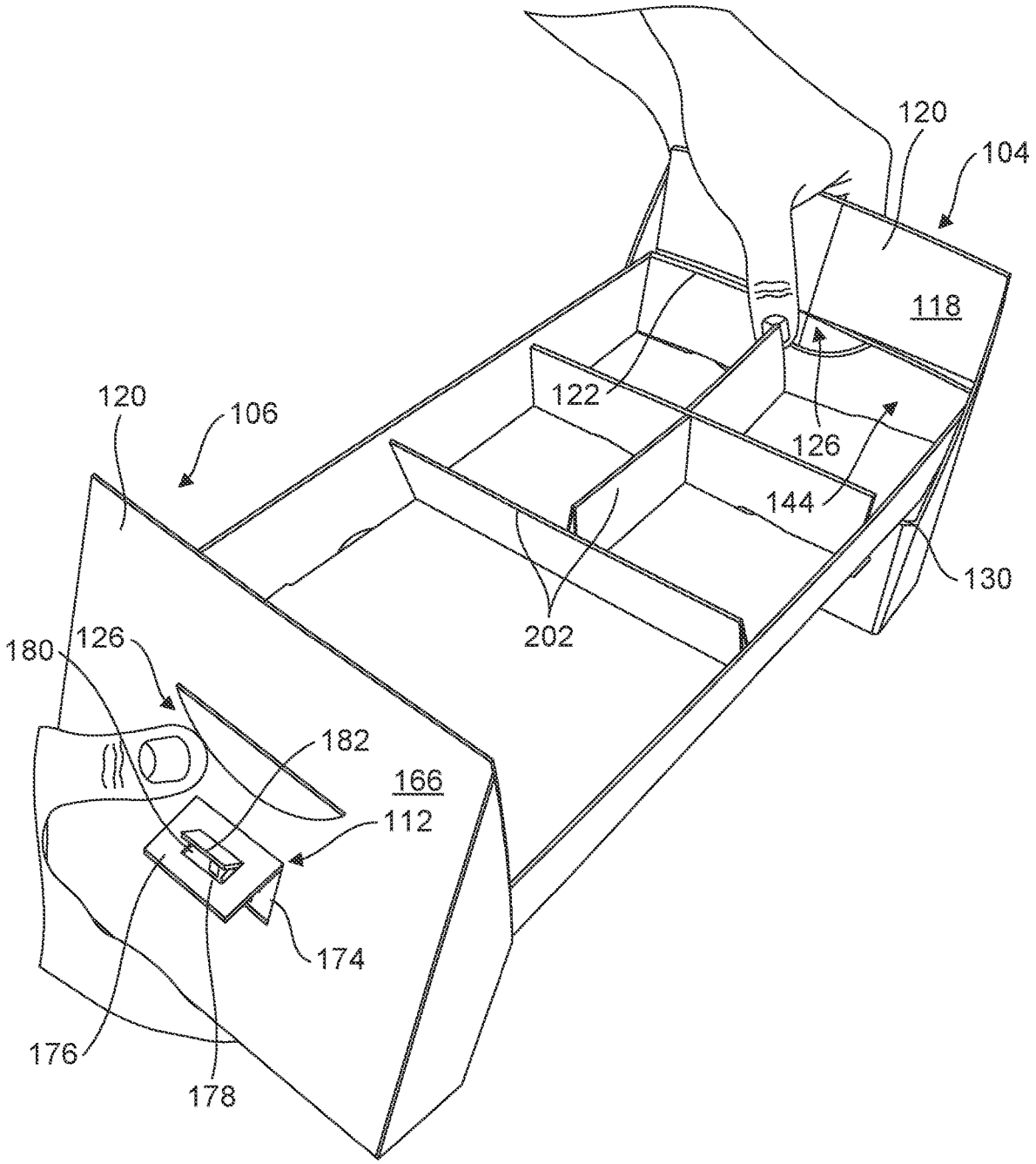
Figure 1L:
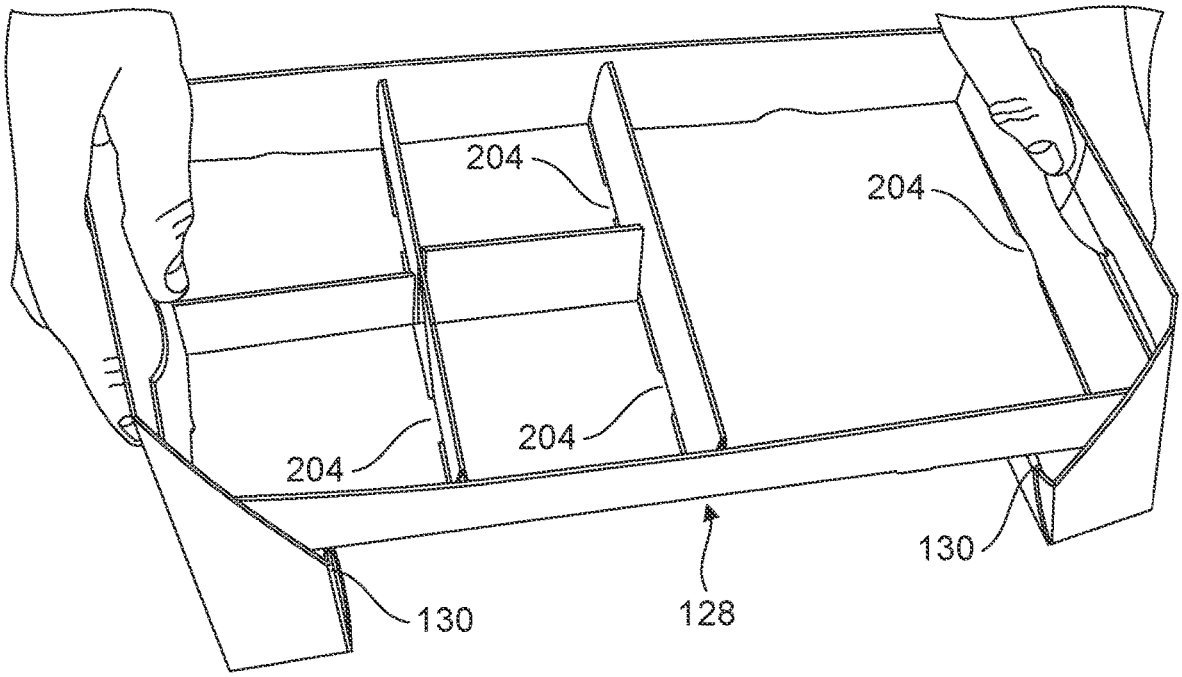
Figure 1M:
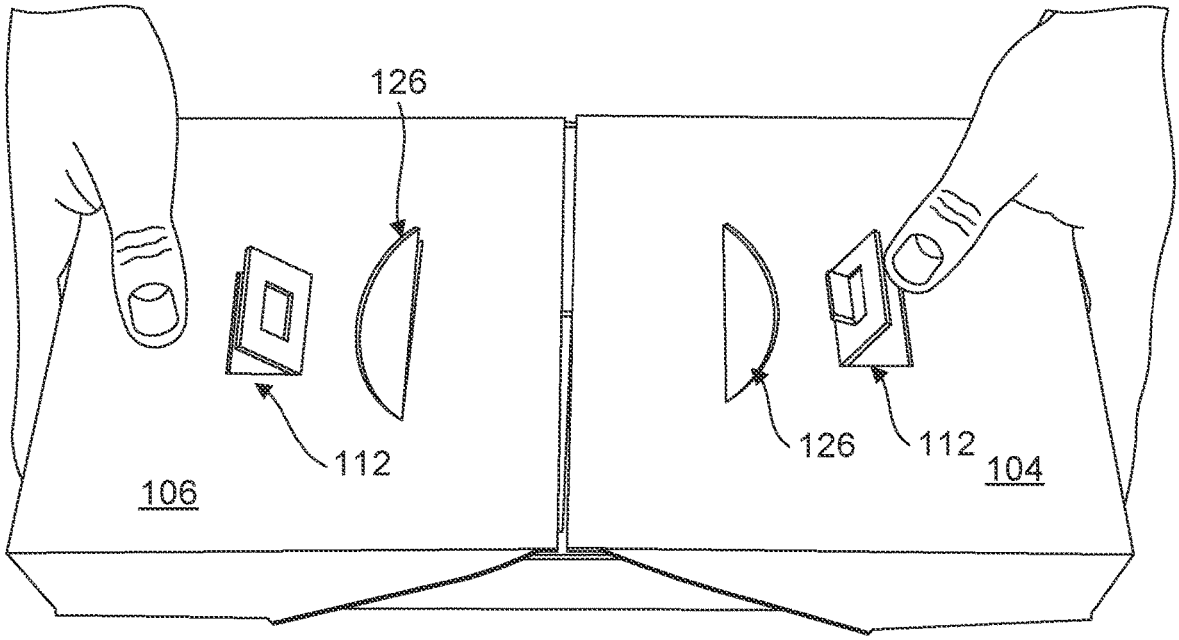
Figure 1N:
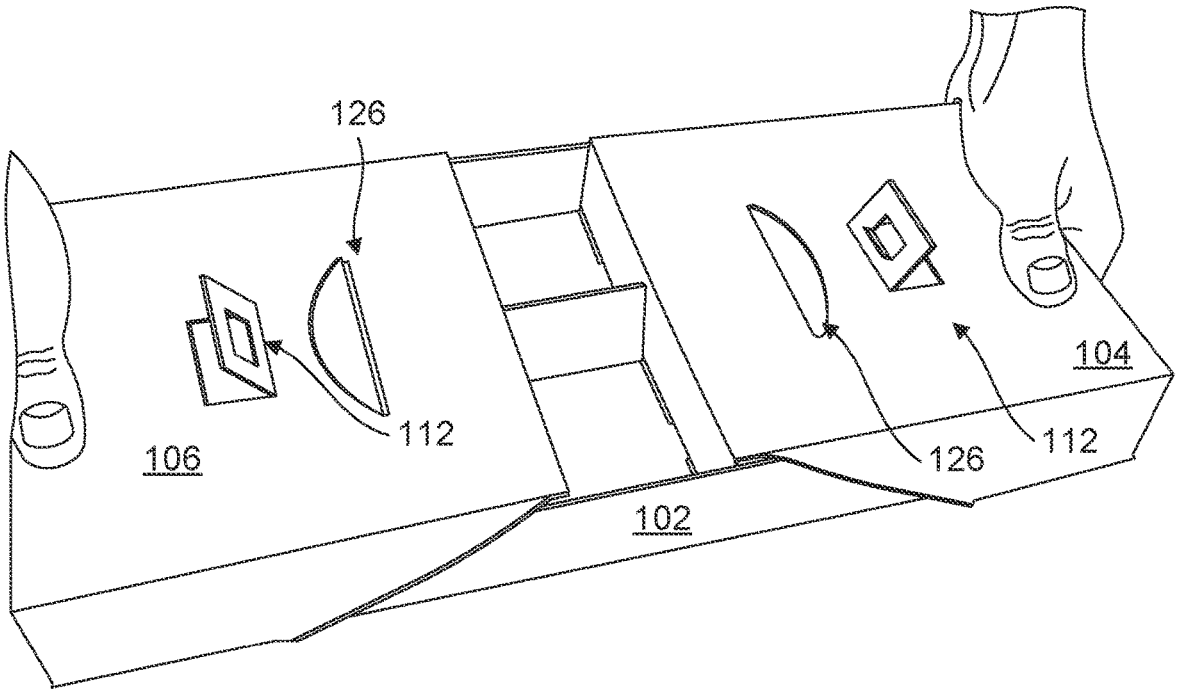
Figure 1O:
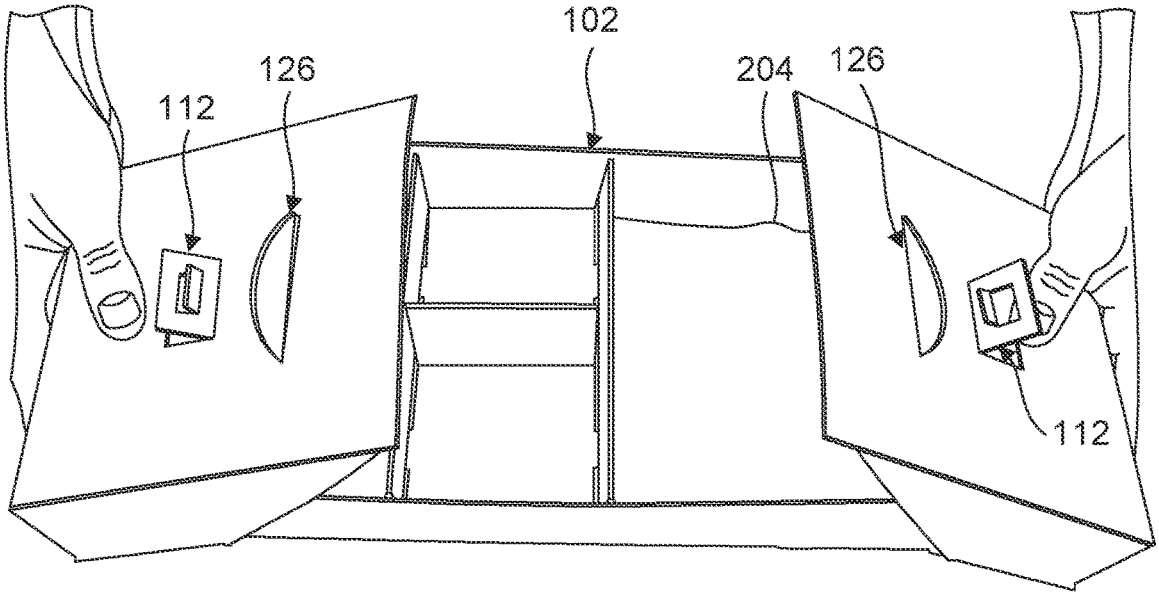
Figure 1P:
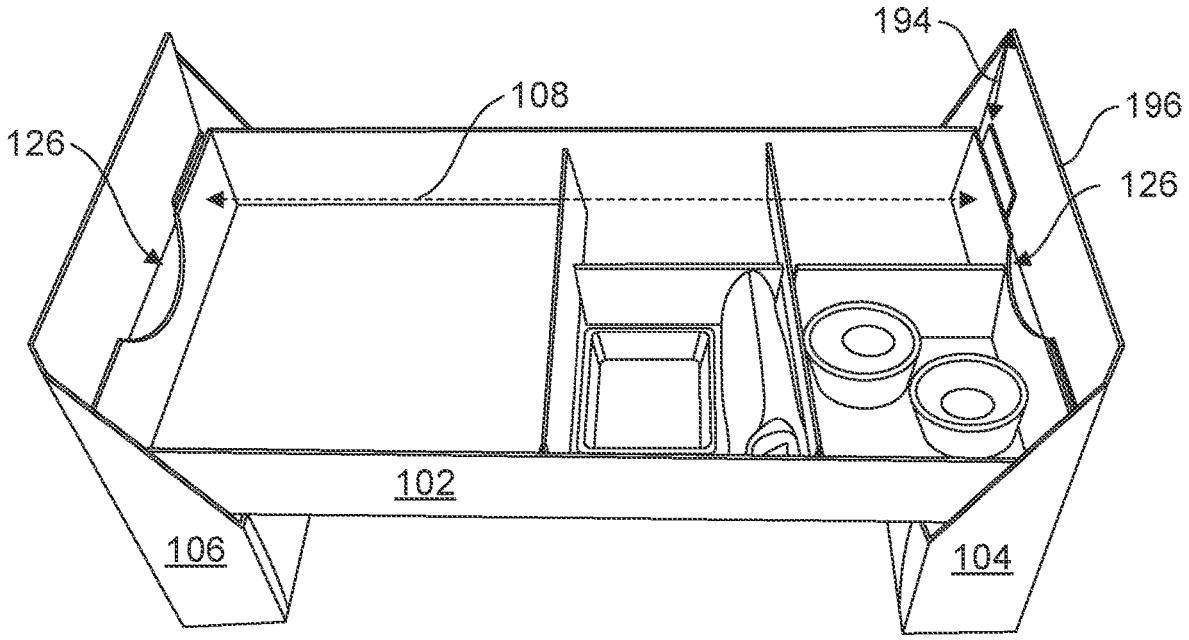
Figure 1Q:
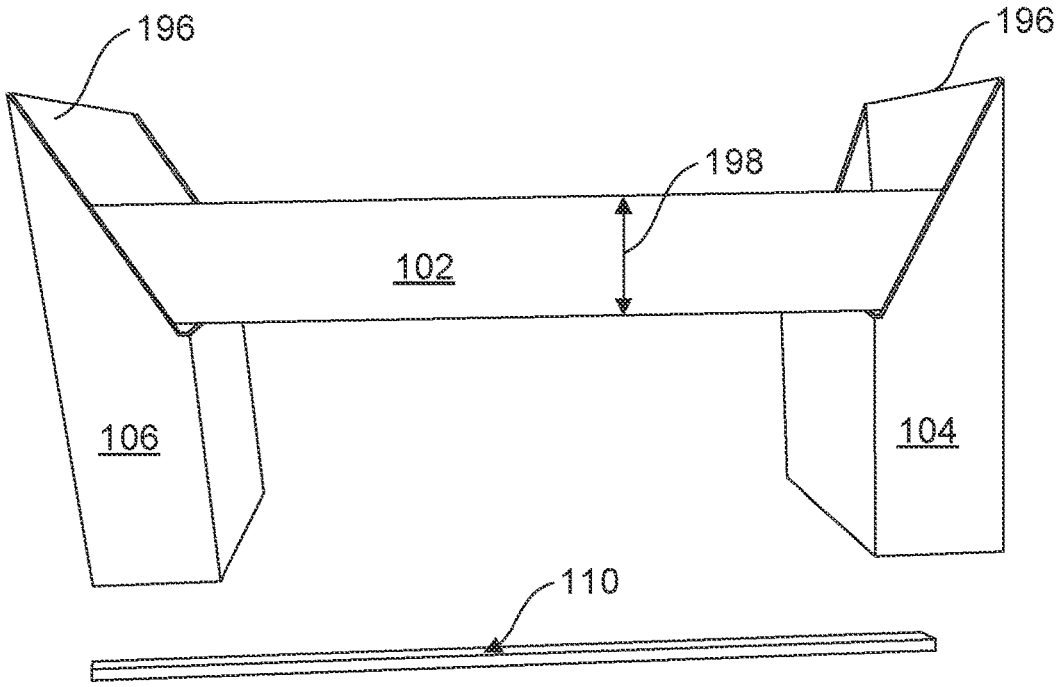
Figure 1R:
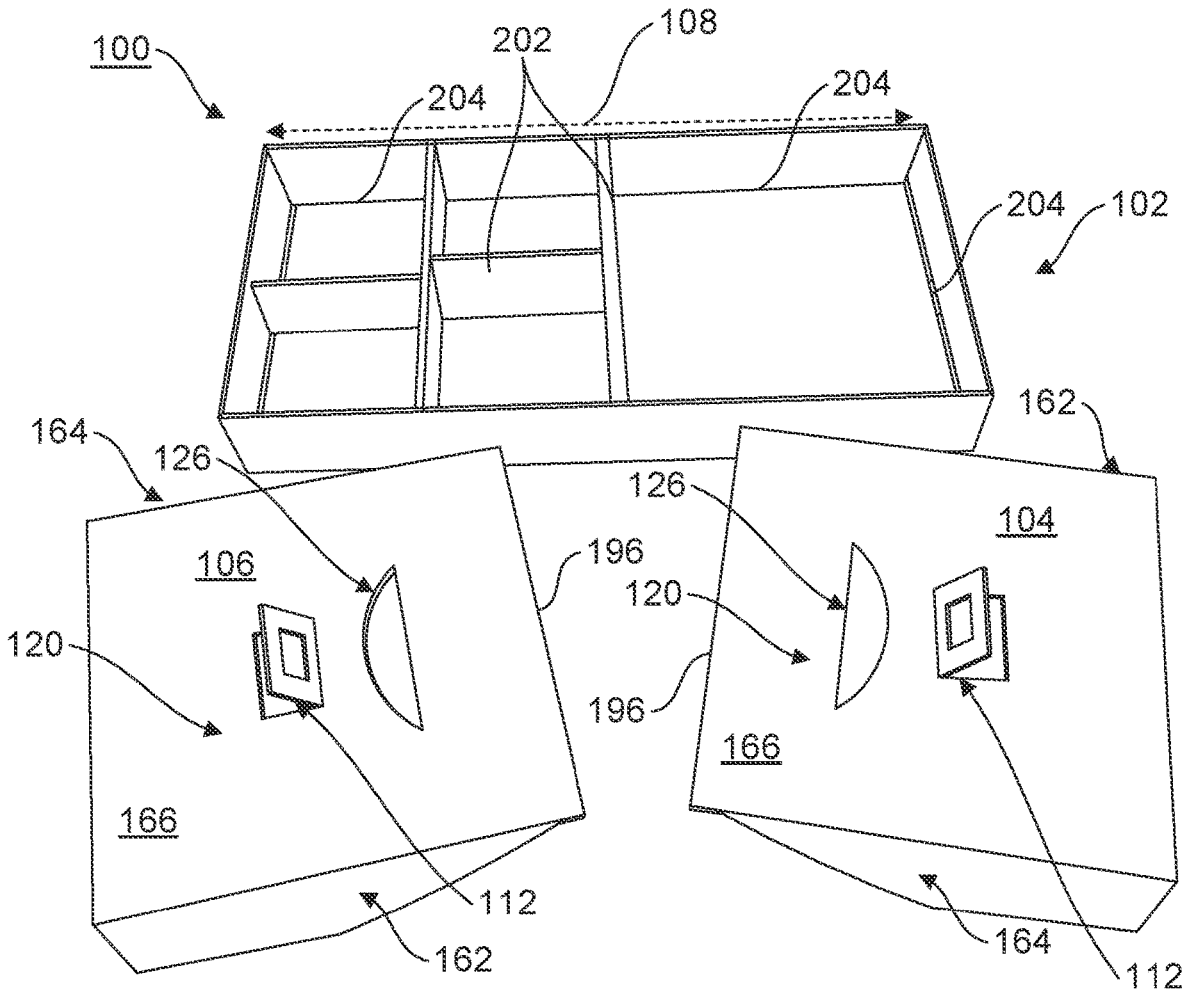

FIGS. 1A to 1R are non-limiting, exemplary illustrations of a takeout food container, progressively illustrating non-limiting, exemplary methods of opening and closing the takeout container in accordance with one or more embodiments of the present invention. As illustrated, the fully assembled takeout food container 100 may be stacked on top of one another for storage or transport, and distributed one by one.

Takeout food container 100 is comprised of a tray 102, and a first sleeve cover 104 and a second sleeve cover 106 that when in closed position, cover tray 102 as shown in FIGS. 1A to 1R. First sleeve cover 104 and second sleeve cover 106 are identical.

When first sleeve cover 104 and second sleeve cover 106 are fully extended (pulled) to an open position and oriented perpendicular to a longitudinal axis 108 (FIG. 1P) of tray 102, first sleeve cover 104 and second sleeve cover 106 engage tray 102 to support tray 102 at an elevated position, functioning as serving tray legs to form a stable table-tray (FIGS. 1P and 1Q).

Referring to FIGS. 1D and IE, to open takeout food container 100, utensils 110 such as a pair of chopsticks may be pulled out of a set of utensil holders 112 of takeout food container 100. Thereafter, users may simply pull or slide out one of the sleeve covers 104 or 106 (e.g., first sleeve cover 104) laterally in the direction shown by arrow 114 in FIG. 1F to halfway open container and partially access content of tray 102.

Users may continue to slide out first sleeve cover 104 to open position while tilting it (as shown by arrow 116 in FIG. 1G-1) so that sleeve cover 104 or 106 is oriented perpendicular a longitudinal axis of tray 102 as sleeve cover 104 or 106 is eventually moved to a fully open position (FIGS. 1G-2 to 1L).

As first sleeve cover 104 is moved to open position and tilted, interior facing side 118 of top side 120 of sleeve cover continues to remain engaged (touches) top edge 122 of first transvers side 144 of tray 102.

As detailed, top edge 122 of first transverse side 144 of tray 102 is caught by an interlock mechanism (e.g., flap) 126 (detailed below) of first sleeve cover 114 as it is tilted and hence, tray 102 interlocks with first sleeve cover 114.

Additional movement of sleeve covers 104 and 106 is prevented due to bottom side 128 (FIG. 1L) of tray 102 resting on supporting edges 130 of sleeve covers 104 and 106. The same operations may be performed for second sleeve cover 106 as it is identical to first sleeve cover 104. In other words, an exterior bottom side 128 of tray 102 rests on supporting edge 130 of first and second sleeve covers 104 and 106 when tray 102 is interlocked with interlock mechanism 126 of first and the second sleeve covers 104 and 106.

As another alternative method shown in FIGS. 1M to 1R, both first and second sleeve covers 104 and 106 may be moved and tilted concurrently as shown, until both top edges 122 of transverse sides 144 and 146 of tray 102 are caught by respective interlock mechanisms 126 of first and the second sleeve covers 104 and 106. As yet another alternative option, first and the second sleeve covers 104 and 106 may simply be moved to an open position and set aside as shown in FIG. 1R.

FIGS. 2A to 2K are non-limiting, exemplary illustrations of the various views of the components that constitute a takeout food container as exemplarily shown in FIGS. 1A to 1R in accordance with one or more embodiments of the present invention. The takeout food container shown in FIGS. 2A to 2K is similar to the takeout food container shown in FIGS. 1A to 1R but it includes additional optional features that are further described in detail below.

Figure 2A:
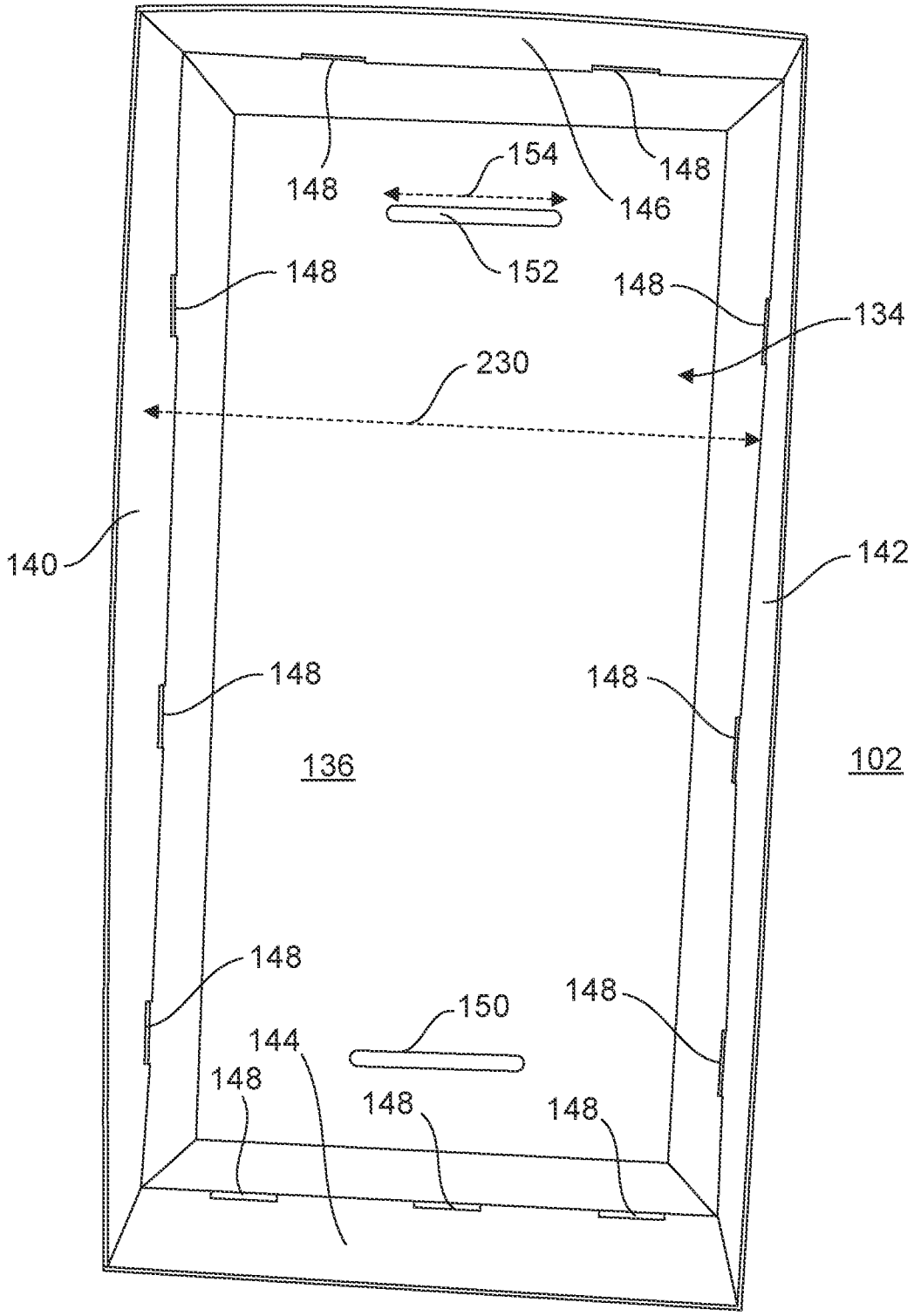
FIGS. 2A to 2K are non-limiting, exemplary illustrations of the various views of the components that constitute a takeout food container as exemplarily shown in FIGS. 1A to 1R in accordance with one or more embodiments of the present invention.
Figure 2B:
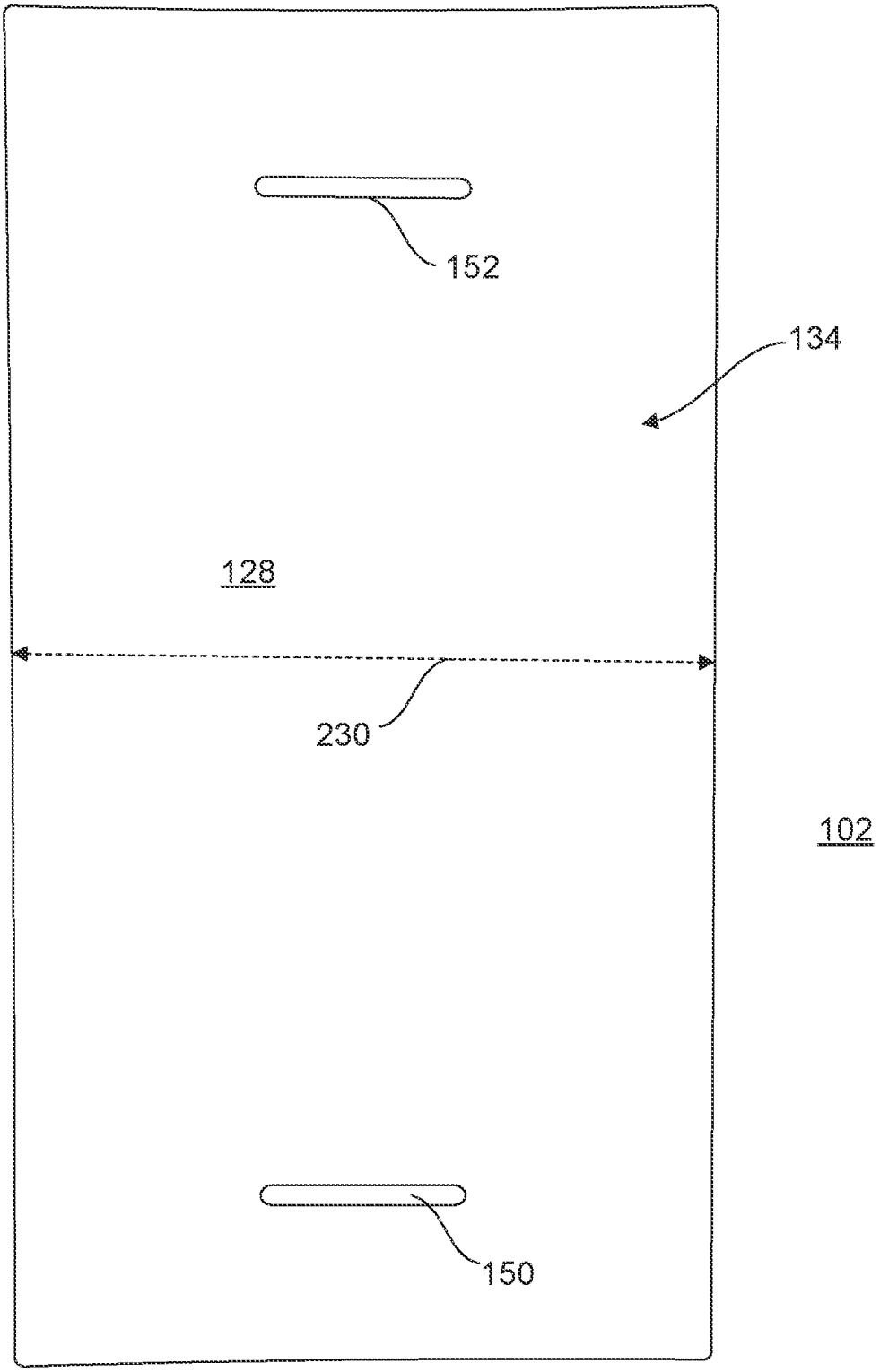
Figure 2C:
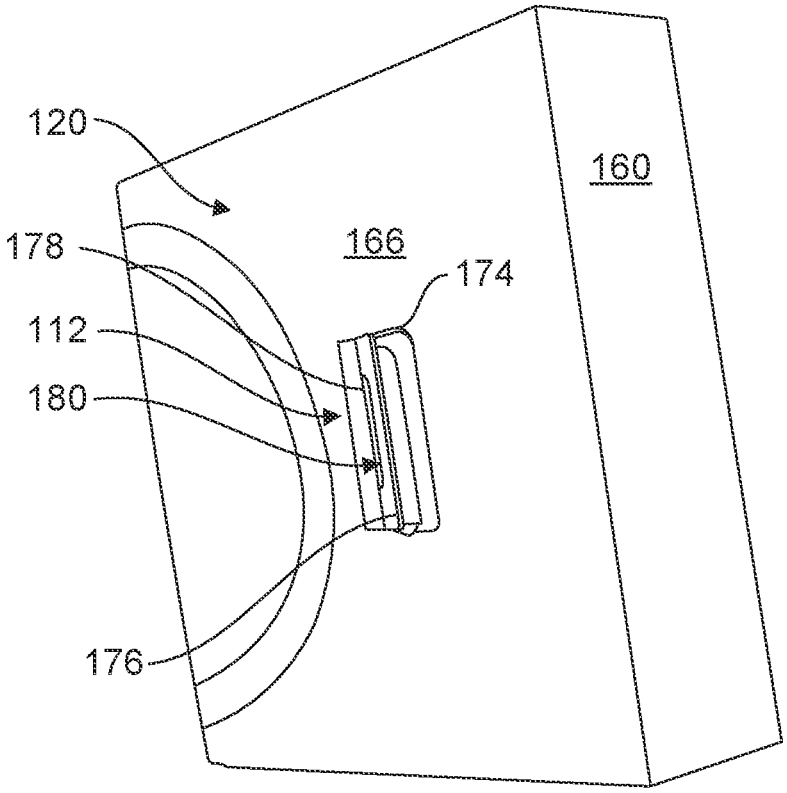
Figure 2D:
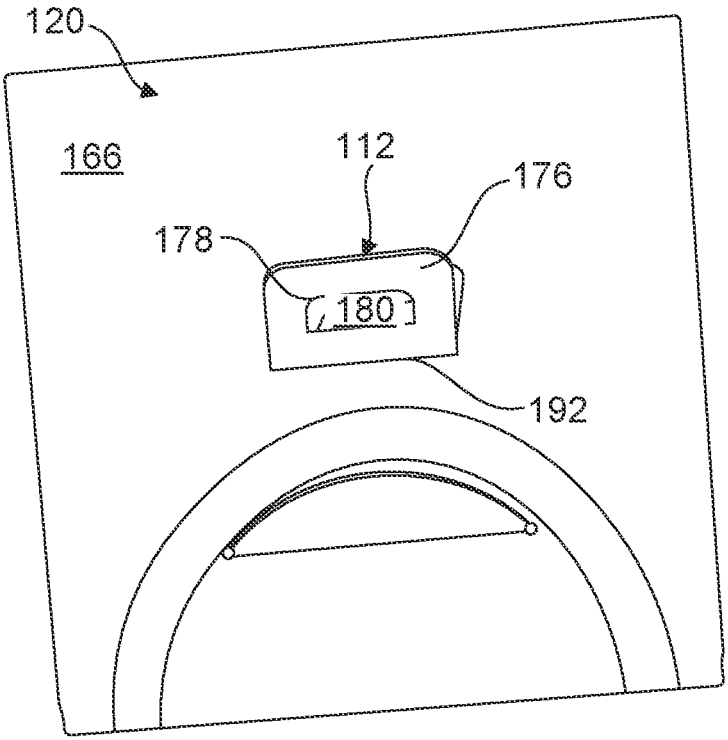
Figure 2E:
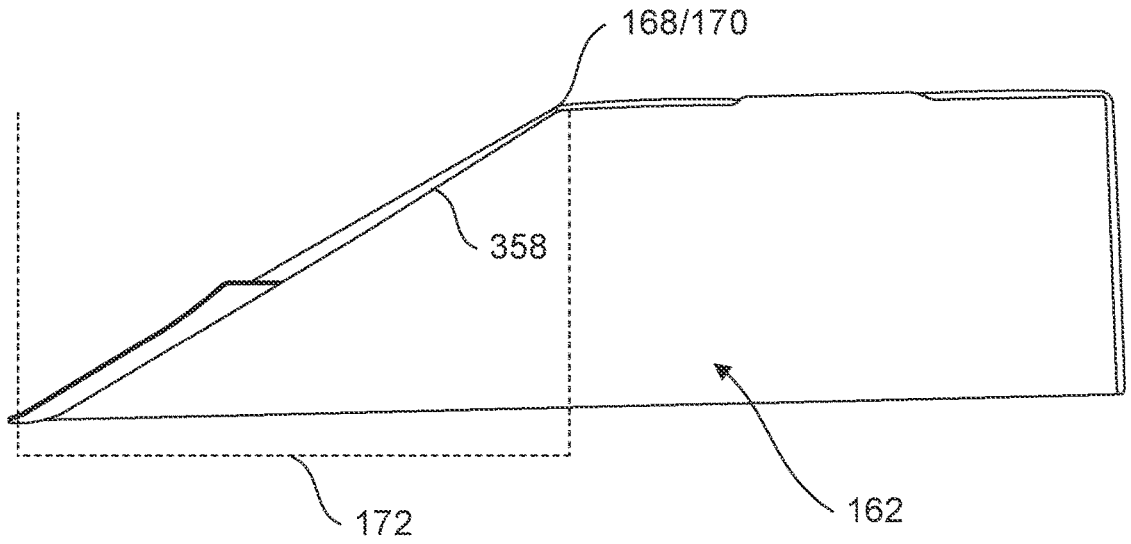

As illustrated in FIGS. 2A and 2B, takeout food container 100 may comprise of a tray 102 in a form of a rectangular open top box that includes a base 134 having an interior (or top) side 136 (FIG. 2A), an exterior (bottom) side 128 (FIG. 2B).

Tray 102 further includes a first longitudinal side 140, a second longitudinal side 142 identical to first longitudinal side 140, a first transverse side 144, and a second transvers side 146 identical to first transverse side 144. Tray 102 further includes edge slits that function as interlocking recessed slots 148 (optionally, one or more per side) for receiving interlocking projections 204 of one or more compartmentalizing pieces 202. Tray 102 in FIG. 2A is shown with compartmentalizing pieces removed for clarity.

As further illustrated, tray 102 may optionally include an optional first elongated opening 150 near first transverse side 144 and an optional second elongated opening 152 near second transvers side 146.

Optional first and second elongated openings 150 and 152 are identical, and are oriented longitudinally (along their longitudinal axis 154) parallel first and second transverse sides 144 and 146 of tray 102. As detailed below, first and second elongated openings 152 and 154 function as interlocking recesses to interlock with optional first and second interlocking projections 168 and 170 of first and second sleeve covers 104 and 106.

As illustrated in FIGS. 2C to 2I, takeout food container 100 may comprise of sleeve covers 104 and 106. First sleeve cover 104 is identical to second sleeve cover 106, forming a first support and a second support that enable leveled elevation of tray 102 to form a stable table-tray.

First and second sleeve covers 104 and 106 include an interior cavity 156 defined by a top side 120, a bottom side 158, sleeve base 160, sleeve base support 380, and first and second identical lateral sides 162 and 164.

Top side 120 of first and the second sleeve covers 104 and 106 has sufficient expanse to cover half an area of tray 102. Lateral sides 162 and164 of sleeve covers 104 and 106 partially overlap a longitudinal (or length) sides 140 and 142 of tray 102, with lateral sides 162 and 164 having extending lateral portions 172 (further detailed below).

Bottom side 158 of sleeves covers 104 and 106 cover over exterior bottom side 128 of tray 128, with an open side that defines cavity 156 that receives tray 102. Bottom side 158 includes an exterior bottom side portion 384 and an interior facing bottom side portion 386.

Closed sides (i.e., sleeve base support) 380 of sleeve covers 104 and 106 engages transverse (or width) sides 144 and 146 of tray 102.

As further detailed below, exterior facing side 166 of top side 120 of first and second sleeve covers 104 and 106 includes utensil holders 112 for keeping utensils 110, with utensils 110 functioning as a handle for takeout food container 100 when maintained by utensil holder 112.

As best shown in FIGS. 1K, 2C, 2D, 2J, and 2K, utensil holder 112 is comprised of an exterior cutout 174 from an exterior facing side 166 of first and the second sleeve covers 104, 106, forming an external flap 176. External flap 176 itself may include a cutout 178, forming an opening 180. Optionally, as best shown in FIG. 1K, cutout 178 may be a partial cutout where it may retain an internal flap 182 associated with opening 180. As illustrated, flap 176 is bent outward at its cantilever edge 192 from exterior facing side 166 of top side 120

Utensil 110 is inserted through opening 180, and the optional internal flap 182 associated with opening 180 may be used to further frictionally secure utensil 110 inserted within opening 180, preventing utensil 110 from sliding out of opening 180.

First and the second sleeve covers 104 and 106 include an interlock mechanism 126 that interlocks with an interlocking edge of first and the second sleeve covers 104 and 106 for assembly of first and the second sleeve covers 104 and 106 (further detailed below). Interlock mechanism 126 further interlocks with lateral sides 144 and 146 of the tray 102 for interlocking first and the second sleeve covers 104 and 106 with tray 102.

Figure 2F:
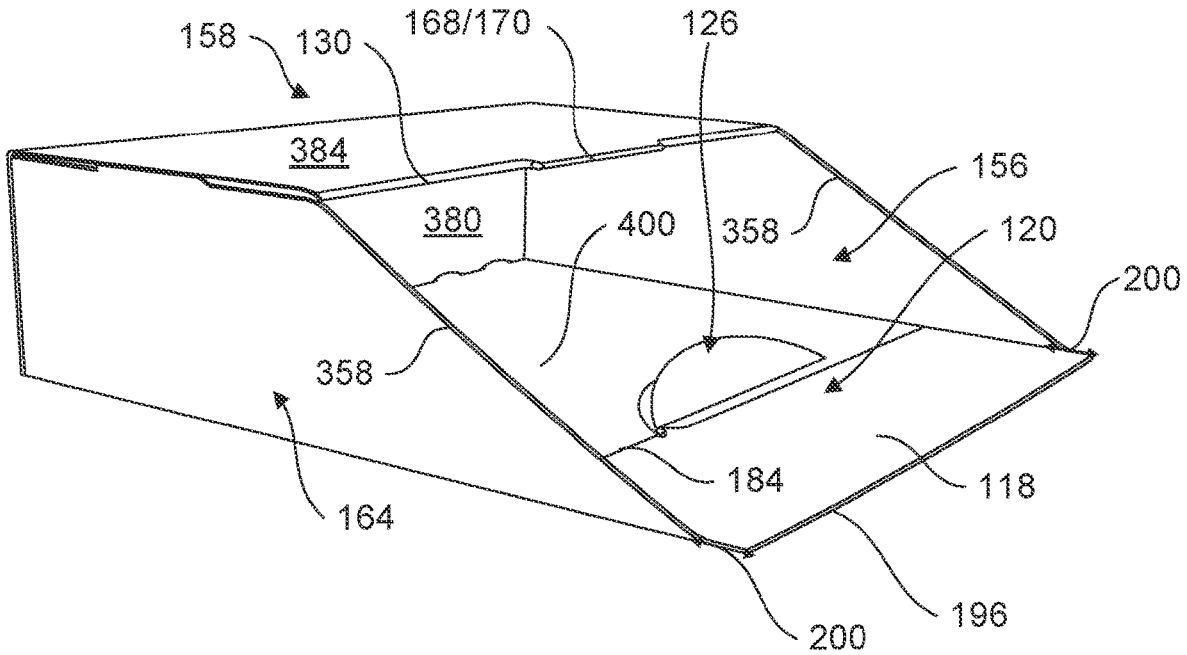
Figure 2G:
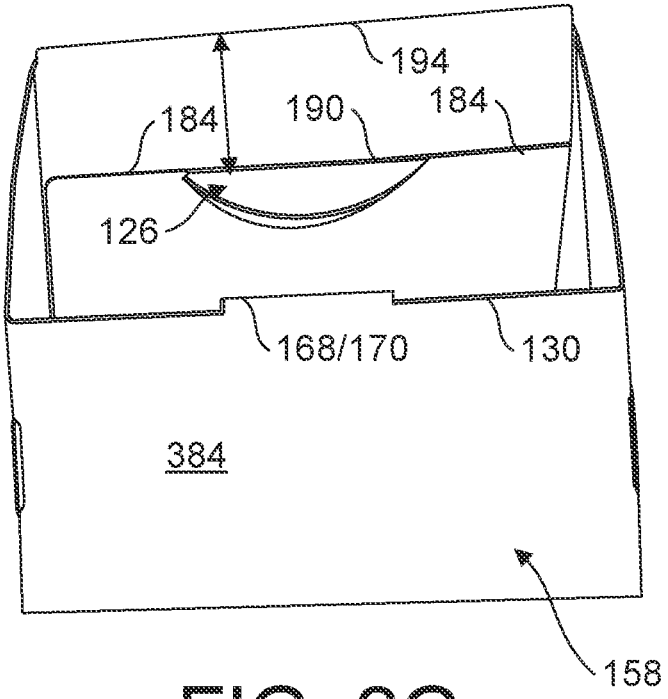
Figure 2H:
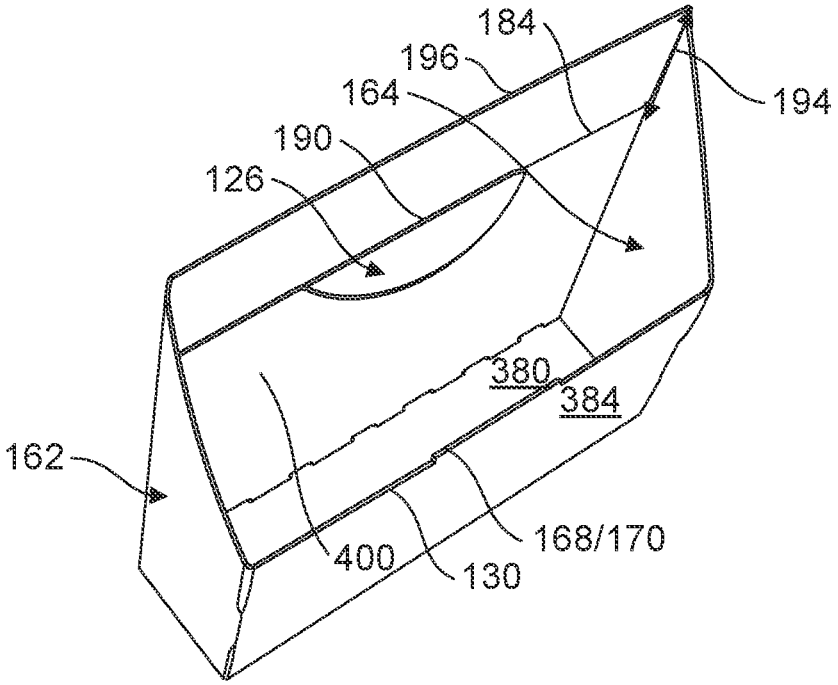
Figures 1, 2I:
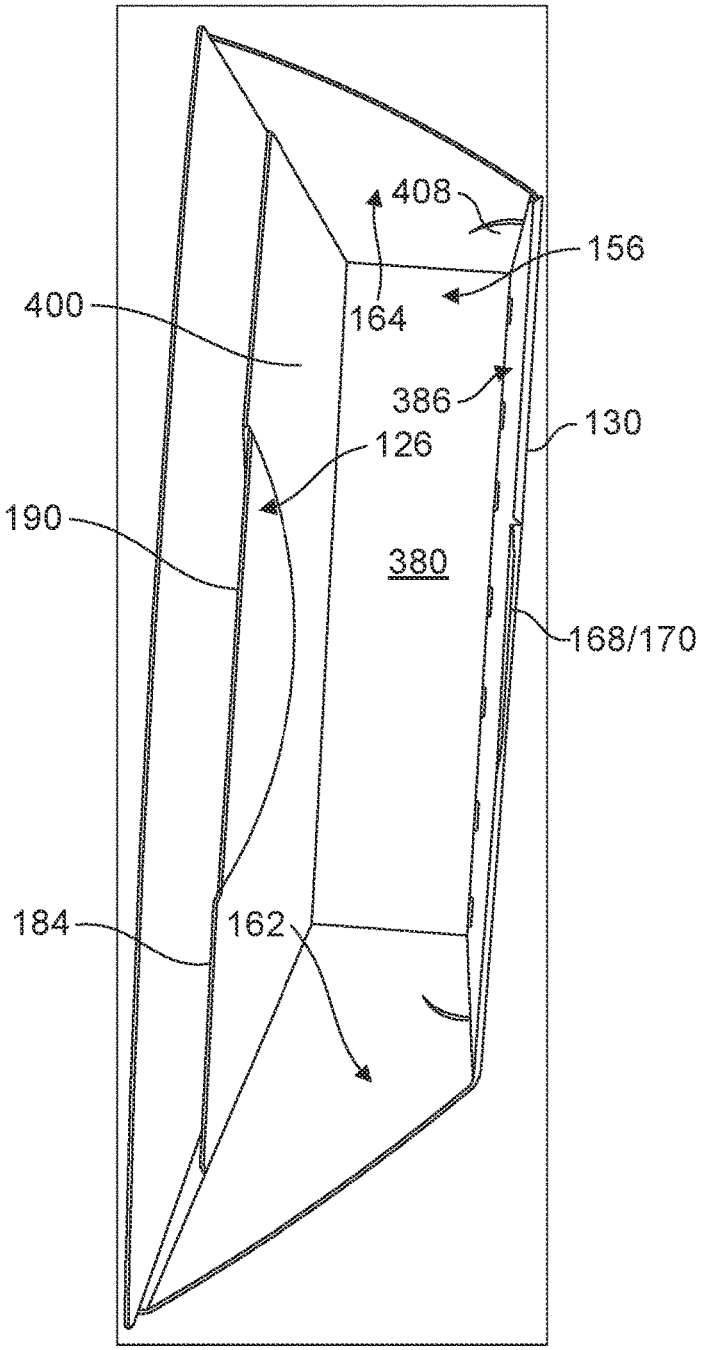
Figures 2, 2I:
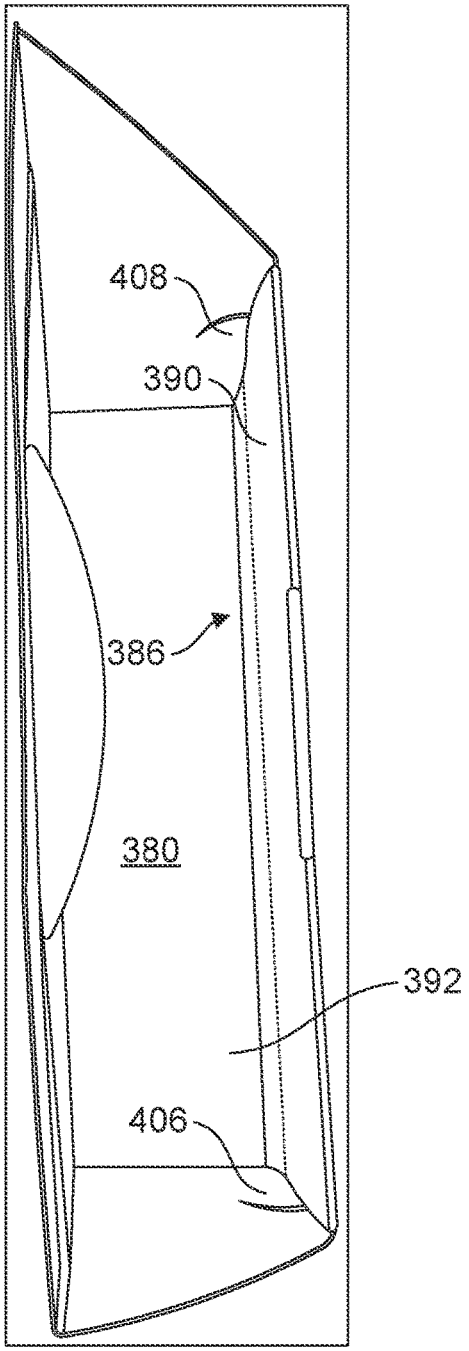
Figure 2J:
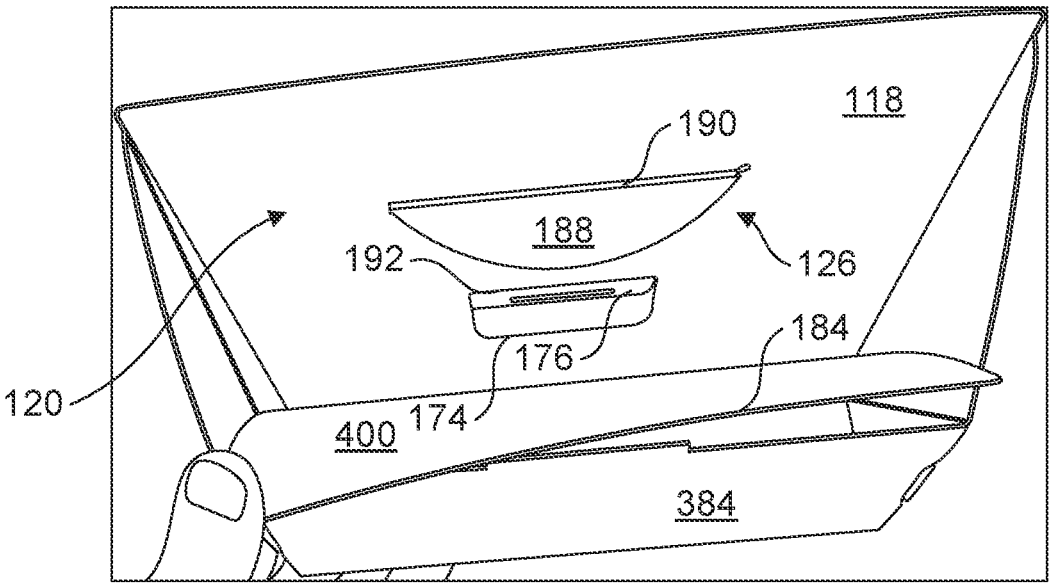
Figure 2K:
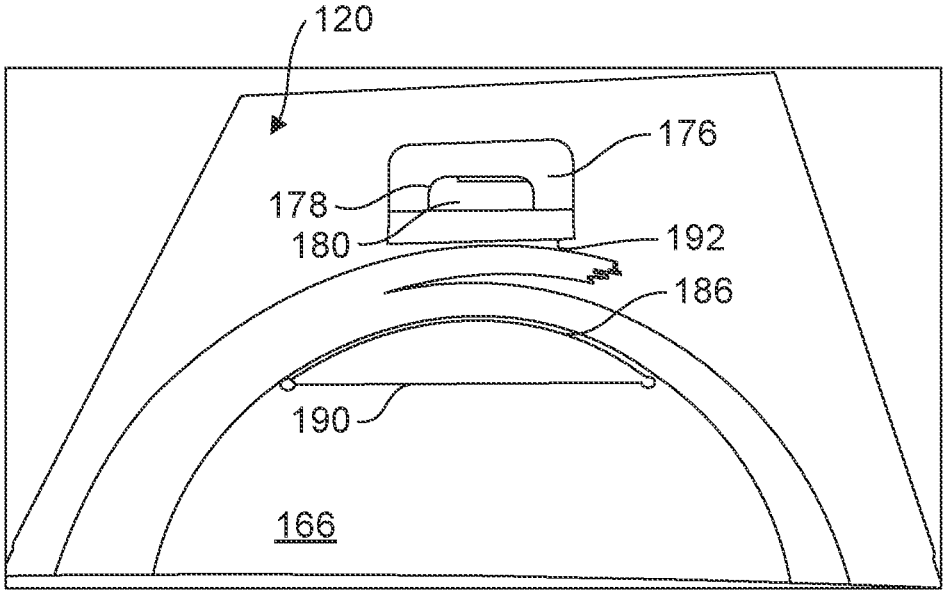

As best illustrated in FIGS. 2J and 2K, interlock mechanism 126 is comprised of a cutout 186 from top side 120 of first and the second sleeve covers 104 and 106, forming a semi-circular flap 188. Flap 188 is bent inwardly at its cantilever edge 190 from exterior facing side 166 of top side 120 to interior facing side 118 of top side 120.

Flap 188 overlaps an interlocking edge 184 of secondary interior facing top side support 400 first and the second sleeve covers 104 and 106 (when assembled) and overlaps lateral side 144 and 146 of tray 102 for table-tray position.

As shown in FIGS. 1P, 1Q, and 2G, interlock mechanism 126 is located at a distance 194 below a top free edge 196 of first and second sleeve covers 104 and 106 at a distance equal to or greater than a height 198 of a side of tray 102, thus lowering an overall center of gravity of the table-tray when tray 102 is interlocked with first and second sleeve covers 104 and 106. This arrangement provides stability and also, the extended height 194 above interlock mechanism 126 of sleeves 104 and 106 function as shield to prevent food from splashing out laterally.

Extended lateral portions 172 of lateral sides 162 and 164 of first and second sleeve covers 104 and 106 engage longitudinal sides 140 and 142 of tray 102 to thereby prevent tray from in-plane motion or lateral twisting when in tray-table position. As best shown in FIG. 2F, the extended lateral portions 172 have free edge.358 that are sloped and taper from supporting edge 130 towards top free edge 196, ending below top free edge 196 at a distance 200, which may optionally equal to ¼ the distance from interlocking edge 184 to top free edge 196.

Top edge 130 of bottom side 158 may optionally include an extended flange 168/170 that form optional first and second interlocking projections 168 and 170 of respective first and second sleeve covers 104 and 106, which may interlock with optional first and second elongated openings 150 and 152.

Figure 3:
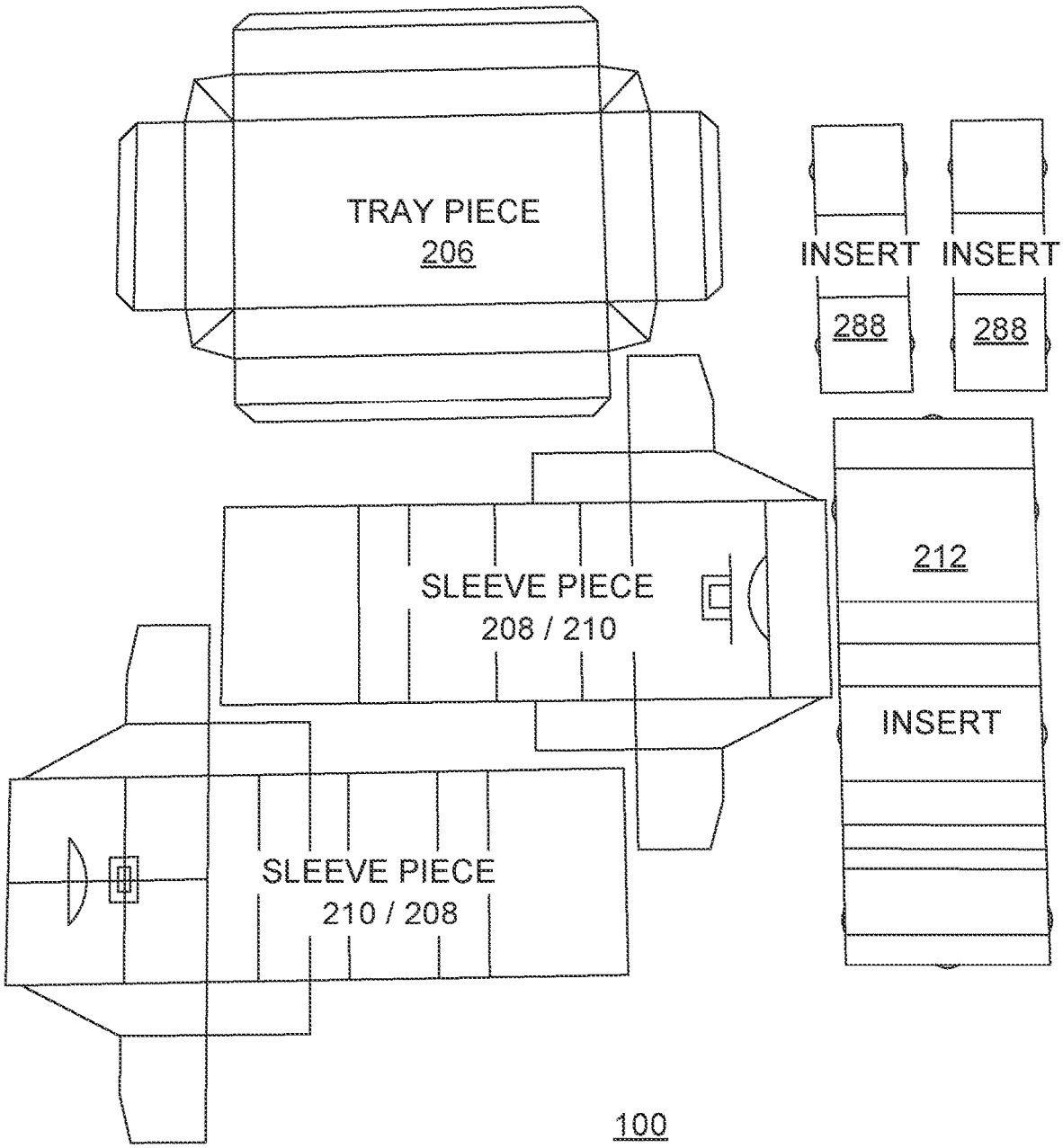
FIG. 3 is a non-limiting, exemplary illustration of the various pieces that may be used to assemble takeout food containers shown in FIGS. 1A to 2K in accordance with one or more embodiments of the present invention.

FIG. 3 is a non-limiting, exemplary illustration of the various pieces that may be used to assemble takeout food containers shown in FIGS. 1A to 2K in accordance with one or more embodiments of the present invention. Any additional optional features in takeout food container shown in FIGS. 2A to 2K are further detailed in relation to FIGS. 7A to 7D-4.

As illustrated, takeout food container 100 is comprised of a tray piece 206, sleeve cover pieces 208 and 210 (that are identical), and optional divider pieces (compartmentation pieces or inserts) 212, and two identical divider pieces 288.

More specifically, takeout food container 100 includes tray piece 206, which is comprised of a first flat, single piece, cut-out material (well known food grade or food safe cardboard paper) that is folded about one or more fold lines to form tray 102 of takeout food container 100. It should be noted that the fold lines may be scored lines, perforated lines, or simply indicated by markings.

Further, takeout food container 100 includes two sleeve cover pieces 208 and 210, which are comprise of a second flat, single piece, cut-out material (food grade or food safe cardboard paper) that are folded about one or more fold-lines to form sleeve covers 104 and 106 of takeout food container 100.

Optional dividers 212/288 are also comprised of flat, single piece, cut-out material (food grade or food safe cardboard paper) that are folded about one or more fold-lines to form the dividers 202, which may then be inserted in tray 102 to compartmentalize tray 102.

It should be noted that no adhesives or other additional coupling mechanisms is needed or required in the entire assembly of takeout food container 100. This makes takeout food container 100 food-safe and easy to store, ship, and assemble. As importantly, flat cardboard pieces make it easy to ship a large number of trays, sleeves, and divider pieces in a very small form factor.

It should further be noted that since both first and second sleeve cover pieces are identical, only a single manufactured cut-out (for example, press cut) is required. This means one cut-out configured may be used for both the first and the second cover pieces. Accordingly, only two press cuts may be needed to press-cut the tray piece and sleeve cover pieces.

Figure 4:
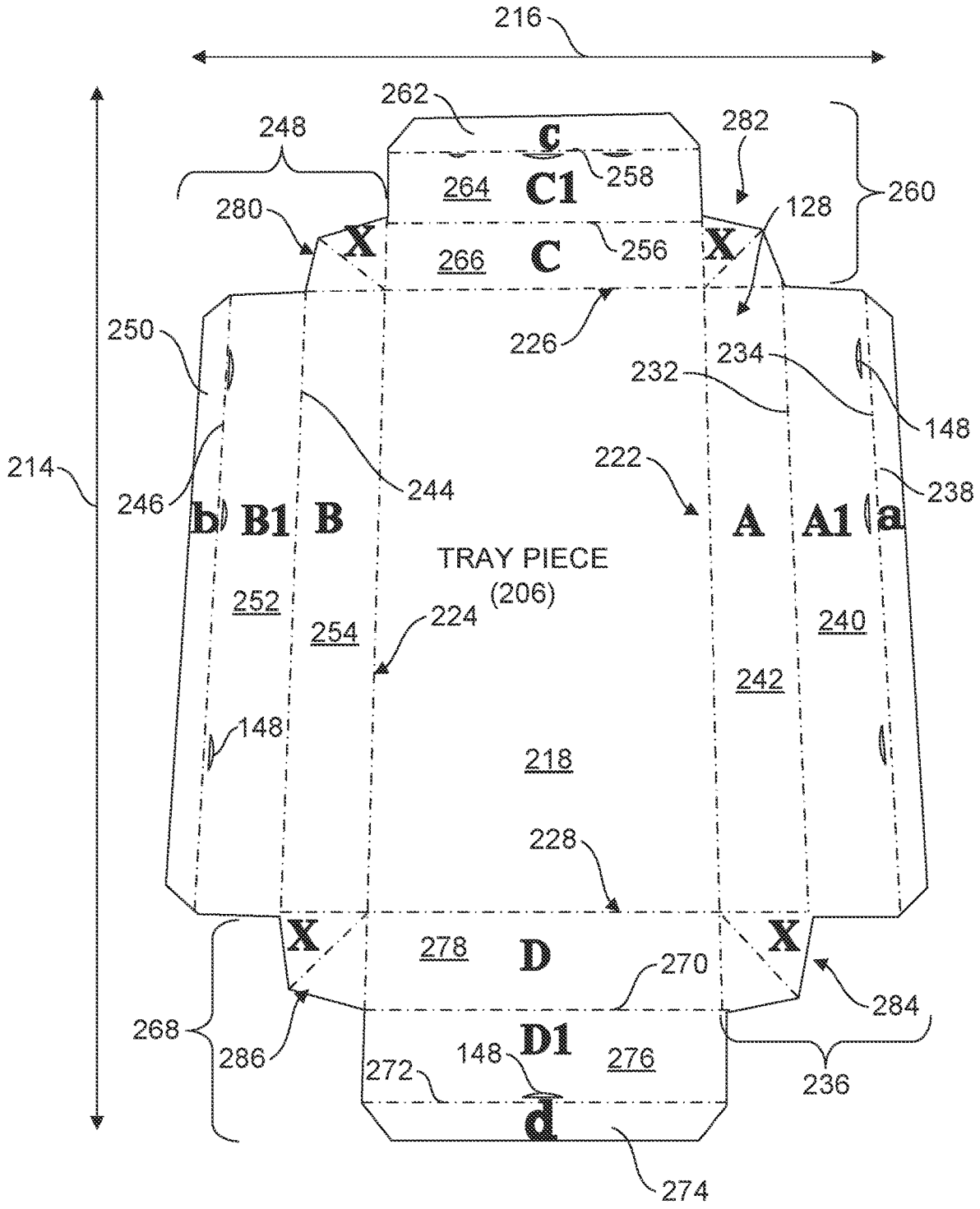

FIG. 4 is a non-limiting, exemplary illustration of an enlarged view of the tray piece shown in FIG. 3 of a tray of a takeout food container shown in FIGS. 1A to 3 in accordance with one or more embodiments of the present invention.

As illustrated in FIG. 4, first piece (i.e., tray piece) 206 shown with exterior (or bottom) side 128 on top has a longitudinal axis 214 and a transverse axis 216 and includes a rectangular core section 218 (delineated by fold-lines 222, 224, 226, 228). In this non-limiting, exemplary embodiment, tray piece 206 does not include the optional first and second elongated openings 150 and 152. It should be noted that interior (or top) side 136 and exterior (or bottom) side 128 of first piece (i.e., tray piece) 206 are identical.

Rectangular core section 218 forms base 134 of tray 102. Rectangular core section 218 has a first and a second longitudinal sides defined by fold-lines 222 and 224 extending parallel along longitudinal axis 214. First and second longitudinal sides defined by fold-lines 222 and 224 form longitudinal axis 108 of tray 102.

Rectangular core section 218 also has a first and a second transverse sides defined by fold-lines 226 and 228 extending along transverse axis 216 of tray piece 206. First and second transverse sides defined by fold-lines 226 and 228 form transverse axis 230 of tray 102.

Parallel adjacent fold-line 222 are a first set of linear fold lines 232 and 234, all of which define first longitudinal sections 236 that when folded form one of the longitudinal sides 140 and 142 of tray 102 as further detailed below.

First longitudinal sections 236 include a first outer longitudinal section 238 (also labeled as "a") that is configured as an Isosceles Trapezoid.

First longitudinal sections 236 further include a first middle longitudinal section 240 (also labeled as "A1") that is configured as a first middle rectangle and includes one or more interlocking recessed slots 148 for insertion of interlocking protruding projections (or tabs) 204 of dividers 202.

First longitudinal sections 236 further include a first inner longitudinal section 242 (also labeled as "A") that is configured as a first inner rectangle.

Parallel adjacent fold-line 224 are a second set of linear fold lines 244 and 246, all of which define second longitudinal sections 248 that when folded form one of the longitudinal sides 142 and 140 of tray 102 as further detailed below.

Second longitudinal sections 248 include a second outer longitudinal section 250 (also labeled as "b") that is configured as an Isosceles Trapezoid.

Second longitudinal sections 248 further include a second middle longitudinal section 252 (also labeled as "B1") that is configured as a second middle rectangle and includes one or more interlocking recessed slots 148 for insertion of interlocking protruding projections (or tabs) 204 of dividers 202.

Second longitudinal sections 248 further include a second inner longitudinal section 254 (also labeled as "B") that is configured as a second inner rectangle.

Parallel adjacent fold-line 226 are a third set of linear fold lines 256 and 258, all of which define first transverse sections 260 that when folded form one of the transverse sides 144 and 146 of tray 102 as further detailed below.

First transverse sections 260 include a first outer transverse section 262 (also labeled as "c") that is configured as an Isosceles Trapezoid.

First transverse sections 260 further include a first middle transverse section 264 (also labeled as "C1") that is configured as a third middle rectangle and includes one or more interlocking recessed slots 148 for insertion of interlocking protruding projections (or tabs) 204 of dividers 202.

First transverse sections 260 further include a first inner transverse section 266 (also labeled as "C") that is configured as a third inner rectangle.

Parallel adjacent fold-line 228 are a fourth set of linear fold lines 270 and 272, all of which define second transverse sections 268 that when folded form one of the transverse sides 146 and 144 of tray 102 as further detailed below.

Second transverse sections 260 include a second outer transverse section 274 (also labeled as "d") that is configured as an Isosceles Trapezoid.

Second transverse sections 268 further include a second middle transverse section 276 (also labeled as "D1") that is configured as a fourth middle rectangle and includes one or more interlocking recessed slots 148 for insertion of interlocking protruding projections (or tabs) 204 of dividers 202.

Second transverse sections 268 further include a second inner transverse section 278 (also labeled as "D") that is configured as a fourth inner rectangle.

The rectangular core section 218 also includes four corner sections 280, 282, 284, 286 (also labeled as "X") with middle diagonal fold-lines that connect adjacent inner longitudinal sections 242, 254 with inner transverse sections 270, 266.

FIGS. 4A-1 to 4B-20 are non-limiting, exemplary illustrations of a tray piece, progressively illustrating a non-limiting, exemplary method of assembly thereof in accordance with one or more embodiments of the present invention.

Figures 1, 4A:
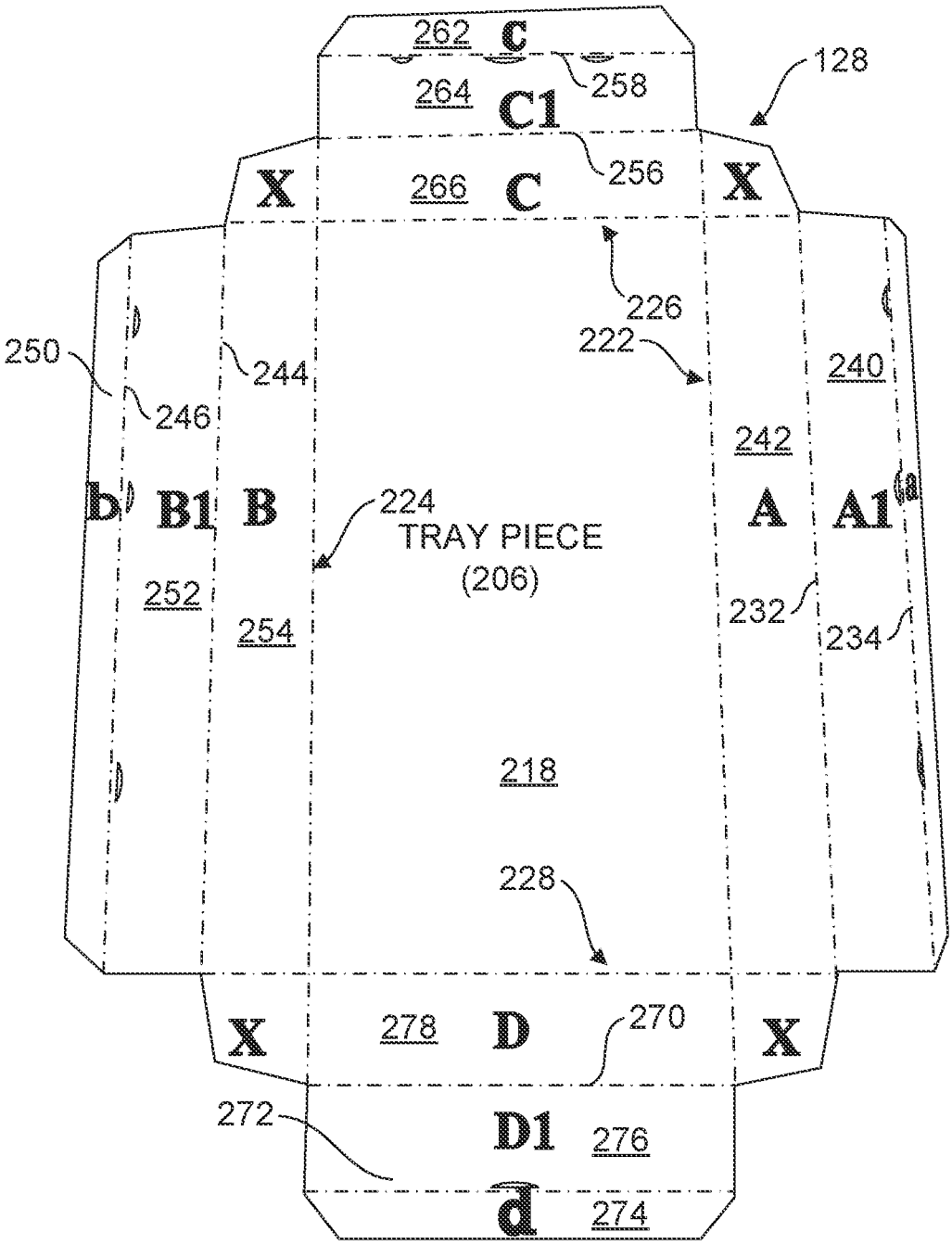
Figures 2, 4A:
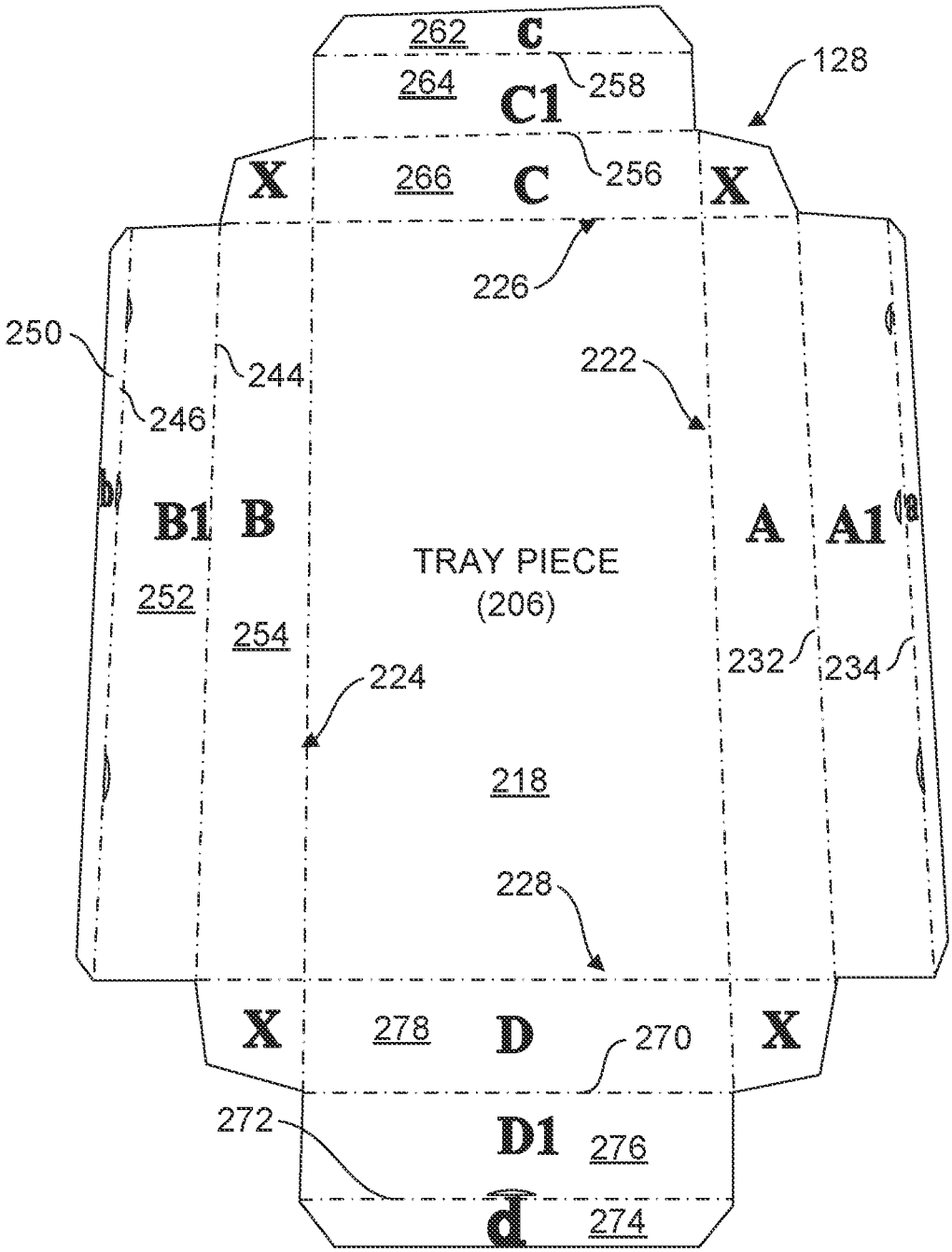
Figures 3, 4A:
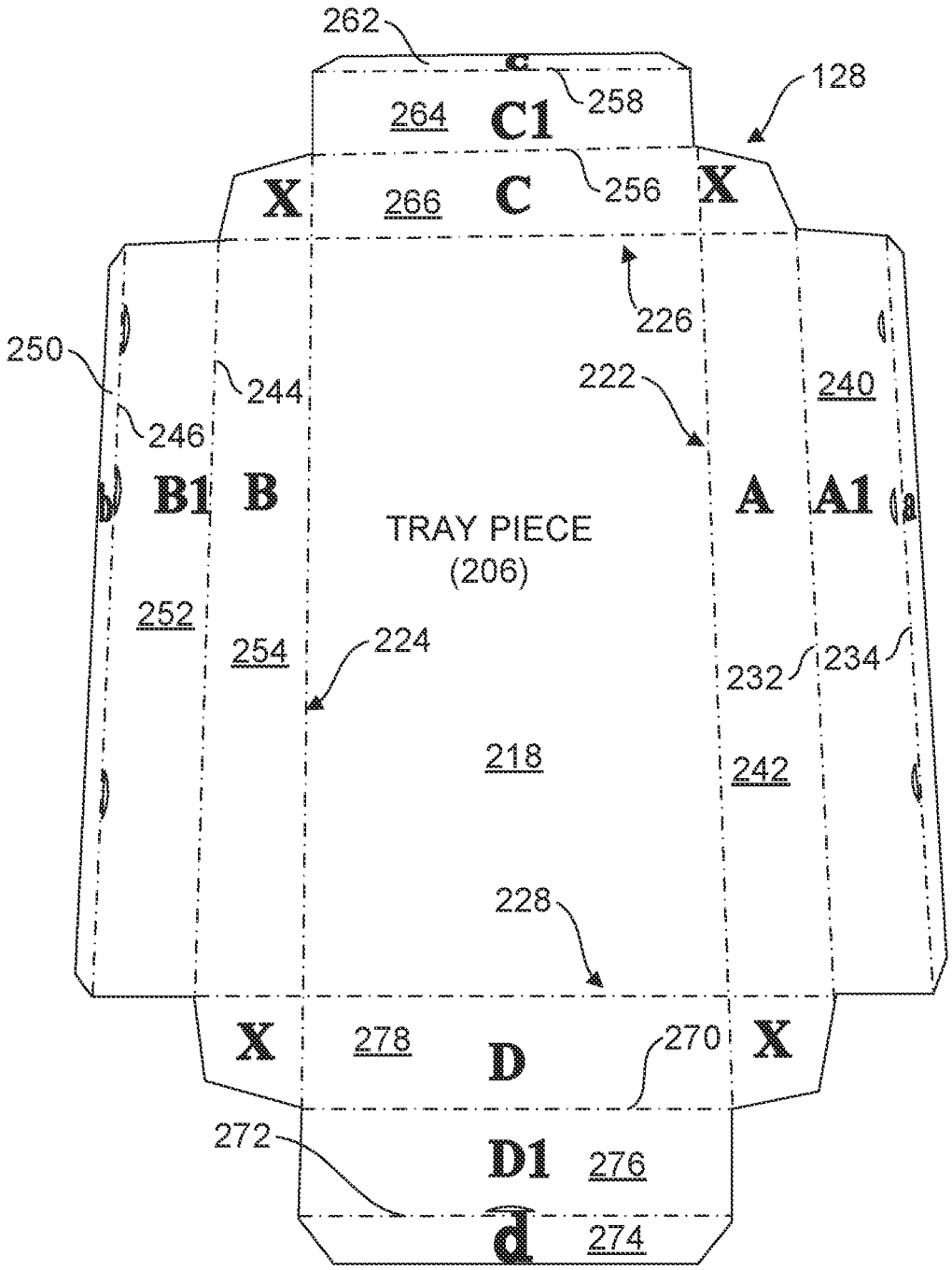
Figures 4, 4A:
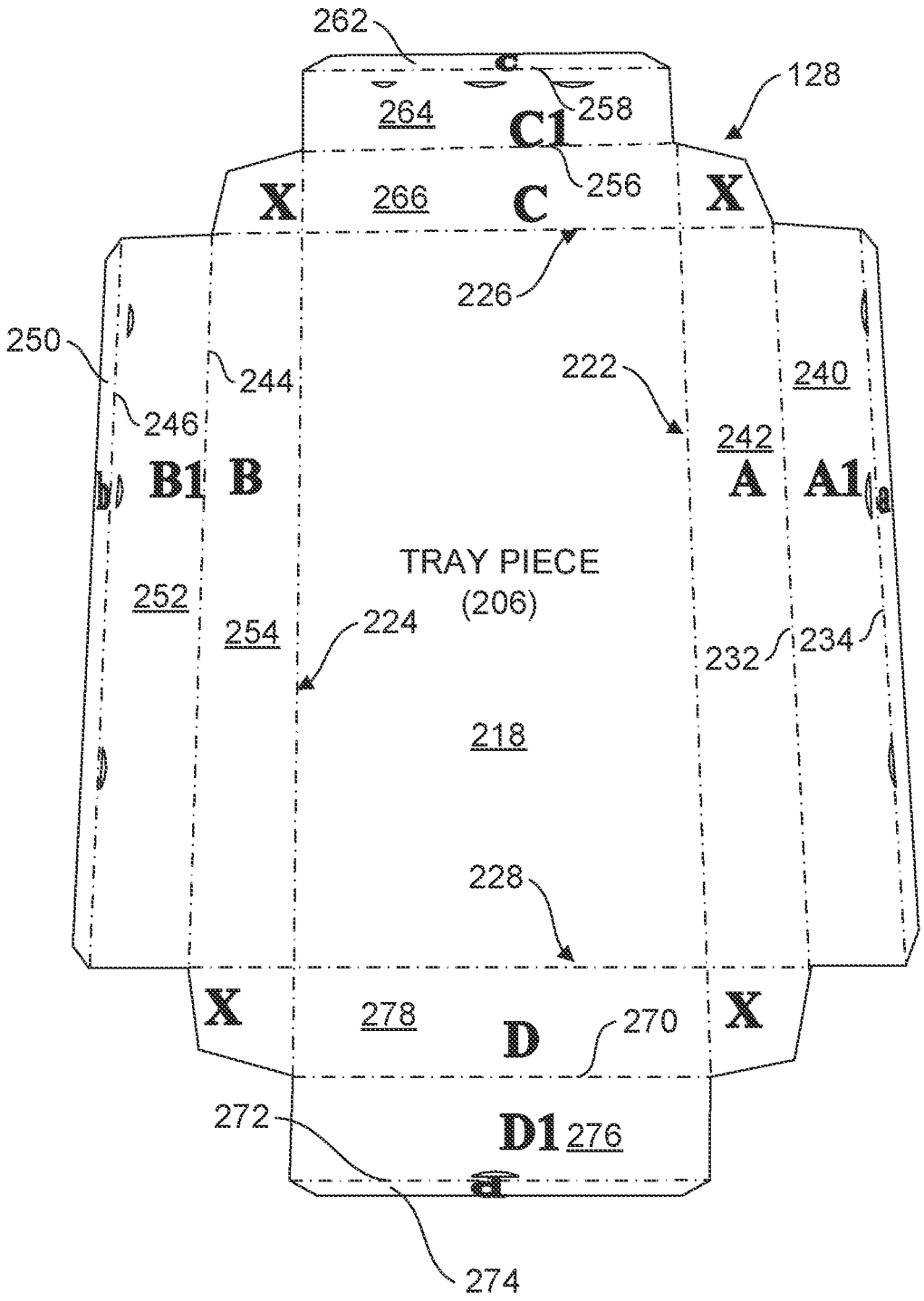
Figures 1, 4B:
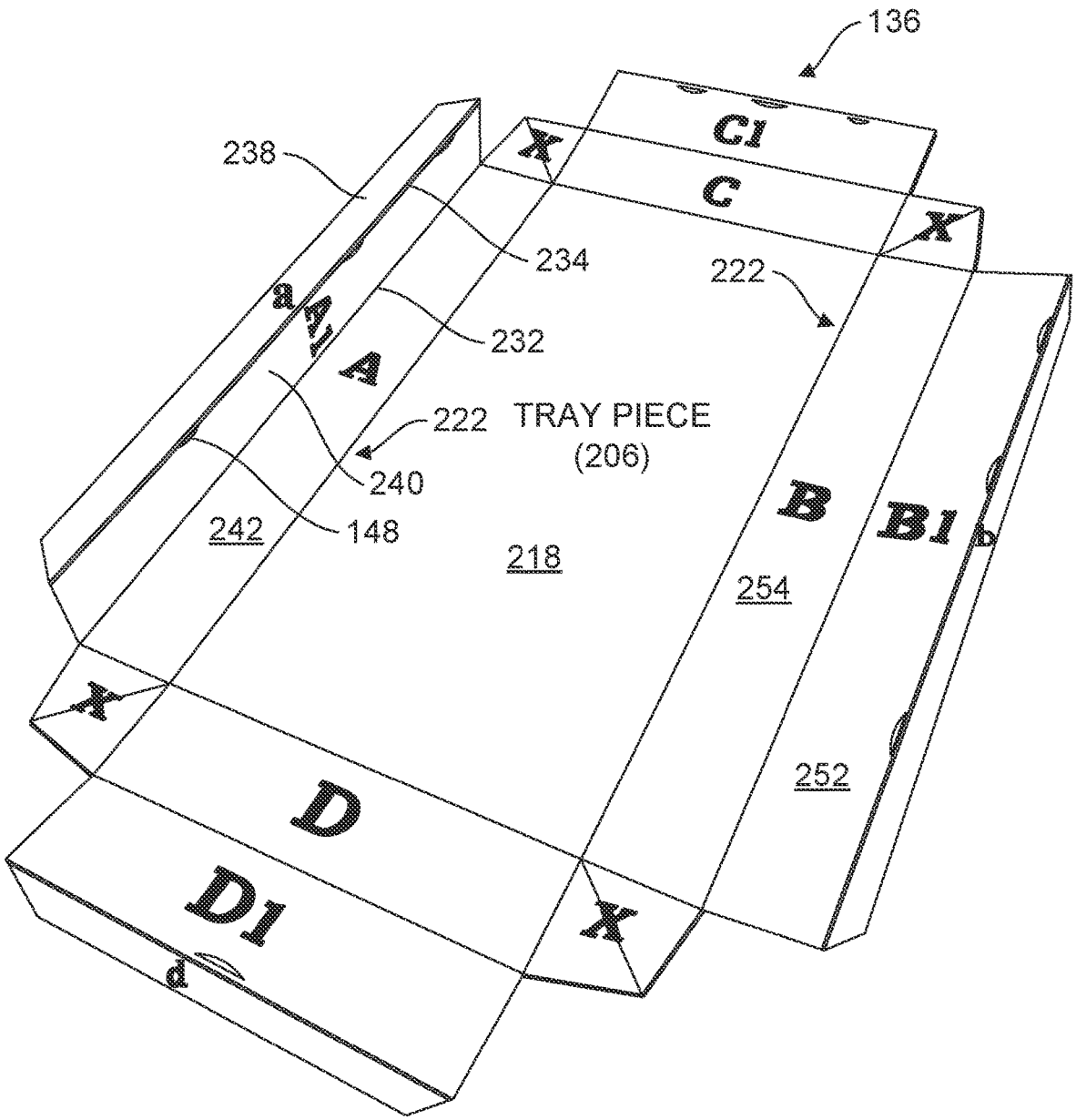
Figures 2, 4B:
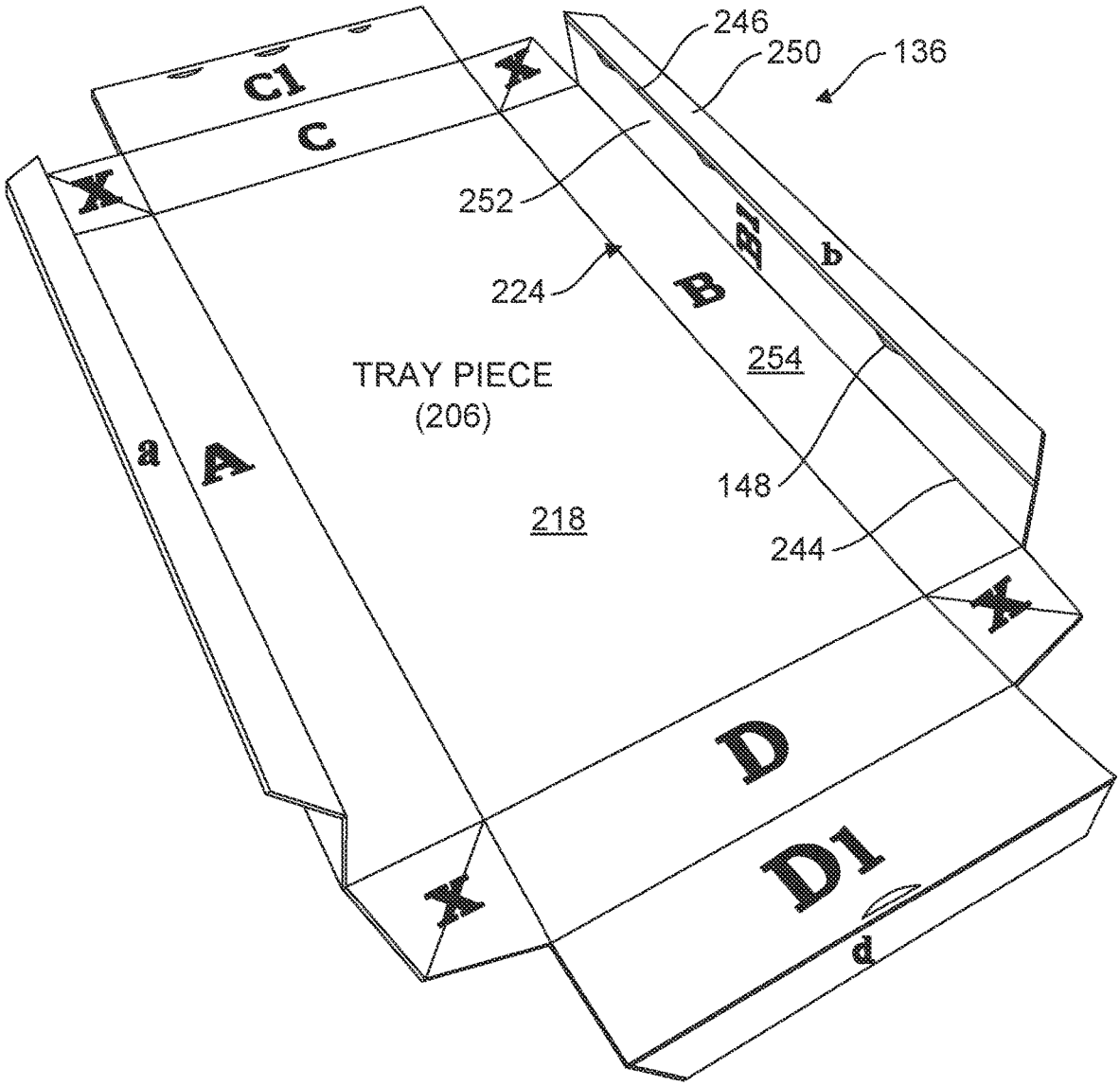
Figures 3, 4B:
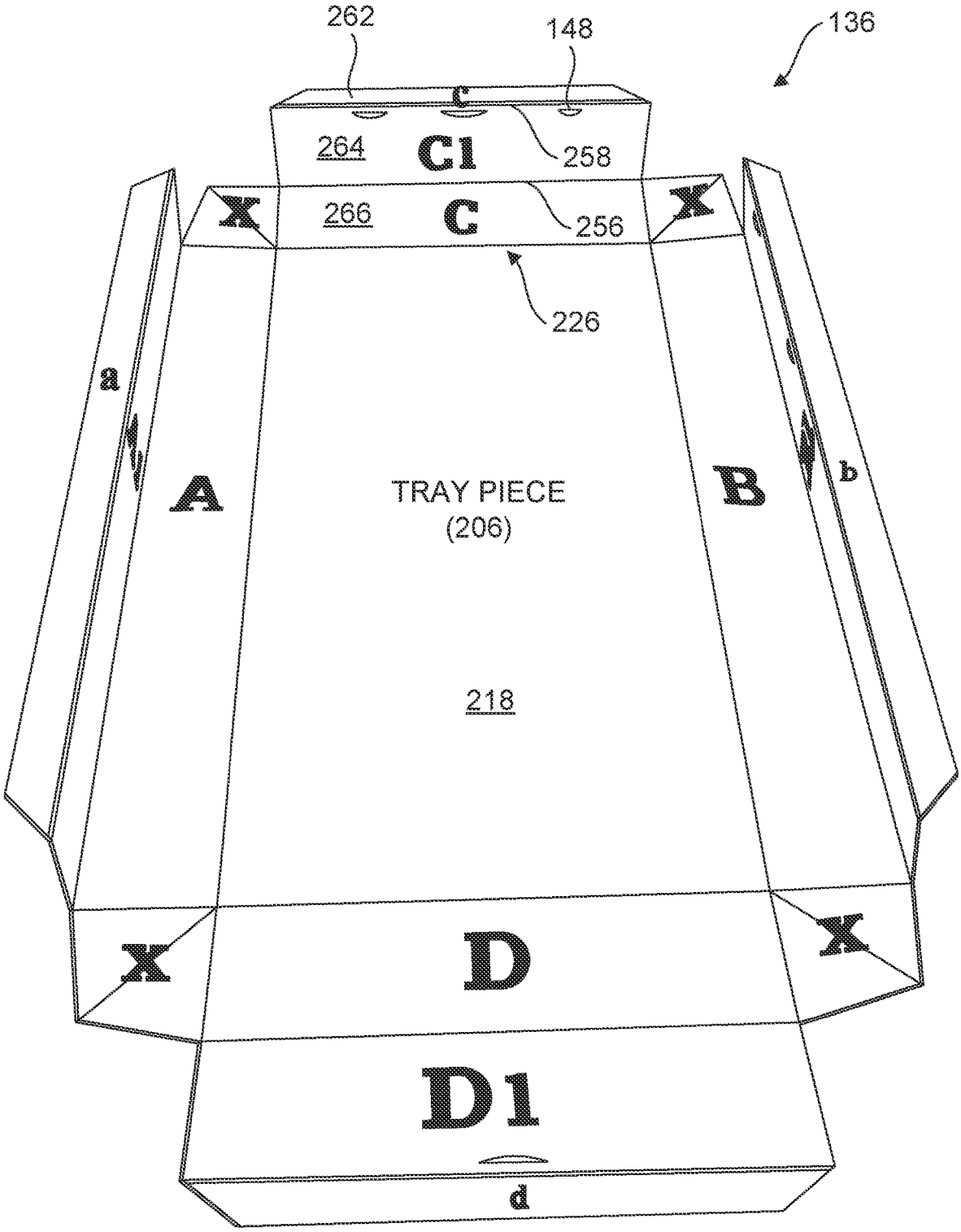
Figures 4, 4B:
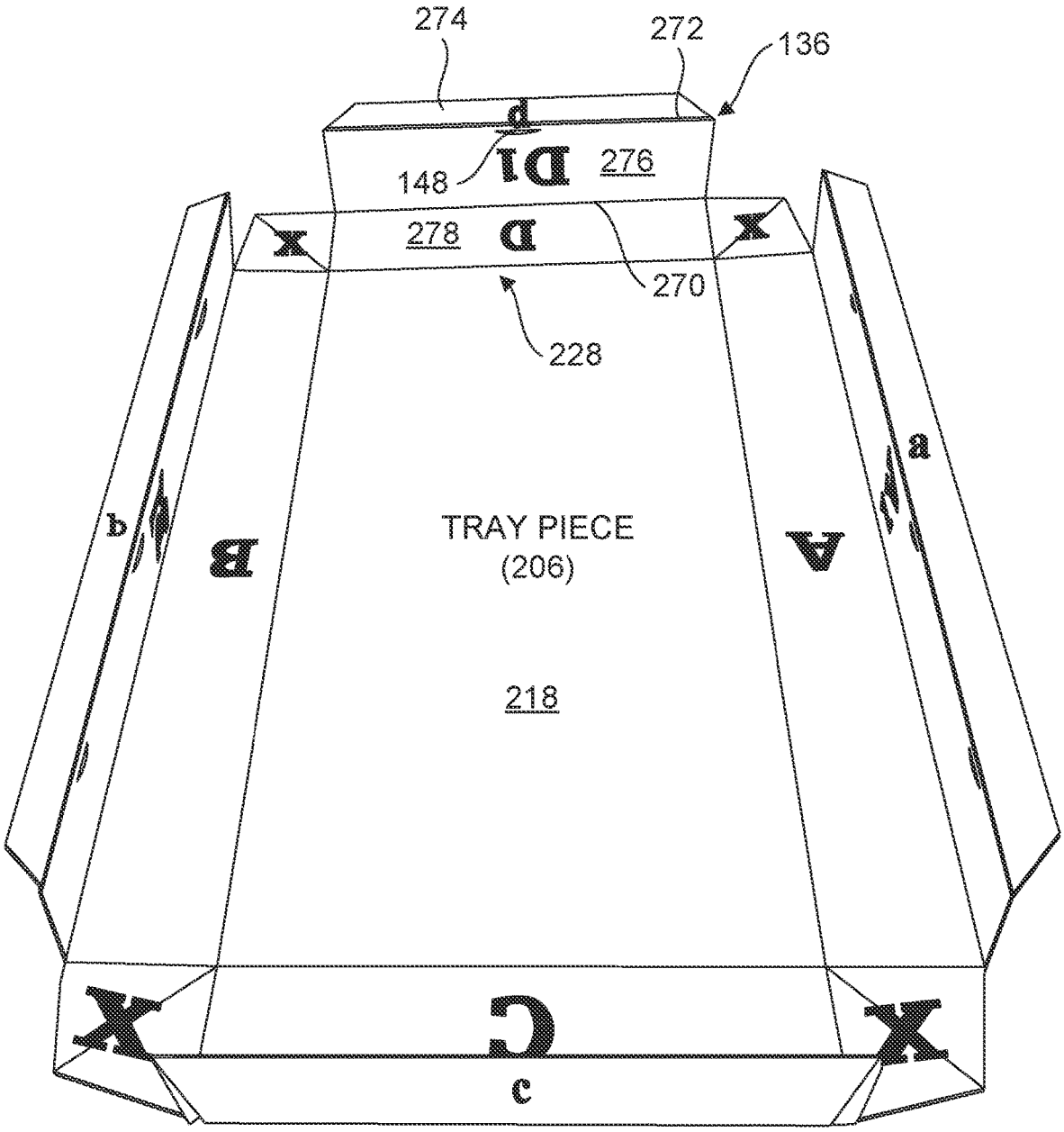
Figures 4, 4B, 5:
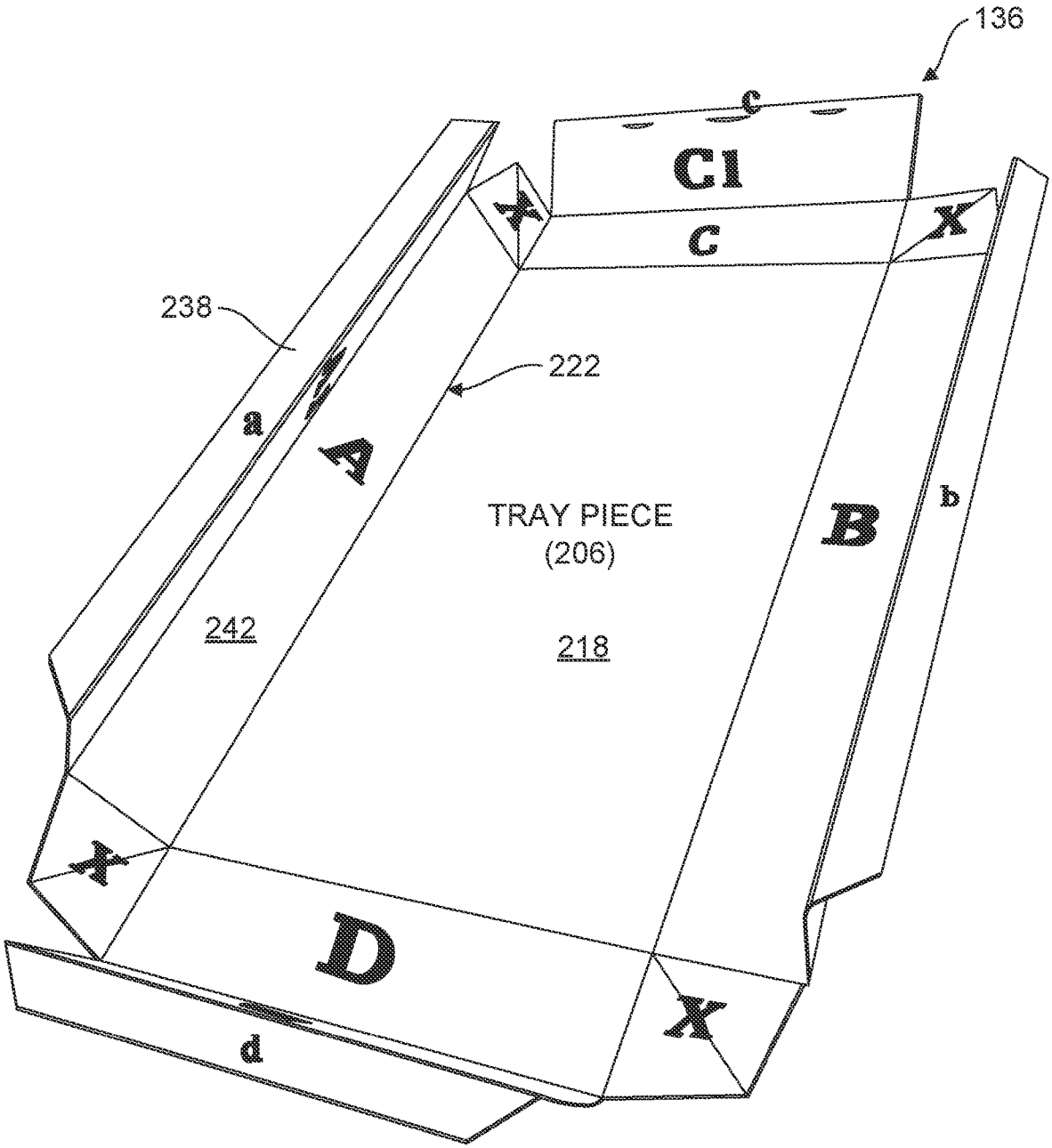
Figures 4, 4B, 5, 6:
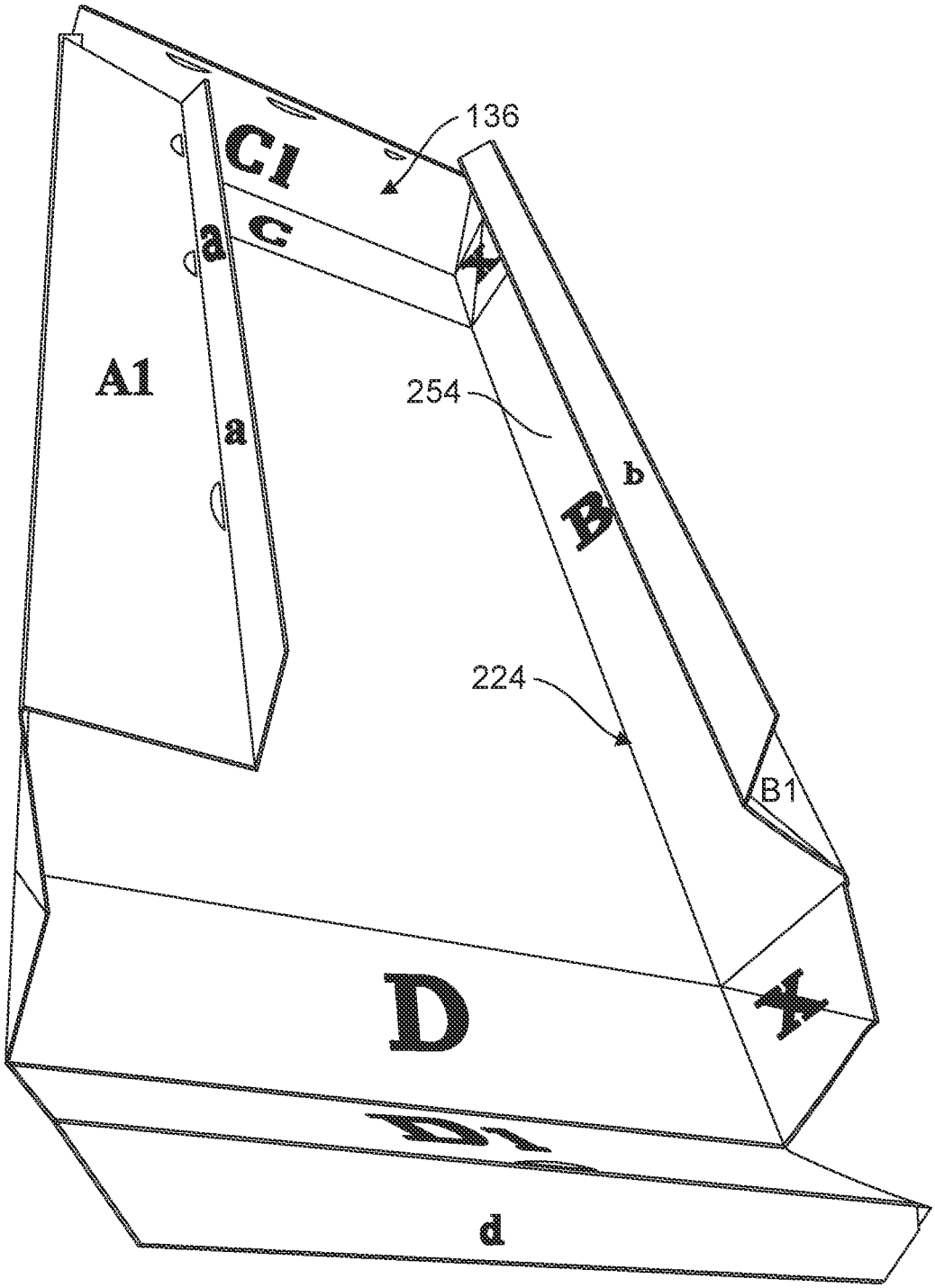
Figures 4, 4B, 5, 6, 7:
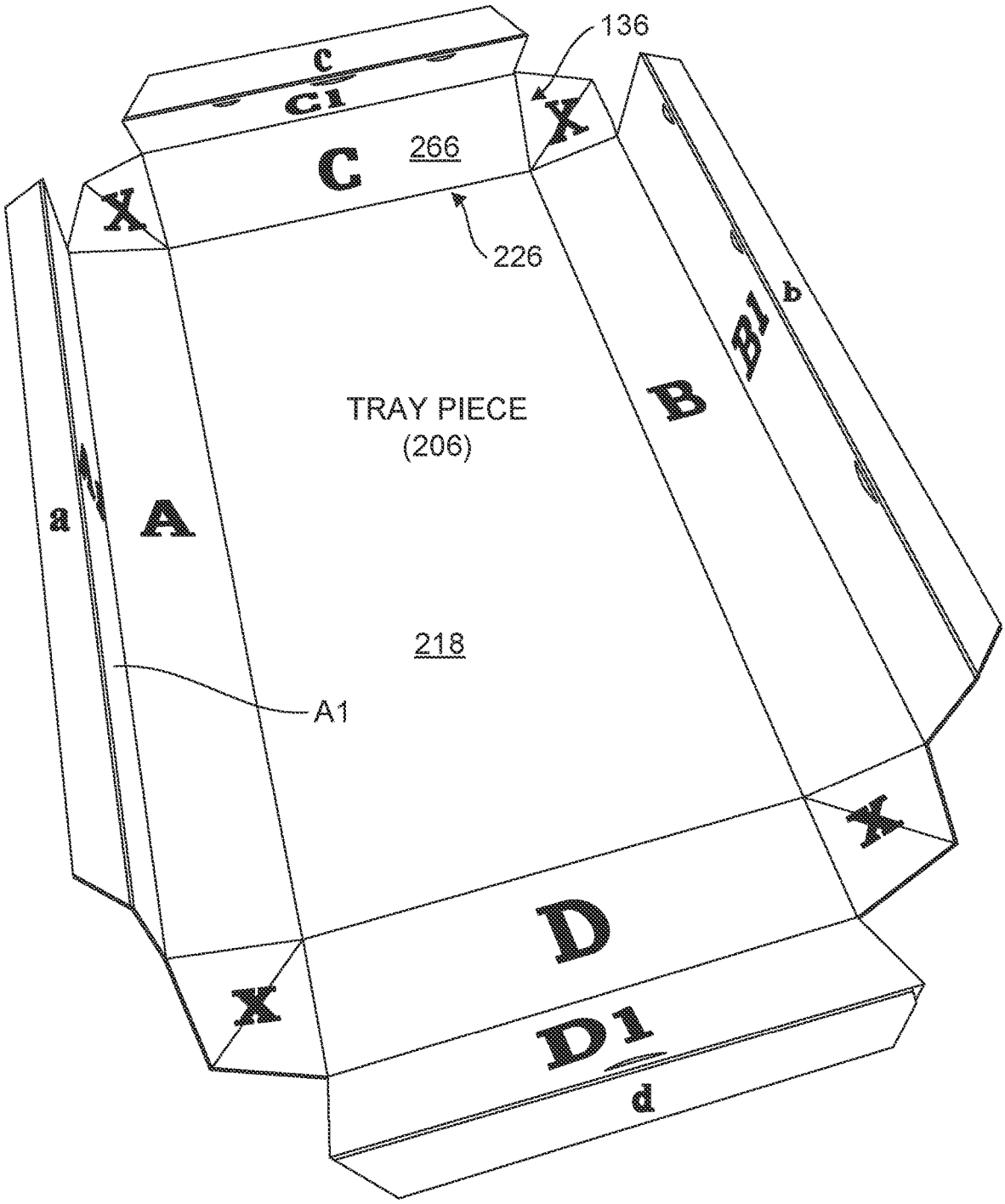
Figures 4, 4B, 5, 6, 7, 8:
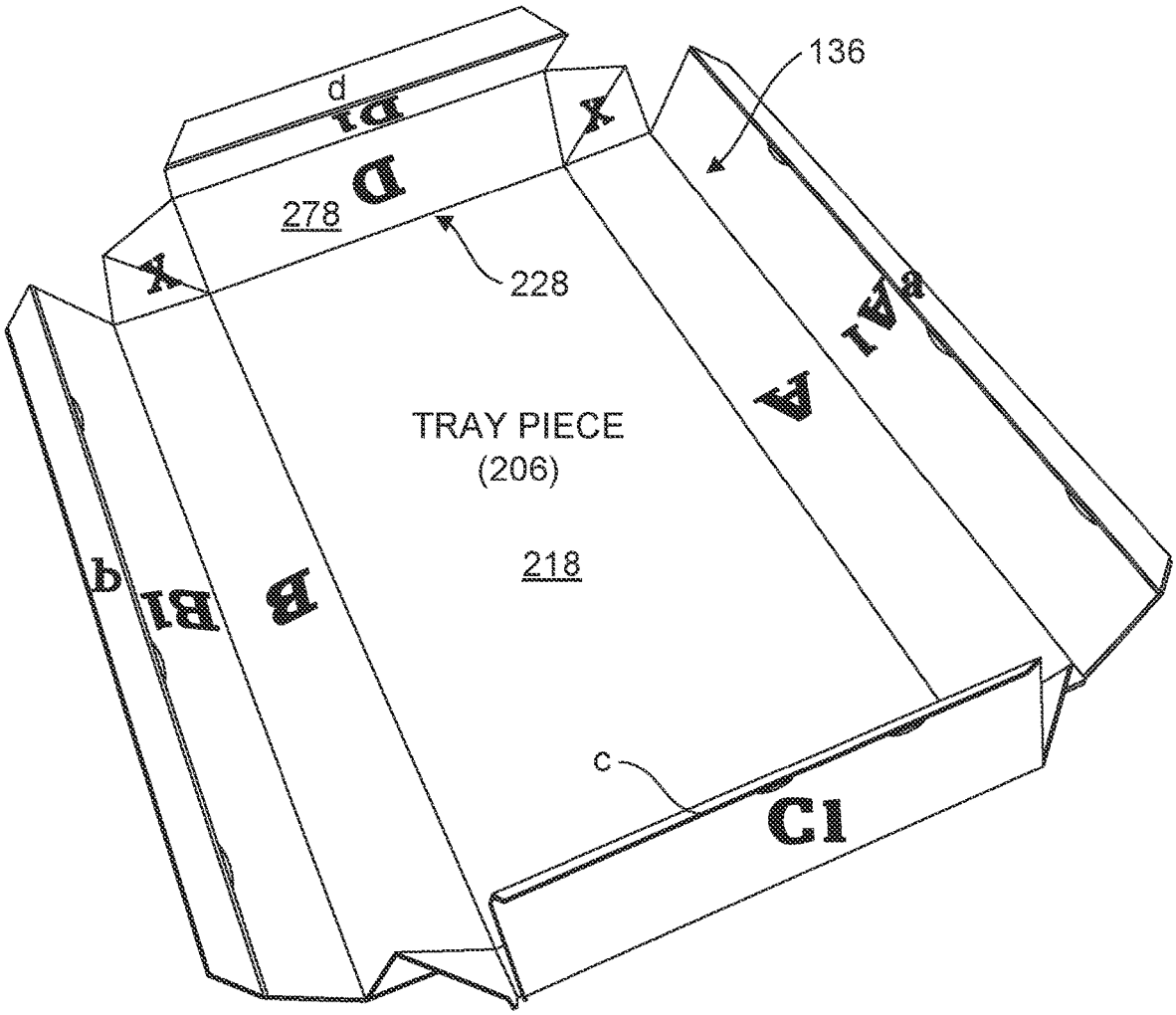
Figures 4, 4B, 5, 6, 7, 8, 9:
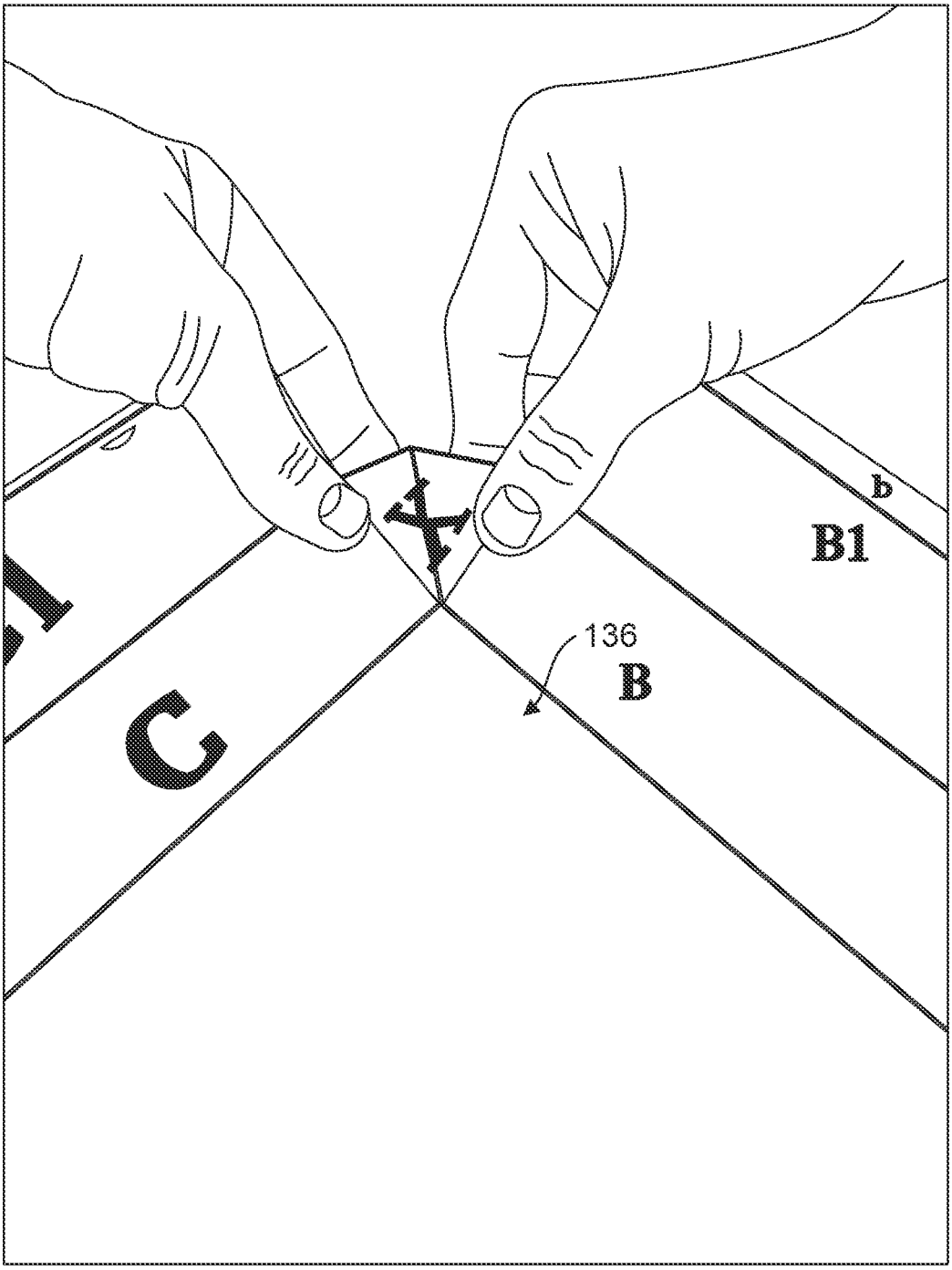
Figures 4, 4B, 5, 6, 7, 8, 9, 10:
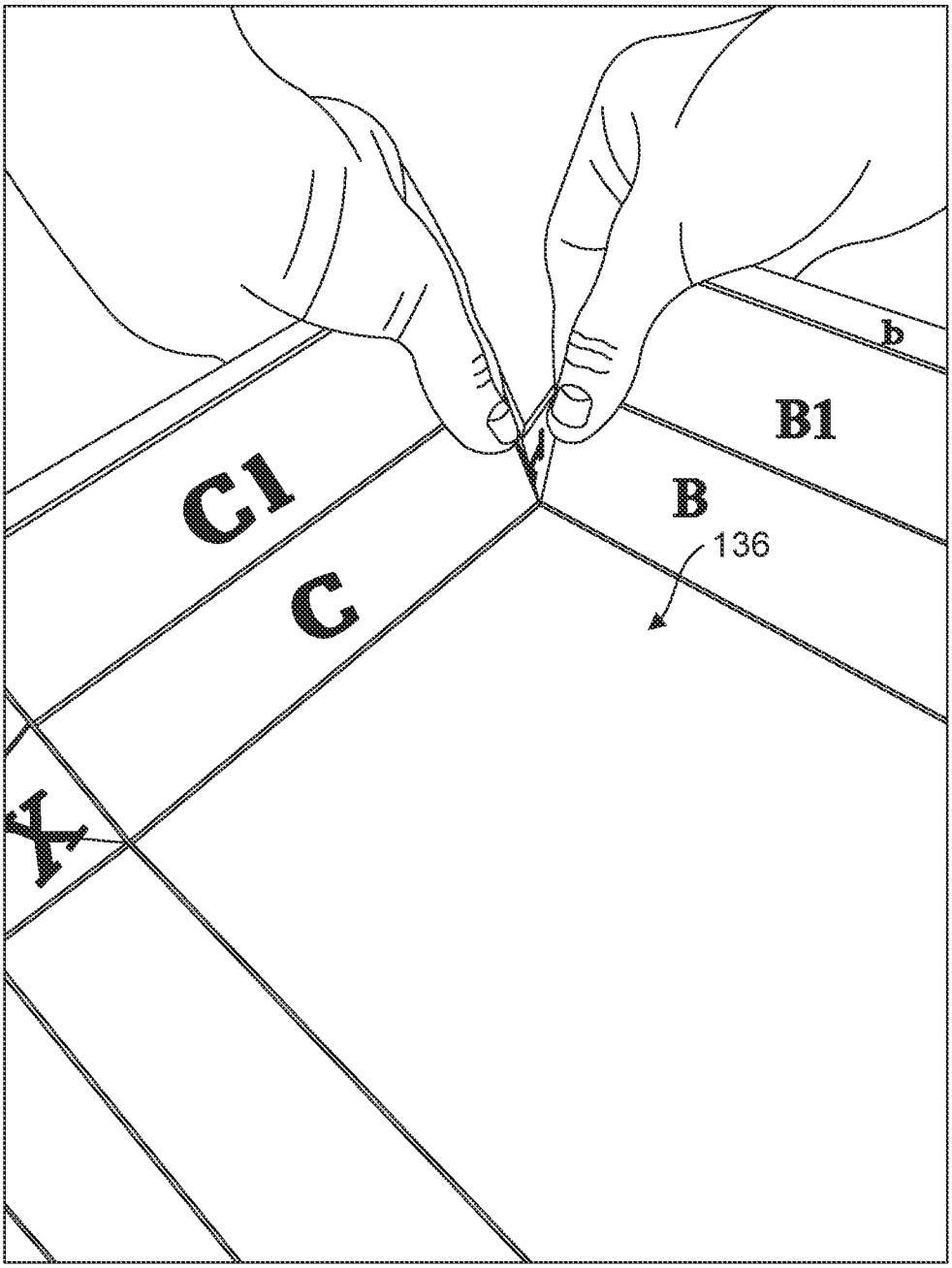
Figures 4, 4B, 5, 6, 7, 8, 9, 10, 11:
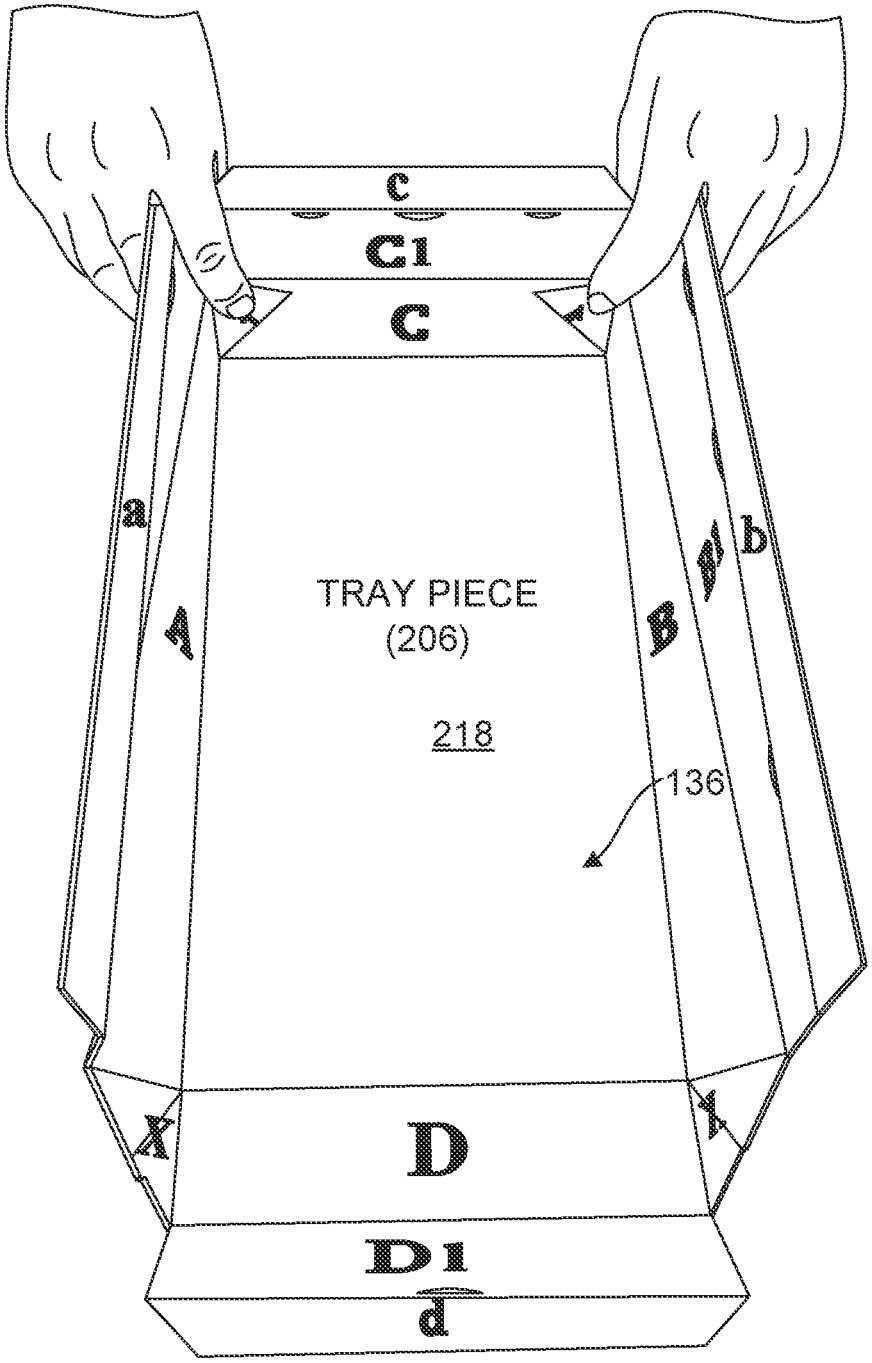
Figures 4, 4B, 5, 6, 7, 8, 9, 10, 11, 12:
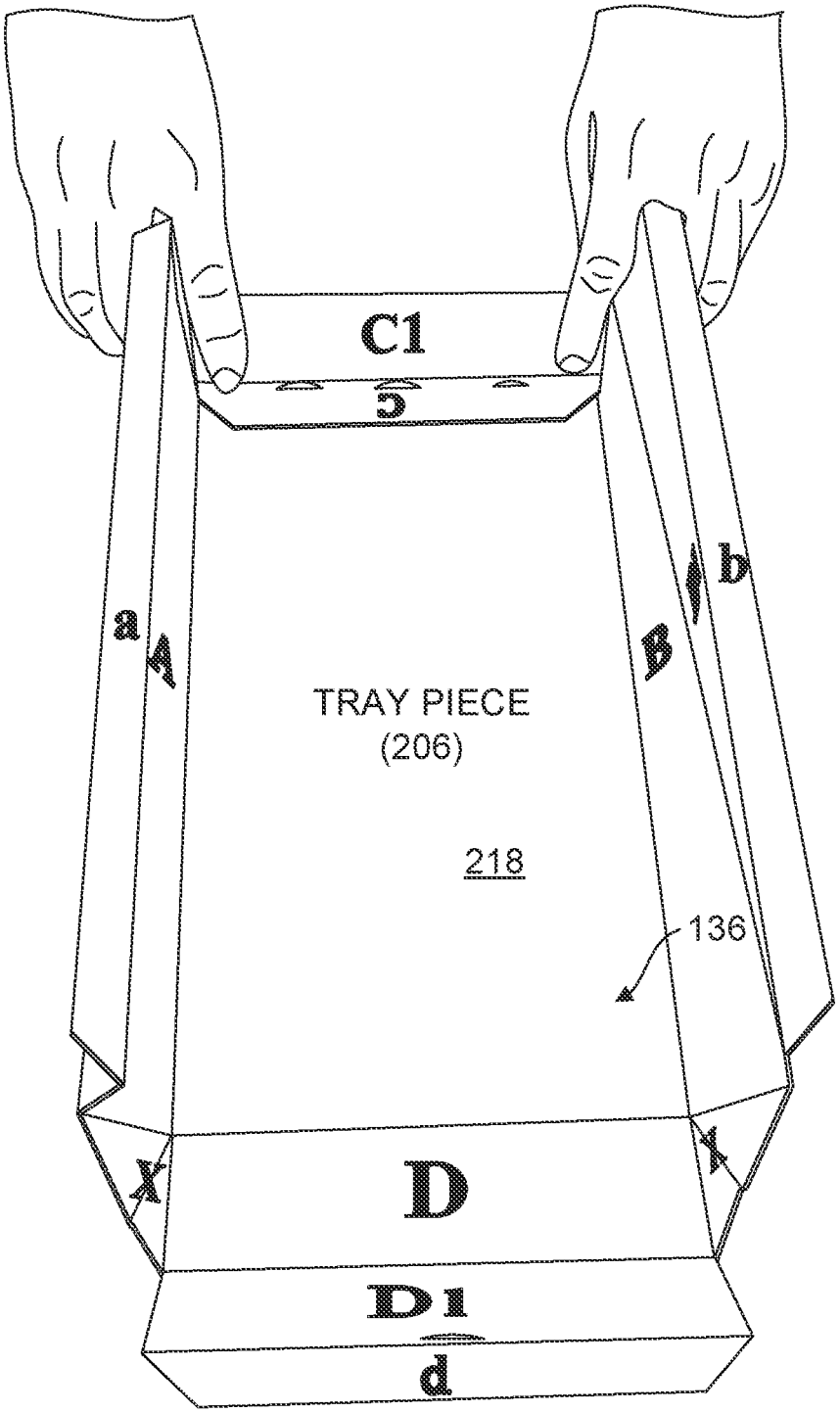
Figures 4, 4B, 5, 6, 7, 8, 9, 10, 11, 12, 13:
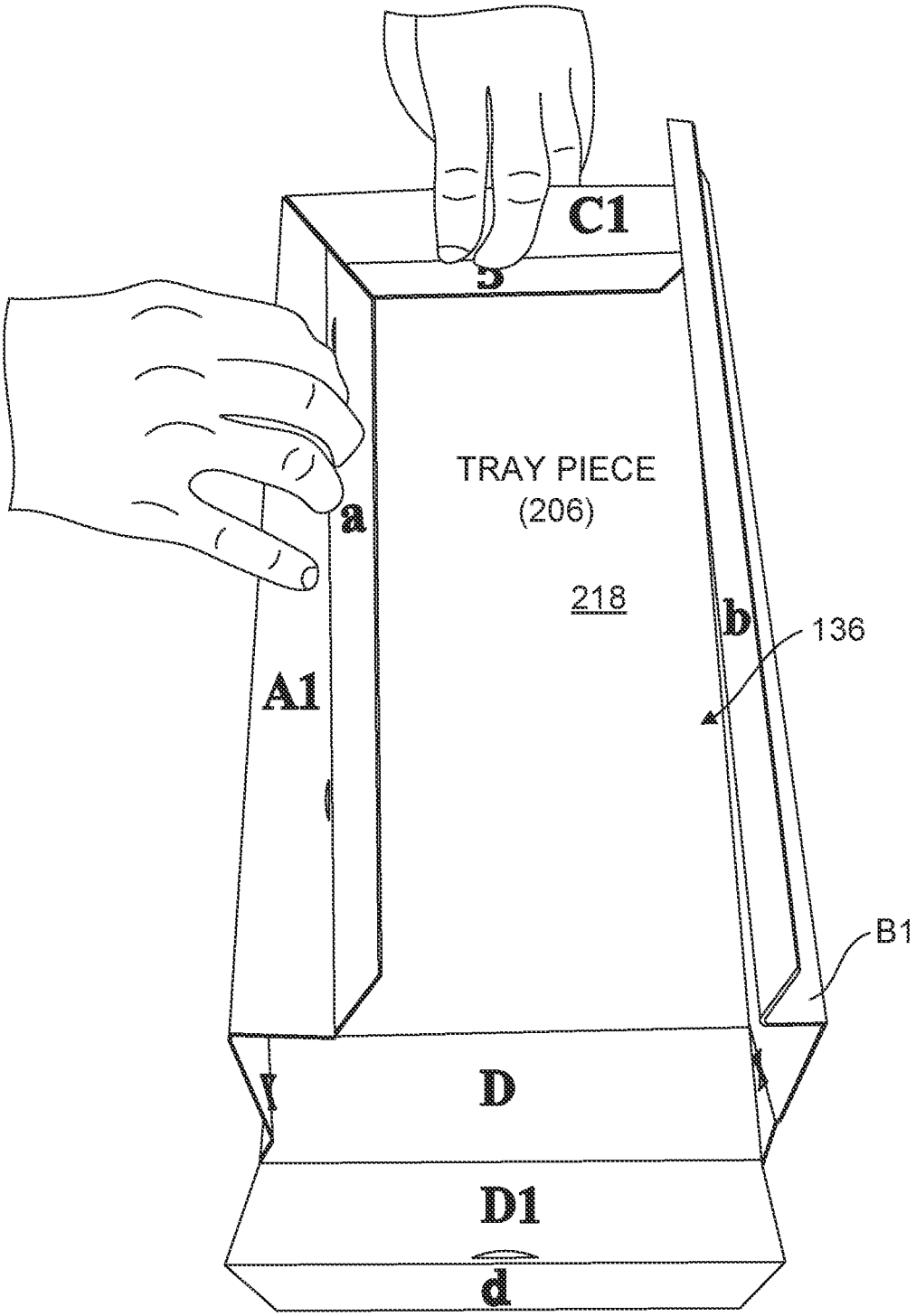
Figures 4, 4B, 5, 6, 7, 8, 9, 10, 11, 12, 13, 14:
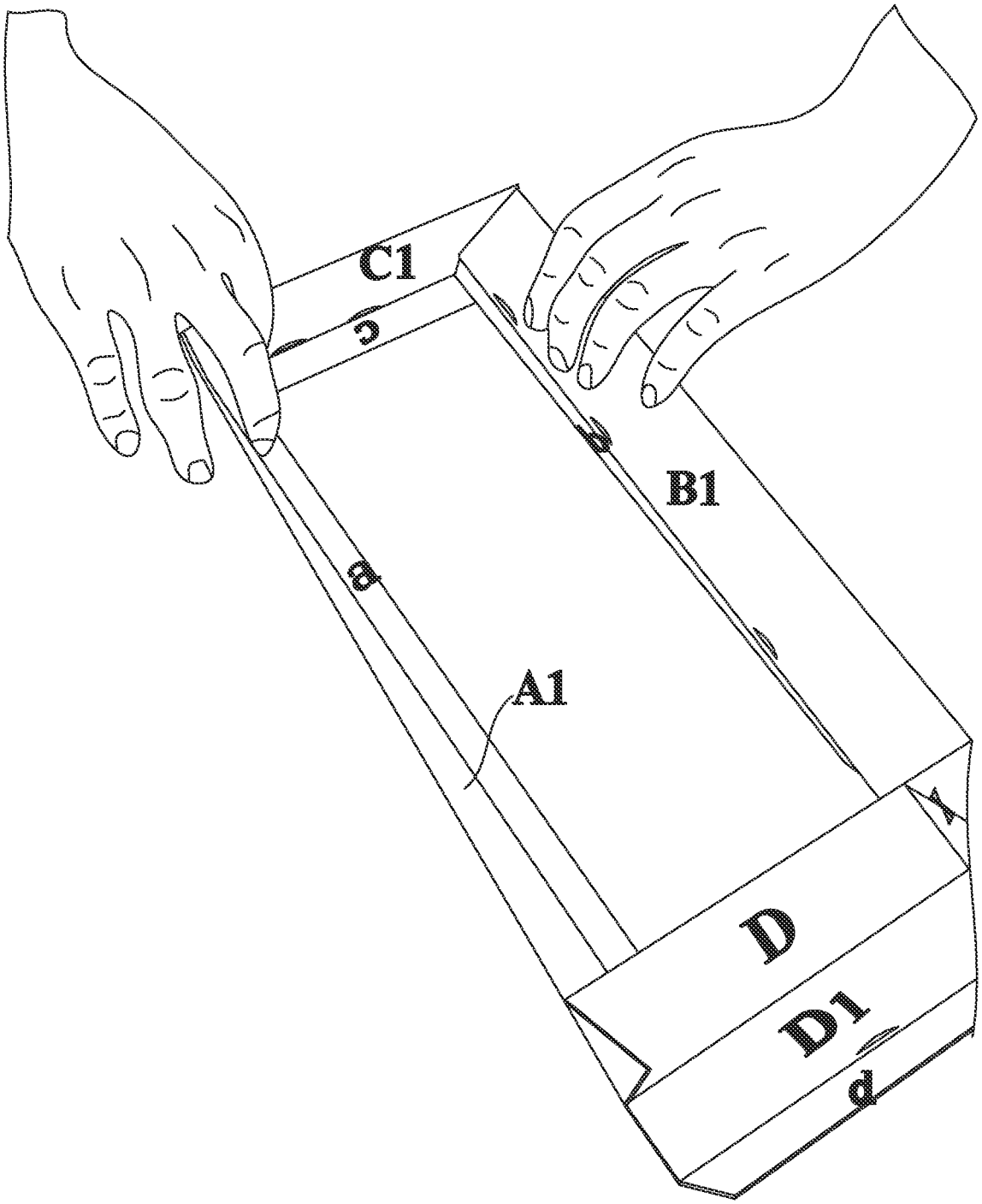
Figures 4, 4B, 5, 6, 7, 8, 9, 10, 11, 12, 13, 14, 15:
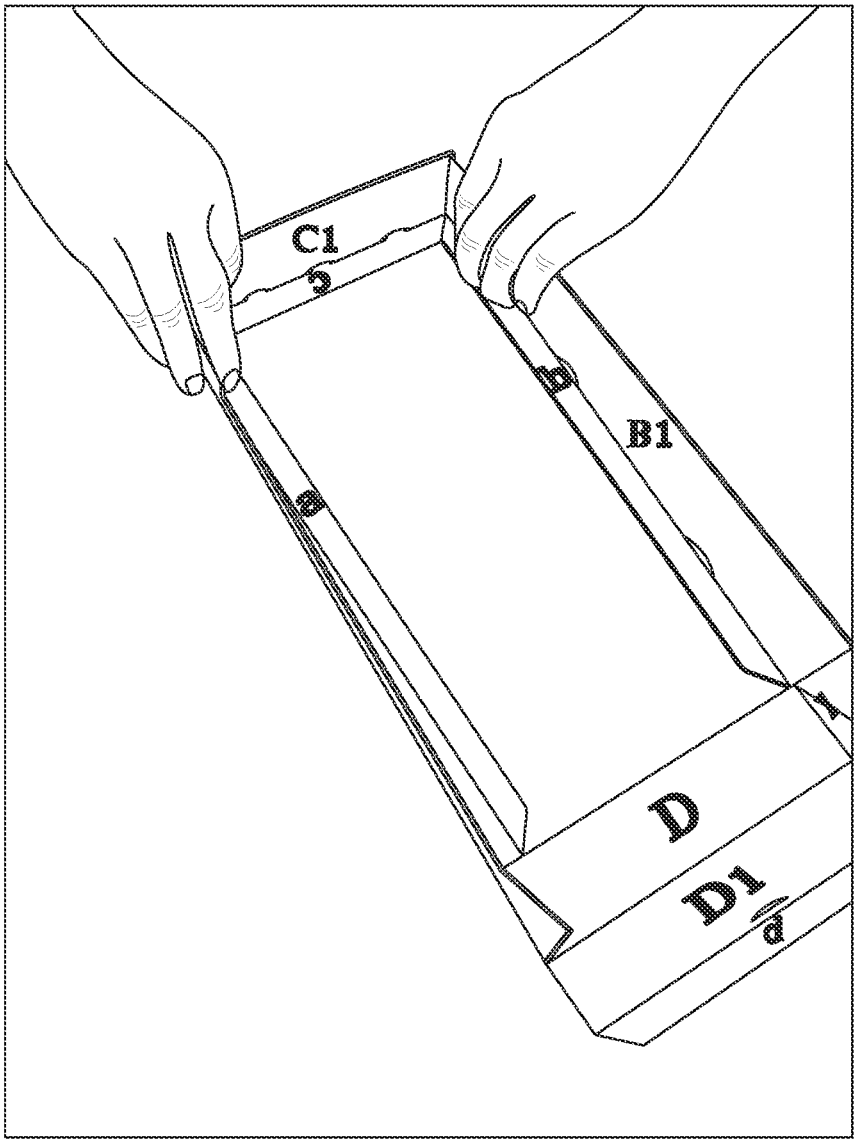
Figures 4, 4B, 5, 6, 7, 8, 9, 10, 11, 12, 13, 14, 15, 16:
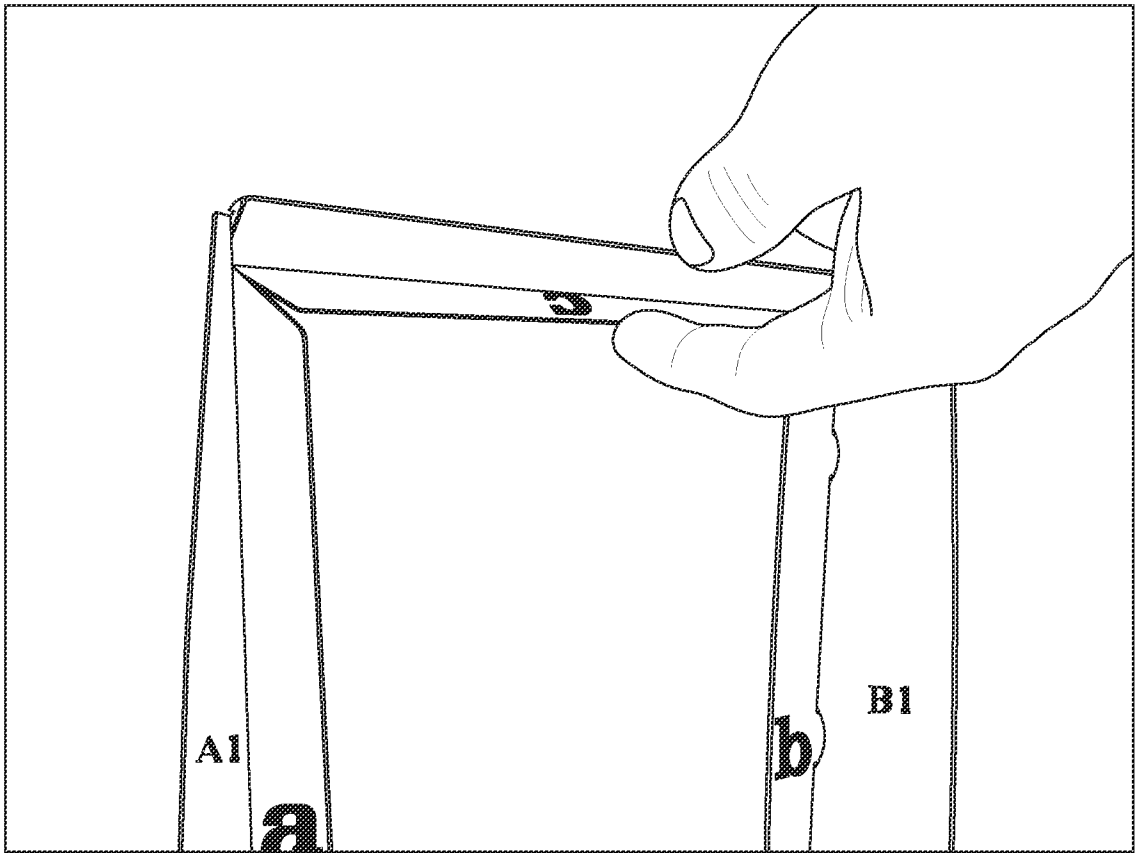
Figures 4, 4B, 5, 6, 7, 8, 9, 10, 11, 12, 13, 14, 15, 16, 17:
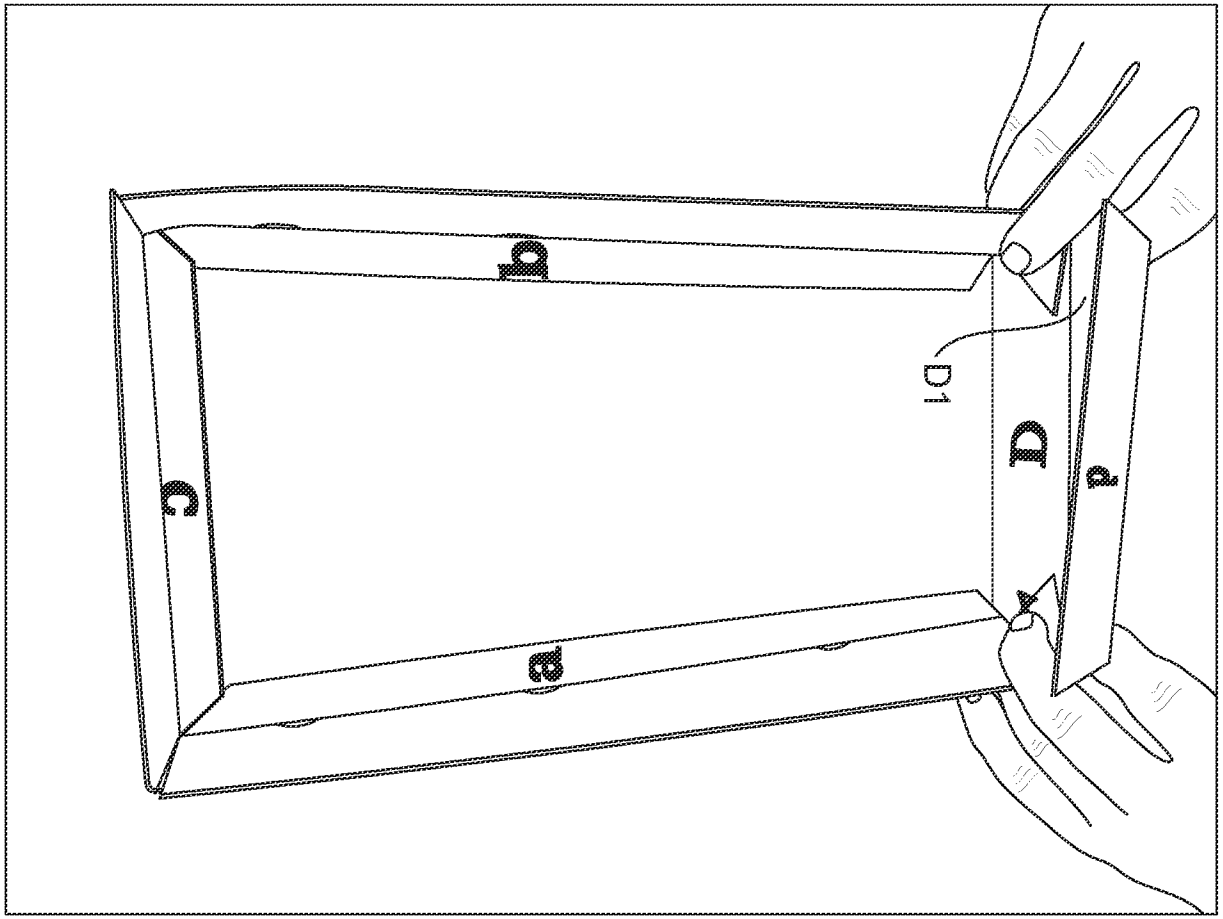
Figures 4, 4B, 5, 6, 7, 8, 9, 10, 11, 12, 13, 14, 15, 16, 17, 18:
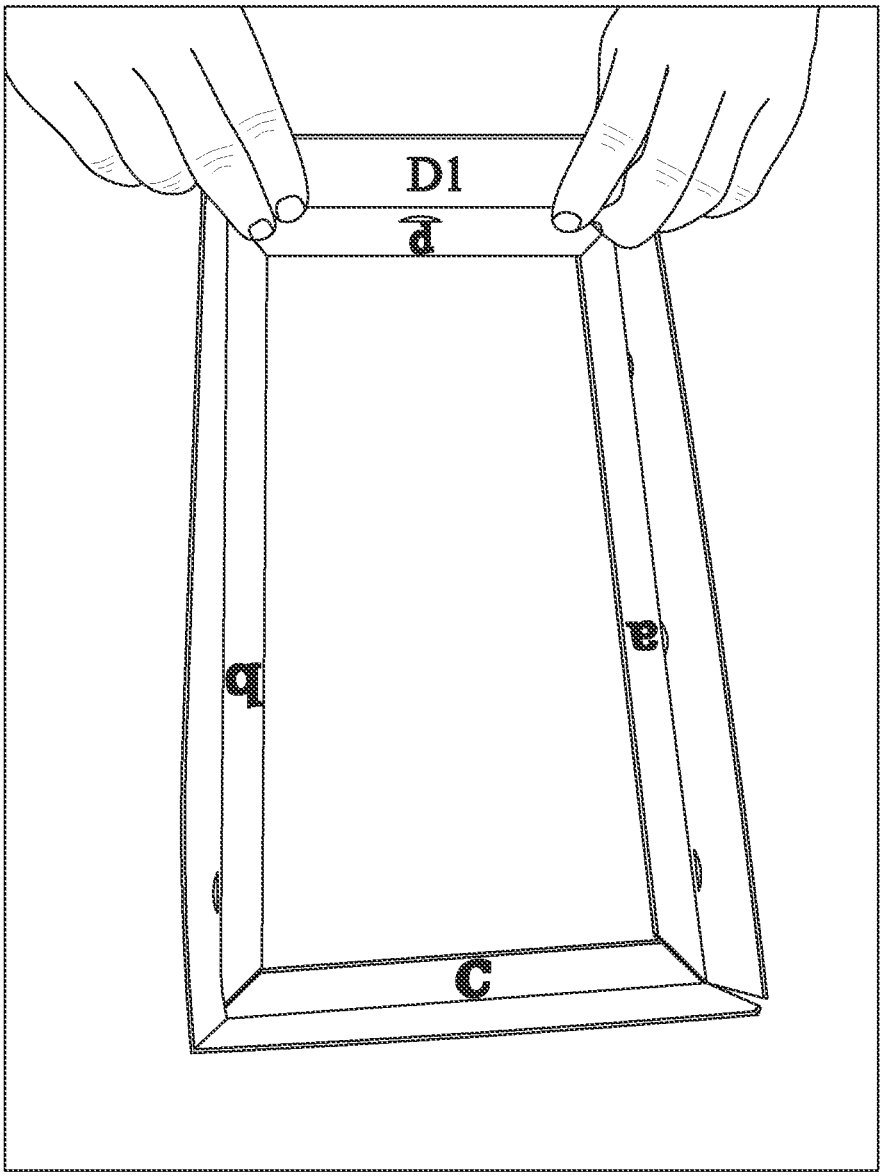
Figures 4, 4B, 5, 6, 7, 8, 9, 10, 11, 12, 13, 14, 15, 16, 17, 18, 19:
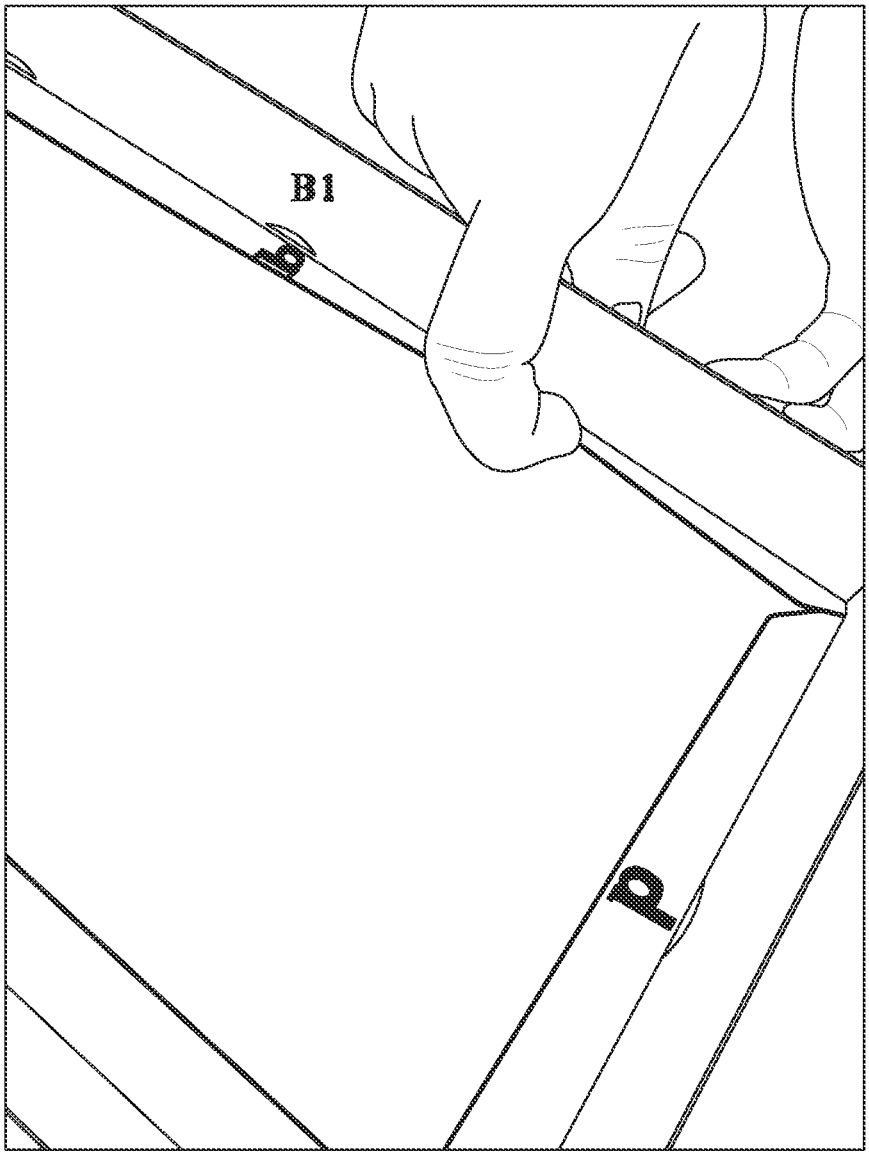
Figures 4, 4B, 5, 6, 7, 8, 9, 10, 11, 12, 13, 14, 15, 16, 17, 18, 19, 20:
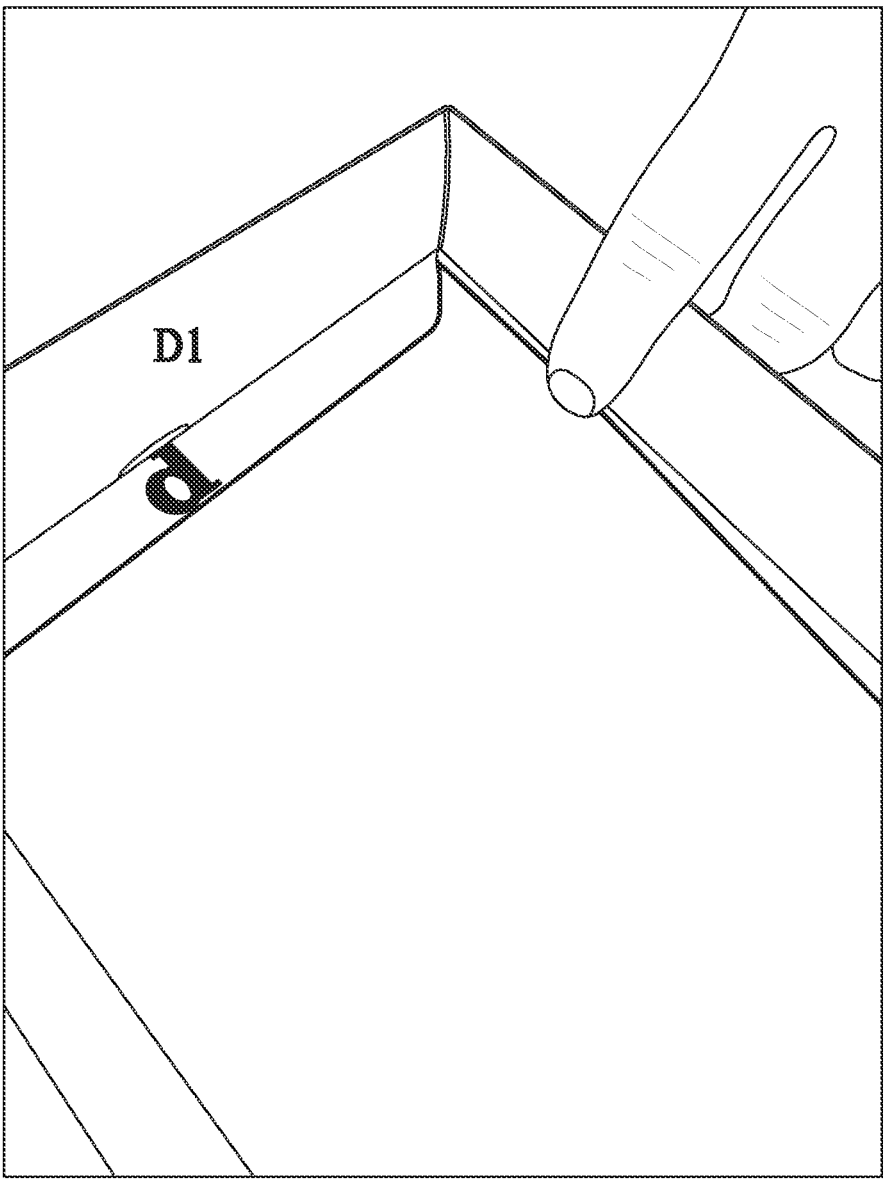
Figures 4, 4B, 5, 6, 7, 8, 9, 10, 11, 12, 13, 14, 15, 16, 17, 18, 19, 20, 21:
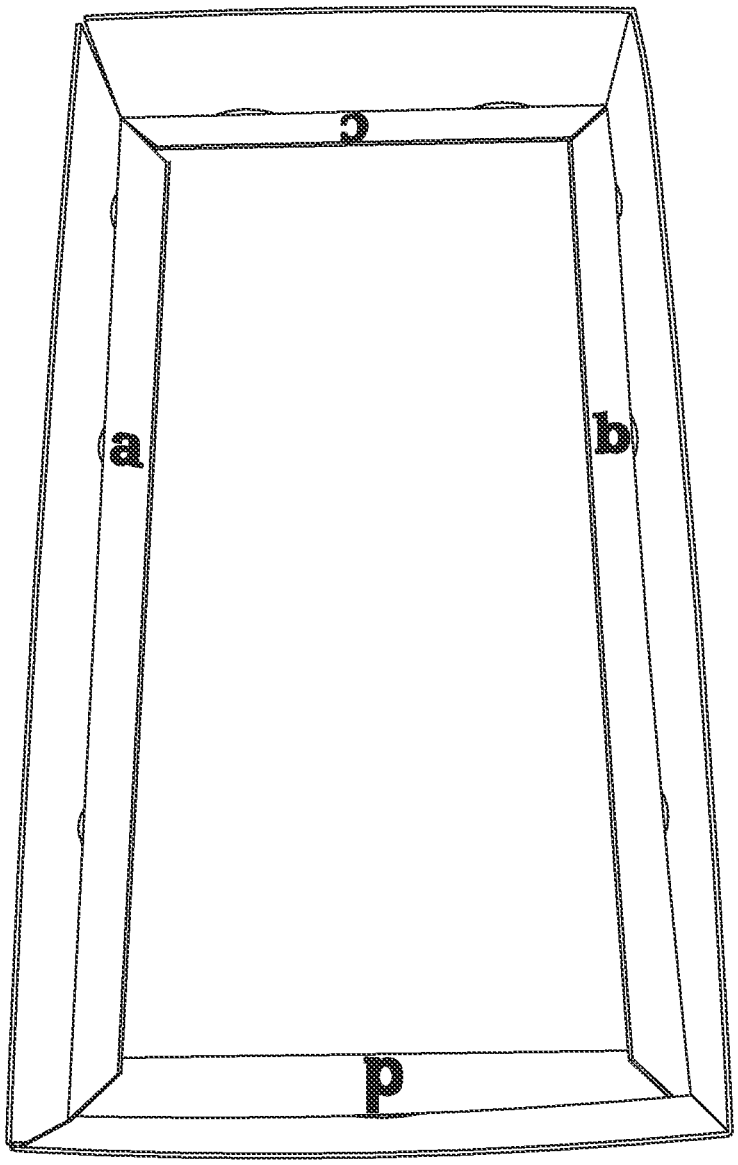

As illustrated in FIGS. 4 to 4B-20, tray piece is positioned flat on a side (in this non-limiting, exemplary instance, interior top side 136. As indicated above, the interior (or top) side 136 and exterior (or bottom) side 128 of first piece (i.e., tray piece) 206 are identical but are labeled as such for assembly instructions only.

As shown in FIG. 4A-1, first outer longitudinal section 238 also labeled as "a" is folded inwardly on linear fold line 234 towards the center of rectangular core section 218 of tray piece 206.

Additionally, as shown in FIG. 4A-2, second outer longitudinal section 250 also labeled as "b" is folded inwardly on linear fold line 246 towards the center of rectangular core section 218 of tray piece 206.

Further, as shown in FIG. 4A-3, first outer transverse section 262 also labeled as "c" is folded inwardly on linear fold line 258 towards the center of rectangular core section 218 of tray piece 206.

As finally shown in FIG. 4A-4, second outer transverse section 274 labeled as "d" is folded inwardly on linear fold line 272 towards the center of rectangular core section 218 of tray piece 206.

As shown in FIGS. 4B-1 to 4B-20, tray piece 206 is flipped flat on interior (or top) side 136. As shown in FIG. 4B-1, first middle longitudinal section 240 also labeled as A1 is folded inwardly on linear fold line 232 towards the center of rectangular core section 218 of tray piece 206.

As illustrated in FIG. 4B-2, second middle longitudinal section 252 also labeled as B1 is folded inwardly on linear fold line 244 towards the center of rectangular core section 218 of tray piece 206.

As illustrated in FIG. 4B-3, first middle transverse section 264 also labeled as C1 is folded inwardly on linear fold line 256 towards the center of rectangular core section 218 of tray piece 206.

As illustrated in FIG. 4B-4, second middle transverse section 276 also labeled as D1 is folded inwardly on linear fold line 270 towards the center of rectangular core section 218 of tray piece 206.

As shown in FIG. 4B-5, a first inner longitudinal section 242 also labeled as A is folded inwardly on linear fold line 222 towards the center of rectangular core section 218 of tray piece 206.

As shown in FIG. 4B-6, a second inner longitudinal section 254 also labeled as B is folded inwardly on linear fold line 224 towards the center of rectangular core section 218 of tray piece 206.

As shown in FIG. 4B-7, a first inner transvers section 266 also labeled as C is folded inwardly on linear fold line 226 towards the center of rectangular core section 218 of tray piece 206.

As illustrated in FIG. 4B-8, a second inner transvers section 278 also labeled as D is folded inwardly on linear fold line 228 towards the center of rectangular core section 218 of tray piece 206.

As best shown in FIGS. 4B-9 and 4B-10, all four corners marked as "X" are folded in half towards the center of the rectangular core 218 as shown. Thereafter, as shown in FIG. 4B-11, the folded corner pair 280 and 282 along first transverse sections 260 are folded and held against a first inner transvers section 266 also labeled as C.

As shown in FIG. 4B-12, first middle transverse section 264 also labeled as C1 is next folded over its associated corners 280 and 282 (also labeled as "X") at first transverse sections 260.

As shown in FIG. 4B-13, first middle longitudinal section 240 also labeled as A1 is folded over first inner longitudinal section 242 also labeled as A.

As shown in FIG. 4B-14, second middle longitudinal section 252 also labeled as B1 is folded over second inner longitudinal section 254 also labeled as B.

As shown in FIG. 4B-15 and 4B-16, first outer transverse section 262 also labeled as c is lifted up to tuck in first outer longitudinal section 238 also labeled as a and second outer longitudinal section 250 also labeled as b underneath first outer transverse section 262 also labeled as c.

As best shown in FIGS. 4B-17 and 4B-18, the folded corner pair 284 and 286 along second transverse sections 268 are folded and held against second inner transvers section 278 also labeled as D. Second middle transverse section 276 also labeled as D1 is next folded over the corner 284 and 286 at second transverse sections 268.

As shown in FIGS. 4B-19 and 4B-20, first outer longitudinal section 238 labeled as a and second outer longitudinal section 250 labeled as b are lifted so that second outer transverse section 274 labeled as d may be tucked underneath. FIG. 4B-21 is a non-limiting, exemplary illustration of a fully assembled tray 102 without dividers in accordance with one or more embodiments of the present invention.

FIGS. 5A-1 to 5C-7 are non-limiting, exemplary illustrations of a set of divider pieces, progressively illustrating a non-limiting, exemplary method of assembly thereof to form dividers in accordance with one or more embodiments of the present invention.

FIGS. 5A-1 to 5A-10 are non-limiting, exemplary illustrations of divider piece 212, progressively illustrating a non-limiting, exemplary method of assembly thereof in accordance with one or more embodiments of the present invention.

FIGS. 5B-1 to 5B-7 are non-limiting, exemplary illustrations of divider piece 288, progressively illustrating a non-limiting, exemplary method of assembly thereof in accordance with one or more embodiments of the present invention As indicated above, the divider pieces (compartmentation pieces or inserts) 212 and 288 are optional that when used, would divide or compartmentalize interior space of tray 102.

All divider pieces 212 and 288 are formed from a flat, single piece, cut-out material that are folded about fold lines. Additionally, all divider pieces 212 and 288 also include interlocking protruded (projecting) tabs 204 that when inserted into corresponding slots 148 of tray 102 (or other divider slots 290), allow the dividers 212 and 288 to interlock and remain in place. Further, larger dividers 212 may optionally include slits in a form of slots 290 for insertion of interlocking protruded tab 204 of smaller or other dividers 288 (FIGS. 5A-9, 5A-10., 5B-6, and 5B-7).

There are a large number of ways of dividing or compartmentalizing tray 102. In fact, numerous combinations and permutations of different number, size, and shape of divider pieces may be used to generate a large number of different size tray compartments, with only a non-limiting, non-exhaustive examples shown for discussion purposes. For example, only a single larger divider piece may be used or, alternatively, only a single smaller piece may be used, and so on.

The compartments may optionally hold other well-known containers for example. Alternatively, individual compartments may directly hold different foods (such as cooked rice, fish, etc.).

The method of assembly of the divider pieces large or small is similar. For larger dividers 212 shown in FIGS. 5A-1 to 5A-10:

Lay large divider 212 flat and fold section 292 also labeled as A outward on linear fold line 306;

Fold section 294 also labeled as B inward on linear fold line 308;

Fold section 296 also labeled as C outward on linear fold line 310;

Fold section 298 also labeled as D outward on linear fold line 312;

Fold section 300 also labeled as E inward on linear fold line 314;

Fold section 302 also labeled as G outward on linear fold line 316;

As best shown in FIG. 5A-8, large divider 212 is now completed, which now may be inserted in tray 102 (FIG. 5A-9), with interlocking protruding tabs 204 of larger divider 212 inserted into slots 148 of tray 102 (FIG. 5A-10).

Figures 1, 5A:
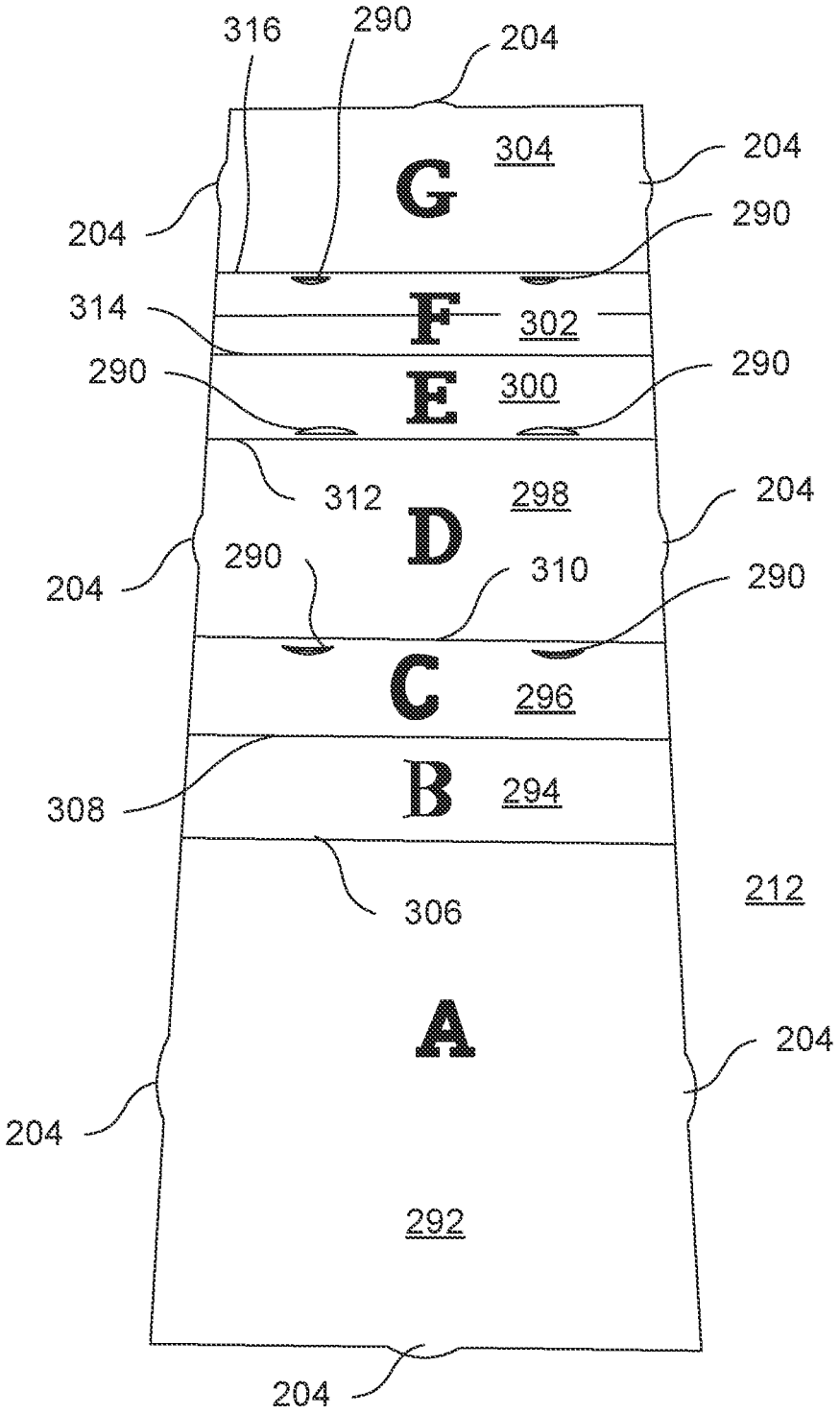
Figures 2, 5A:
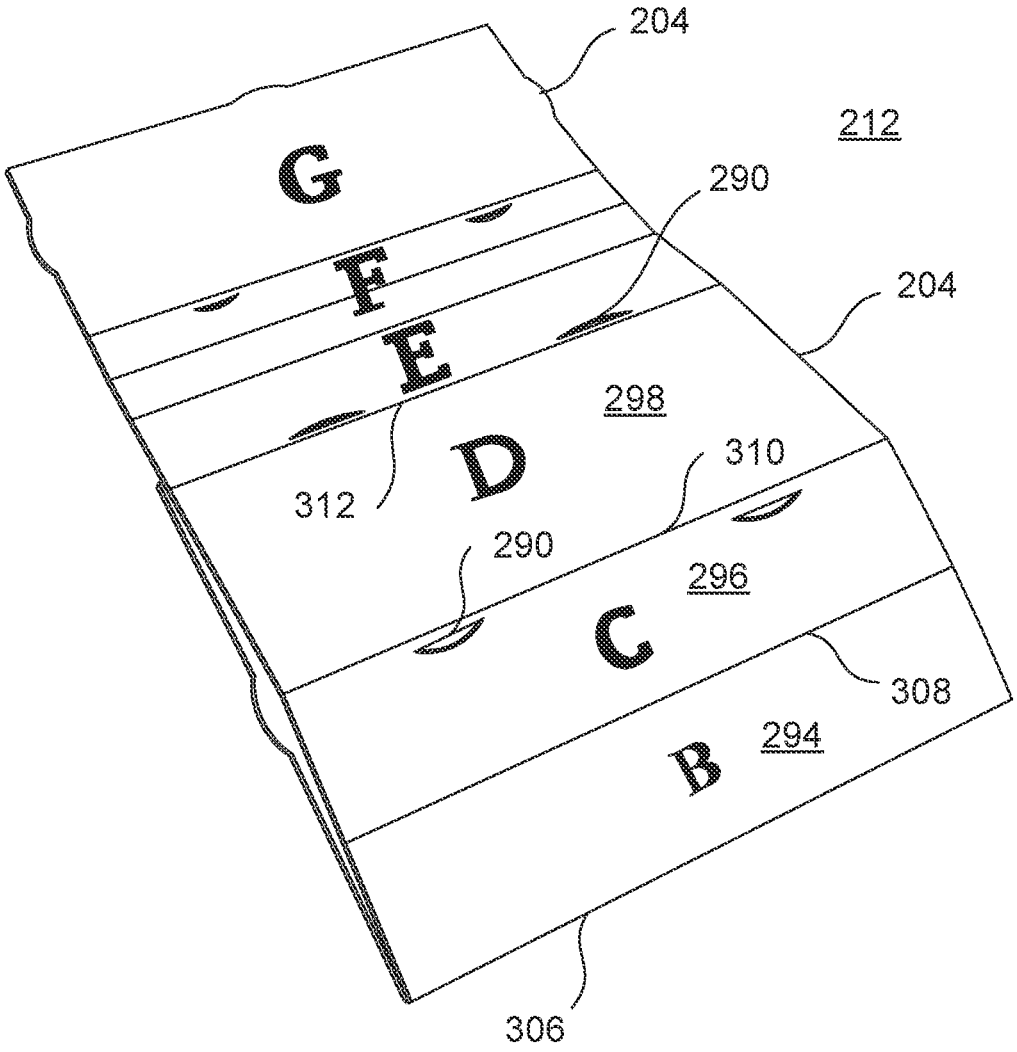
Figures 3, 5A:
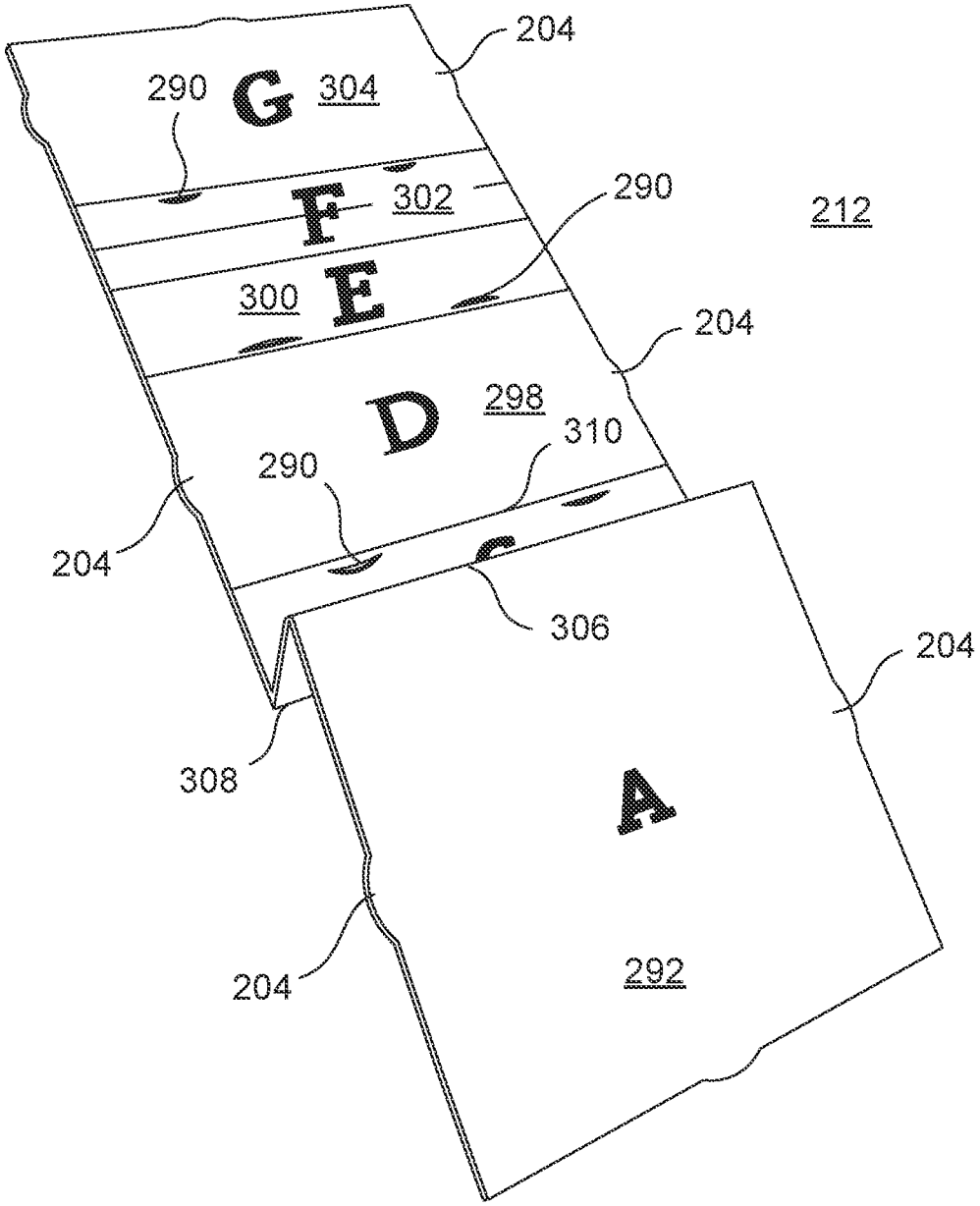
Figures 4, 5A:
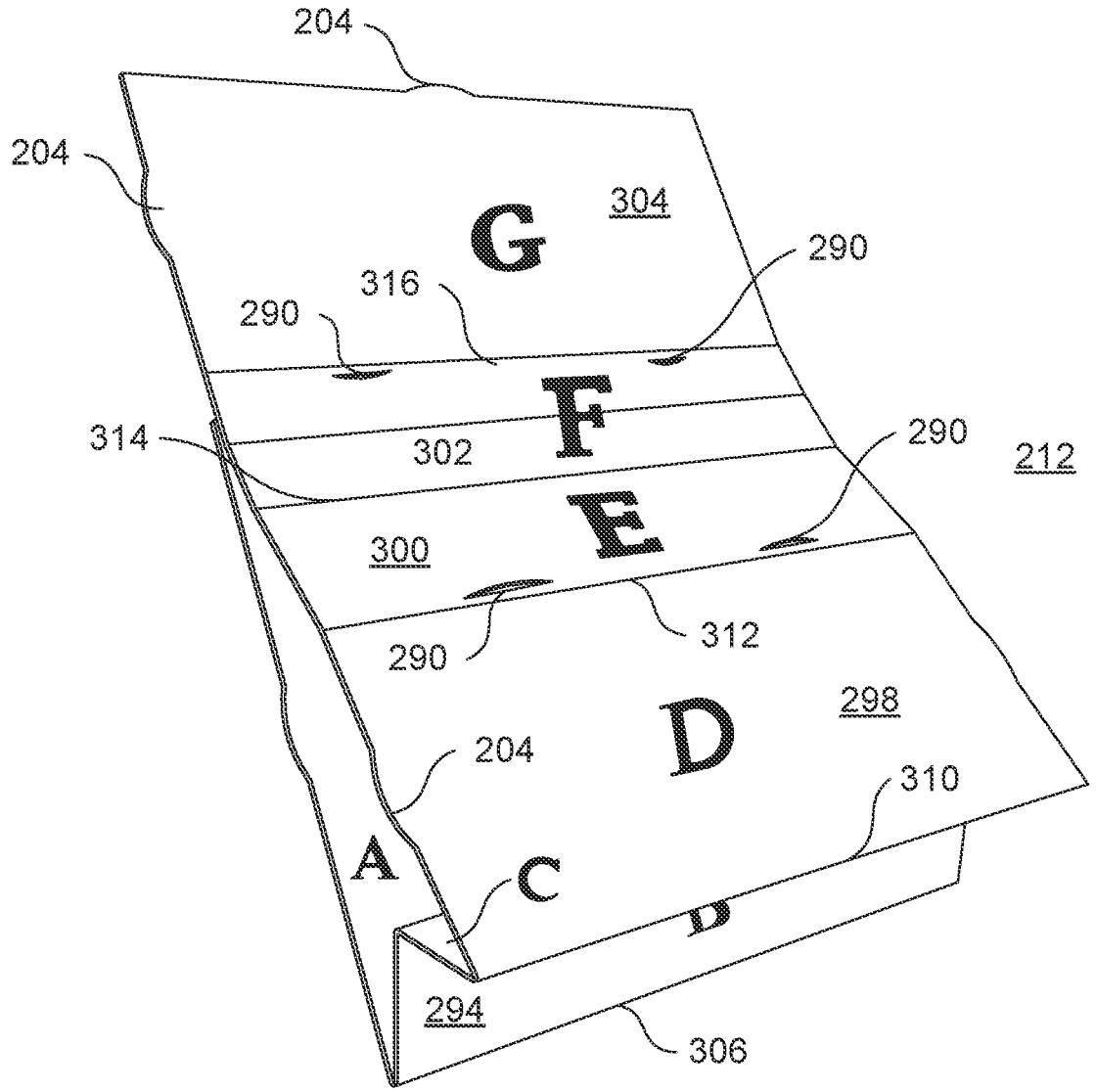
Figures 5, 5A:
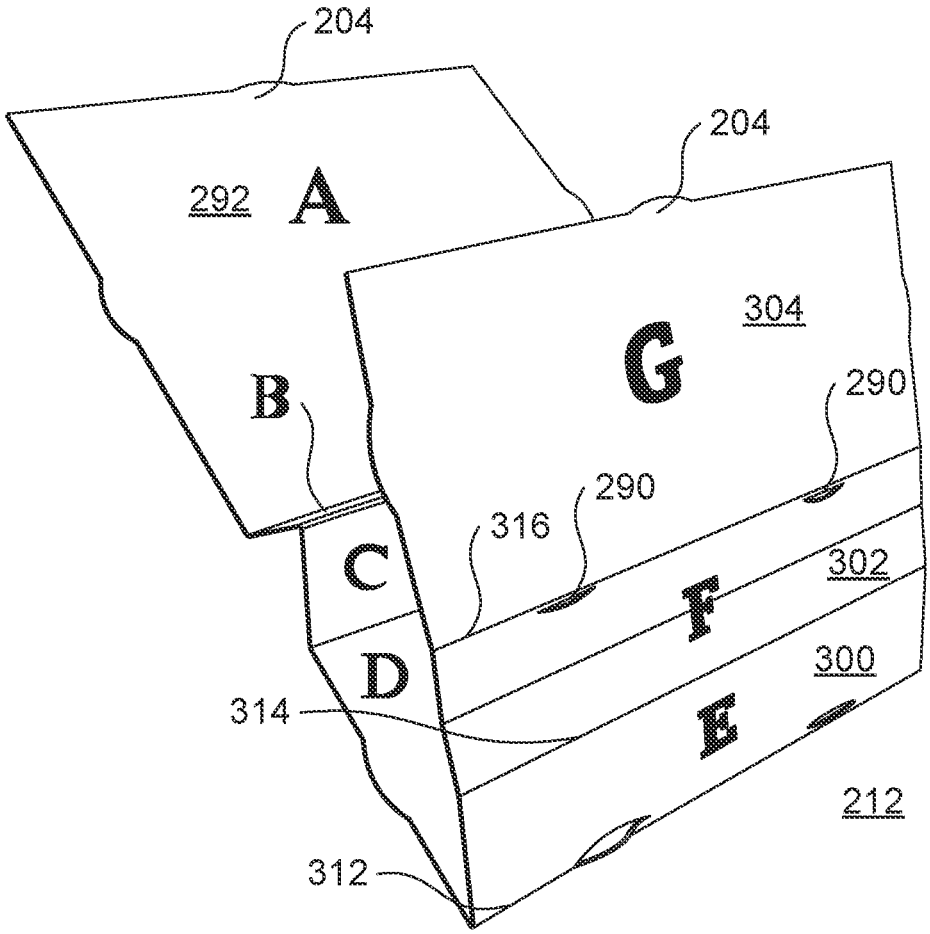
Figures 5, 5A, 6:
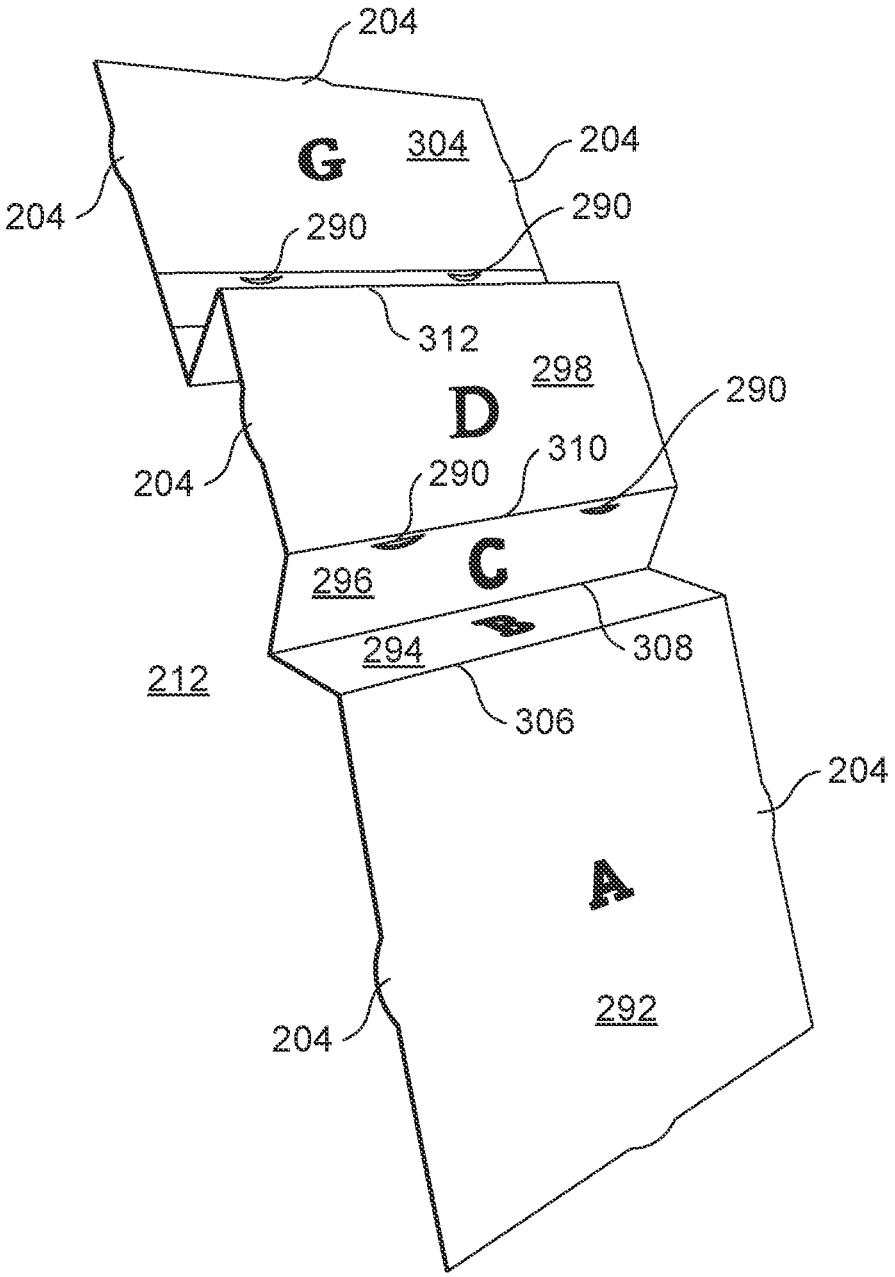
Figures 5, 5A, 6, 7:
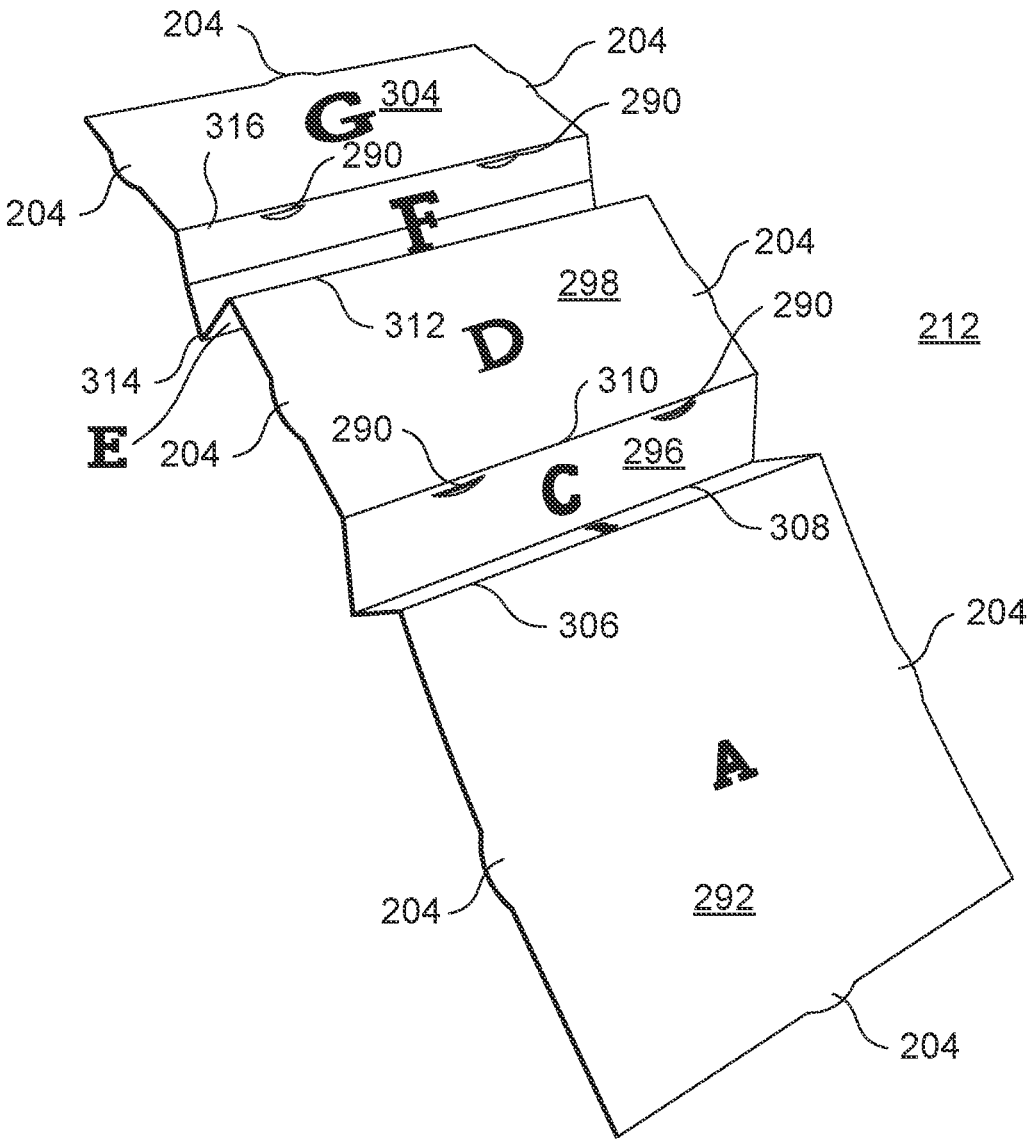
Figures 5, 5A, 6, 7, 8:
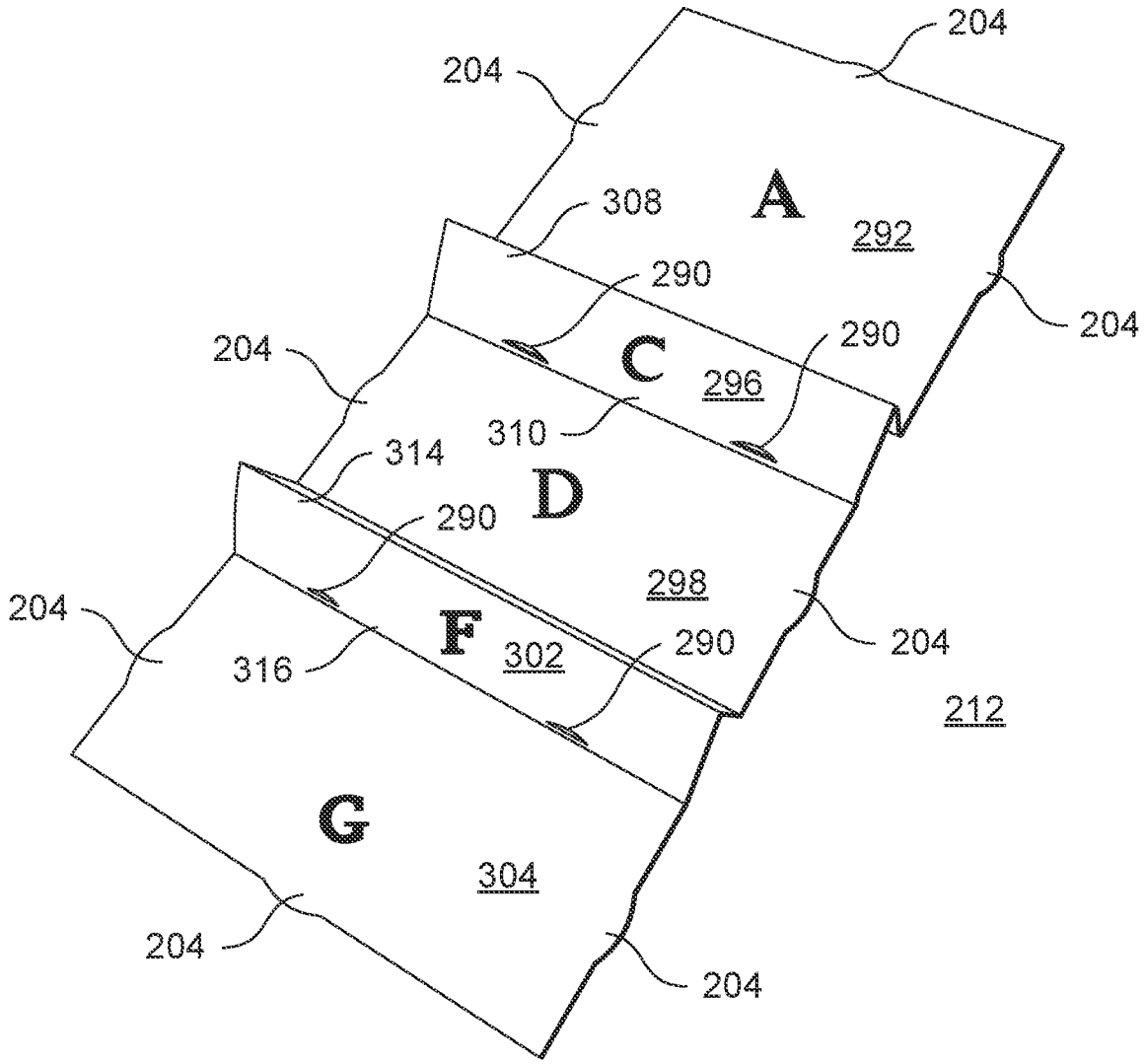
Figures 5, 5A, 6, 7, 8, 9:
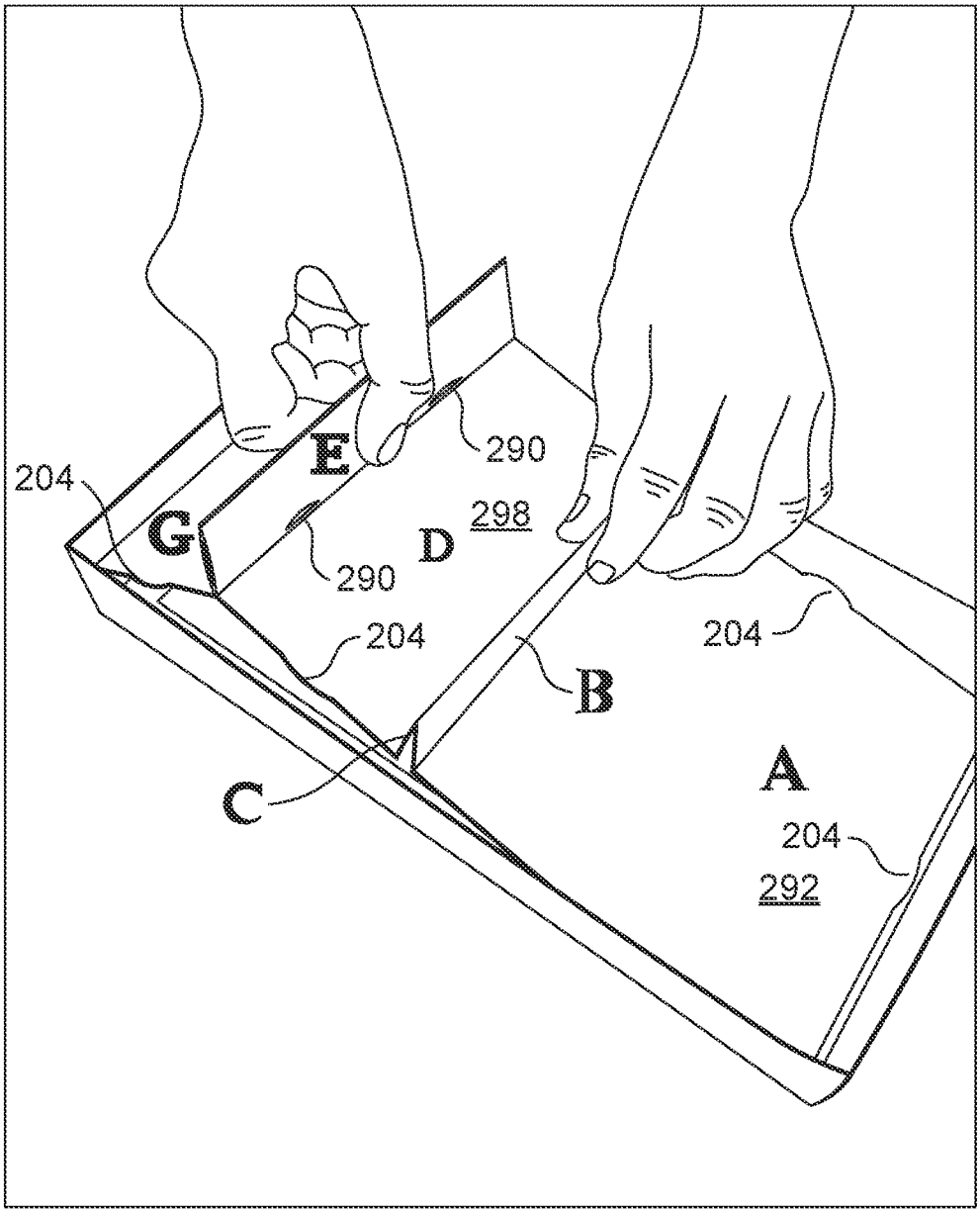
Figures 5, 5A, 6, 7, 8, 9, 10:
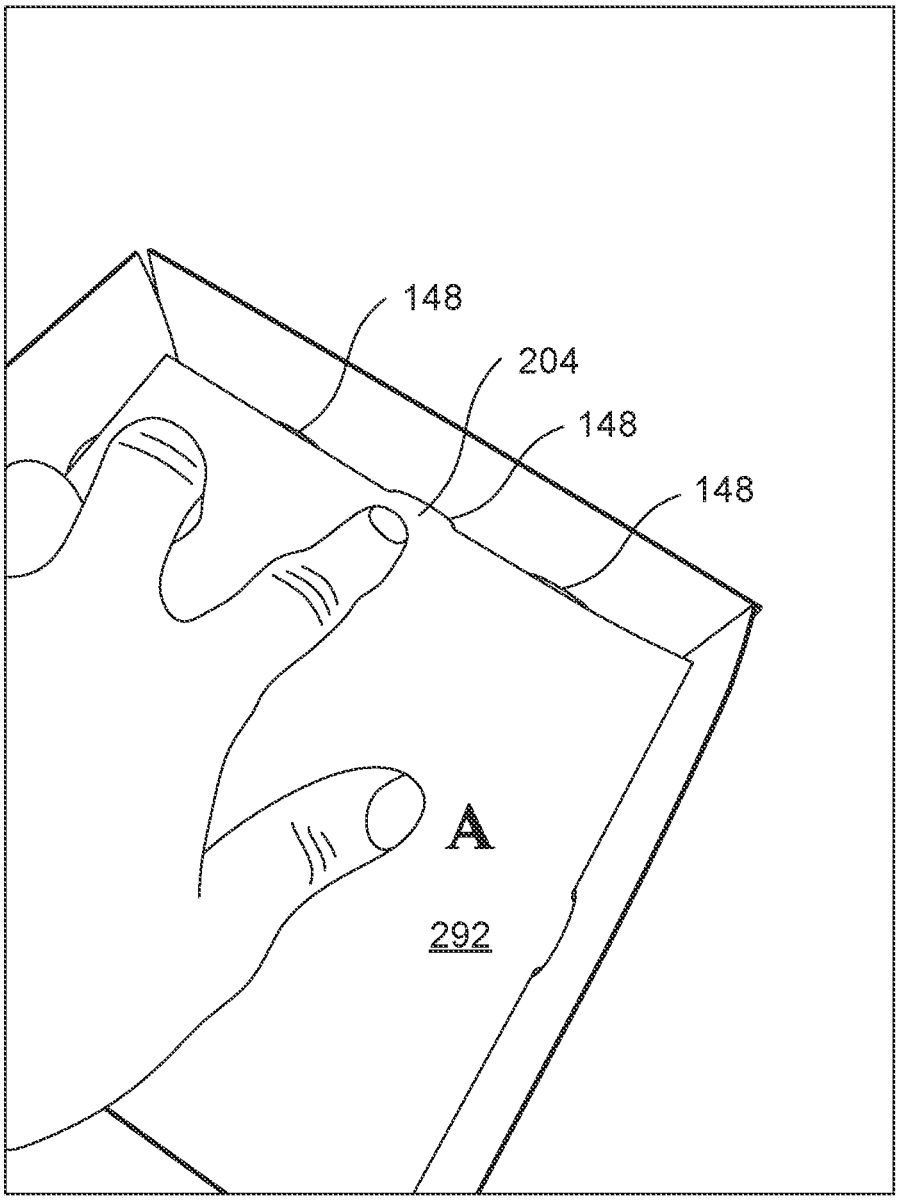
Figures 1, 5B:
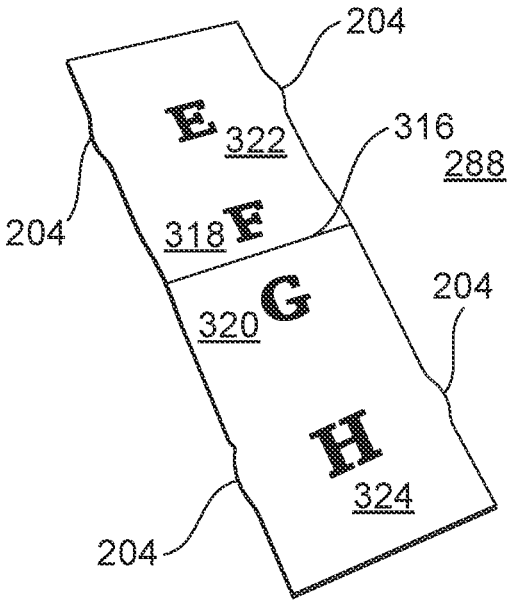
Figures 2, 5B:
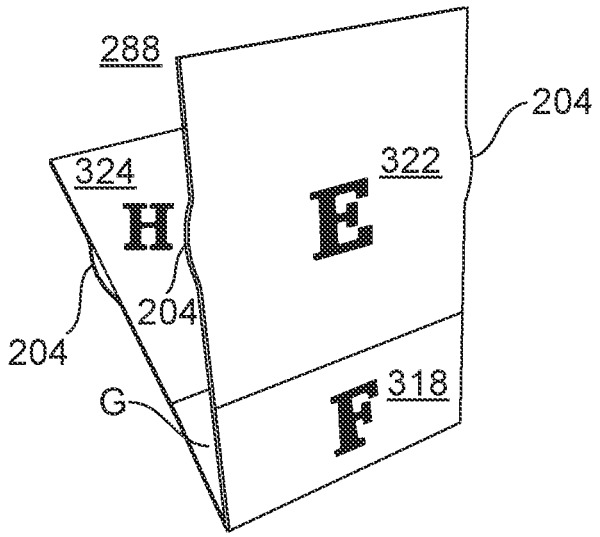
Figures 3, 5B:
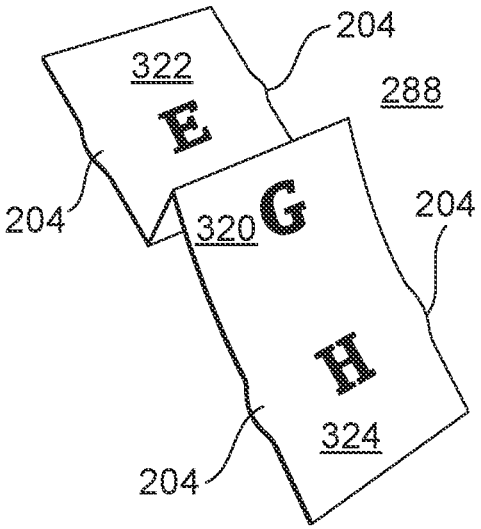
Figures 4, 5B:
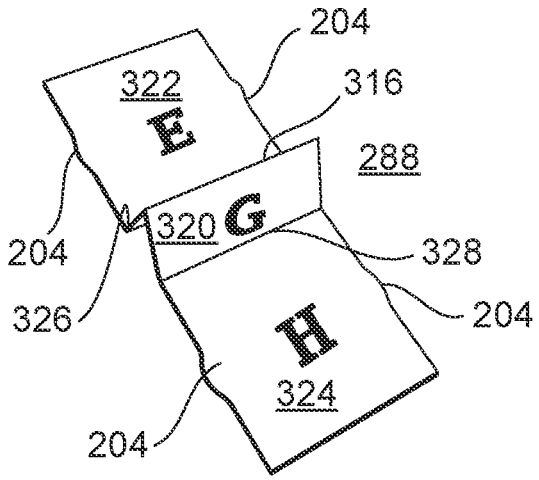
Figures 5, 5B:
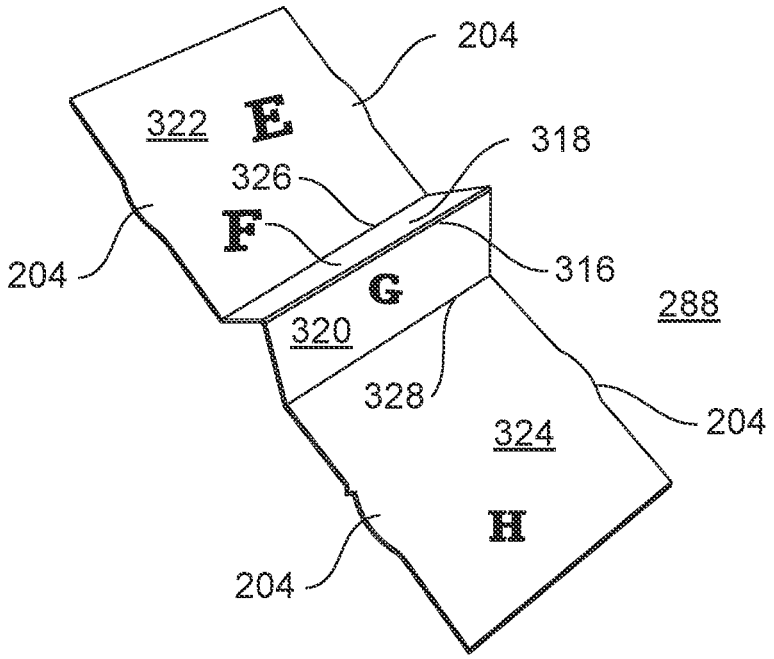
Figures 5, 5B, 6:
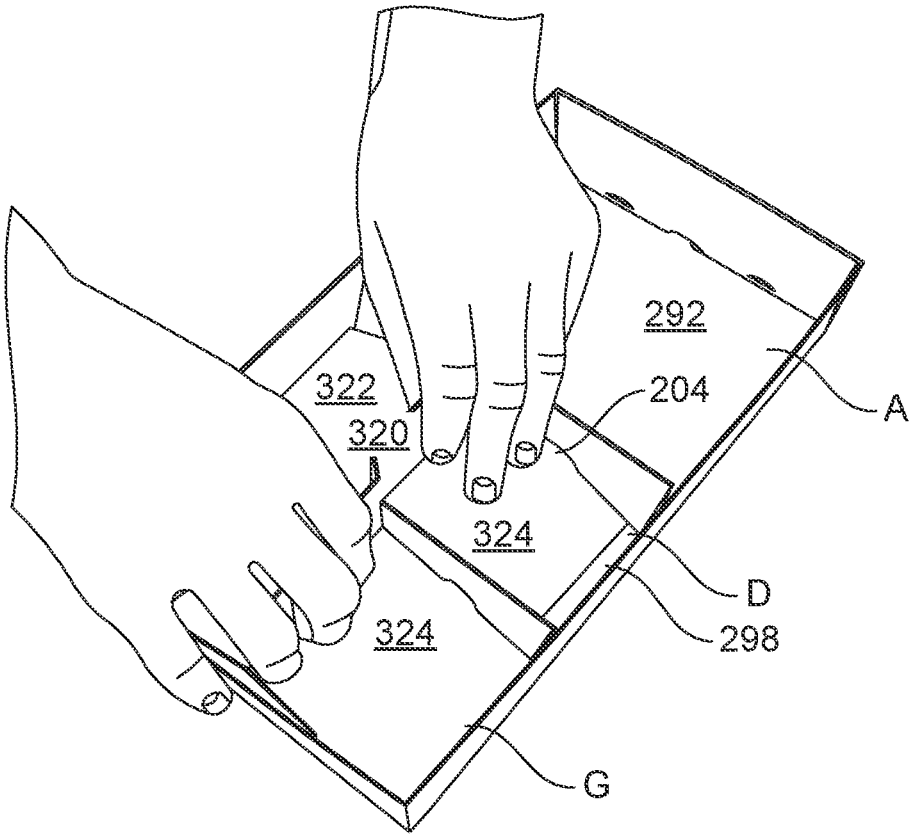
Figures 5, 5B, 6, 7:
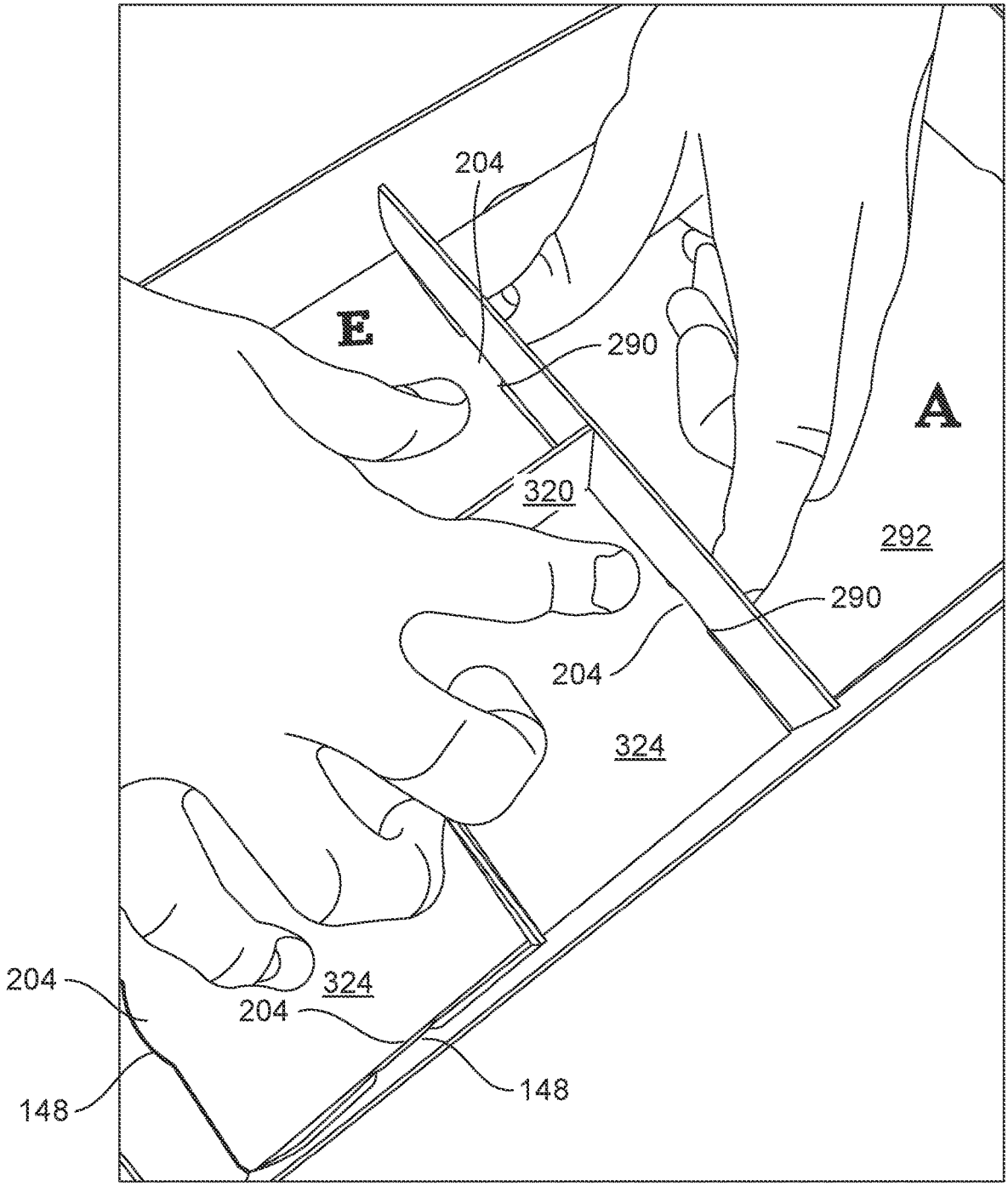

As to the smaller dividers 288, as shown in FIGS. 5B-1 to 5B-7, lay the smaller divider 288 flat and fold in half on fold line 316 between section 318 labeled as F and section 320 labeled as G; next, fold section 322 labeled as E outward on fold line 326, and fold section 324 labeled as H outward on fold line 328, resulting in divider 288 shown in FIGS. 5B-4 and 5B-5. This process may be repeated for as many smaller dividers as used.

As best shown in FIGS. 5B-6 and 5B-7, smaller dividers 288 may be positioned inside tray 102 (at section 292 also labeled as D and section 204 also labeled as G of divider 212) with interlocking protruding tabs 204 of divider 288 inserted into slots 290 of dividers 212 and slots 148 of tray 102 as shown.

Figures 1, 5C:
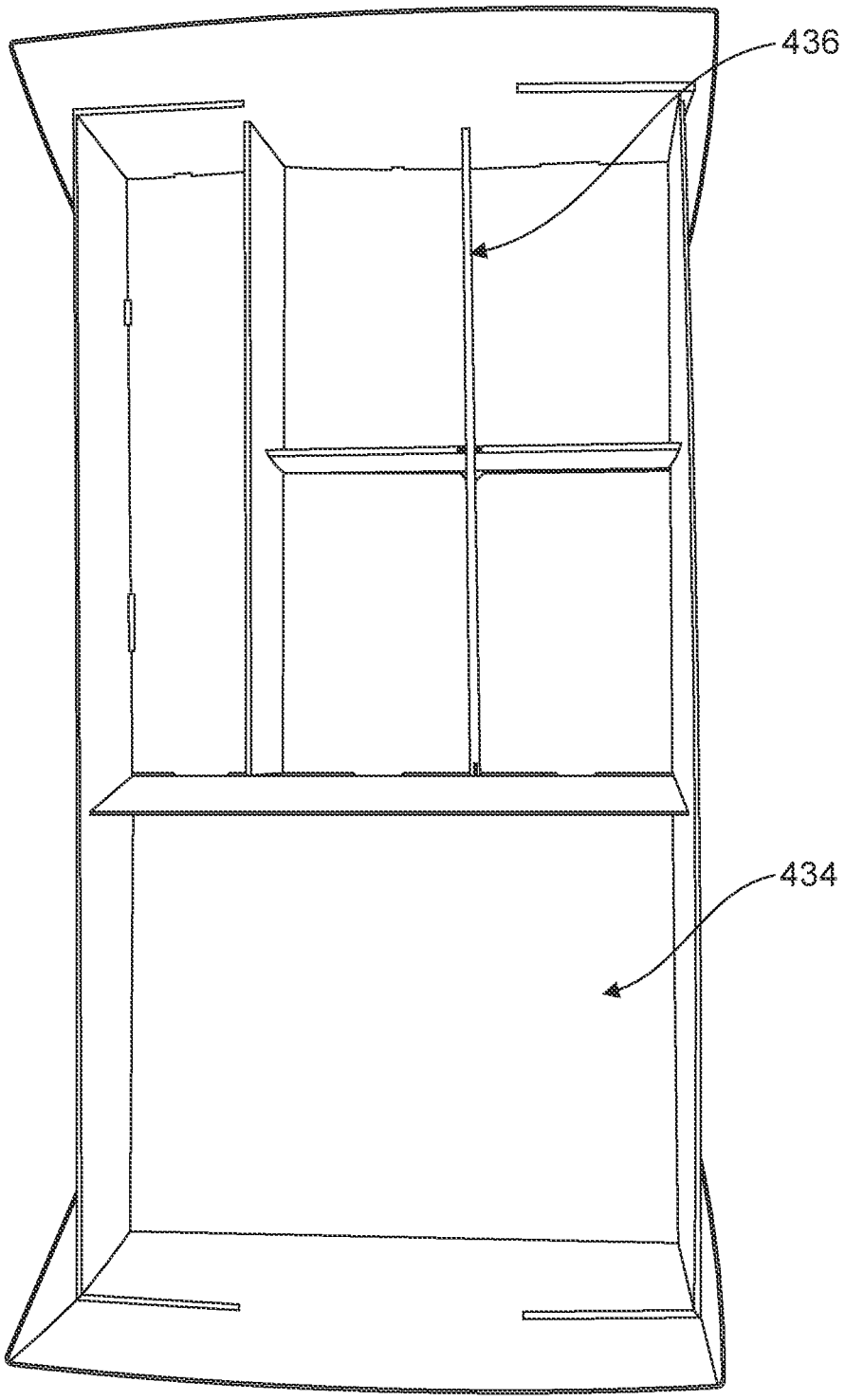
Figures 2, 5C:
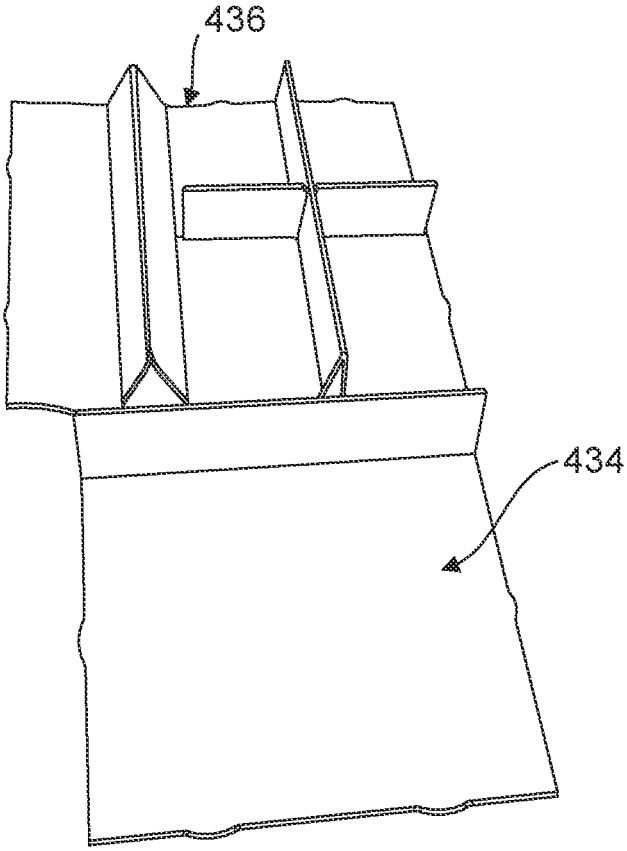
Figures 3, 5C:
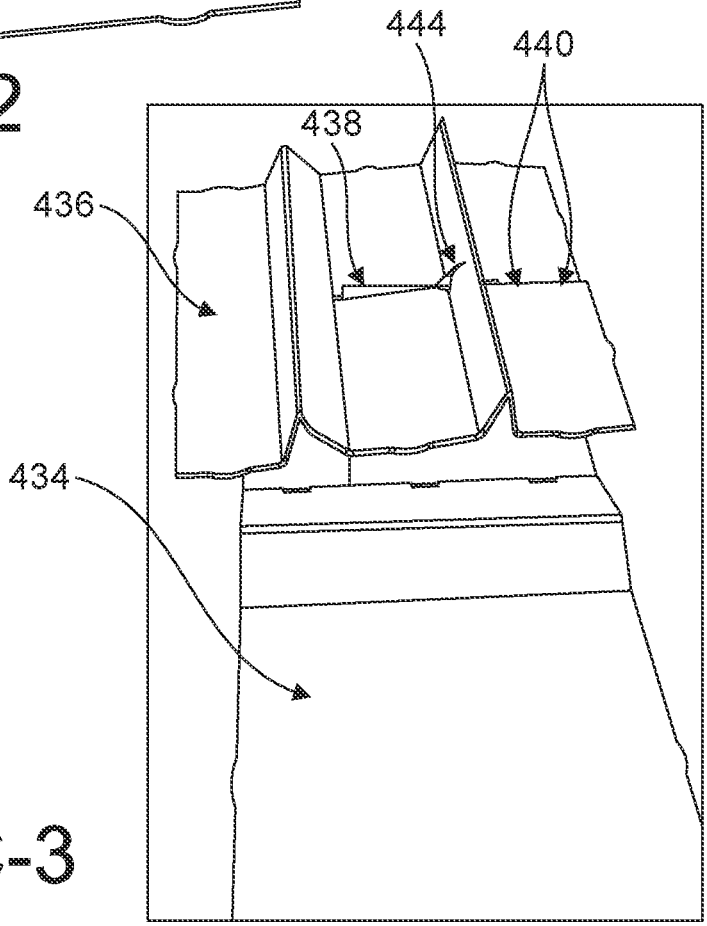
Figures 4, 5C:
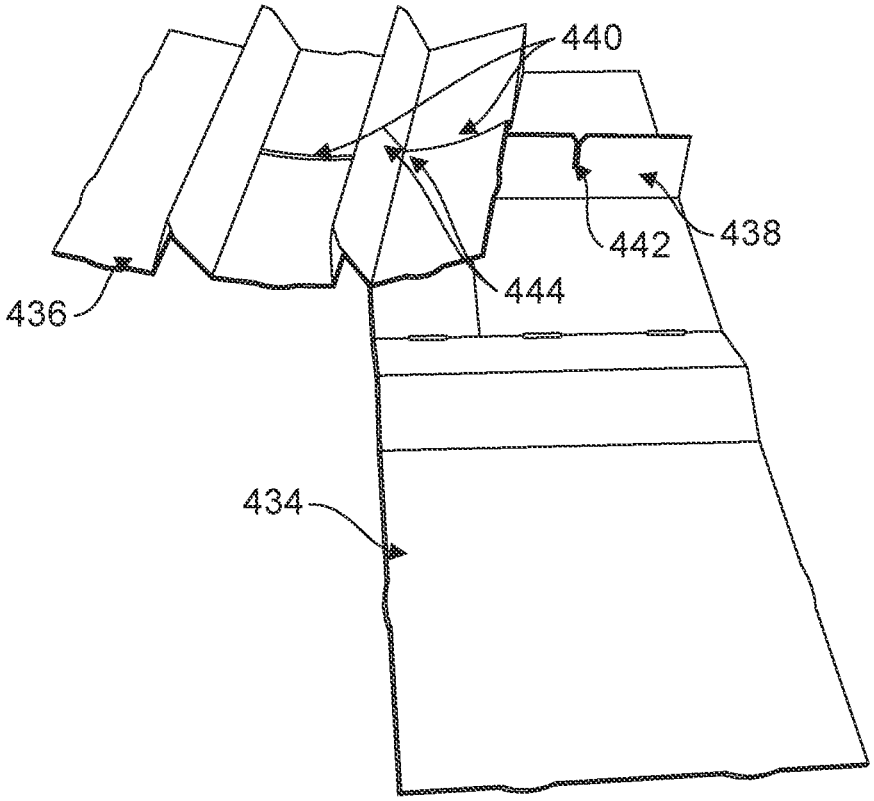
Figures 5, 5C:
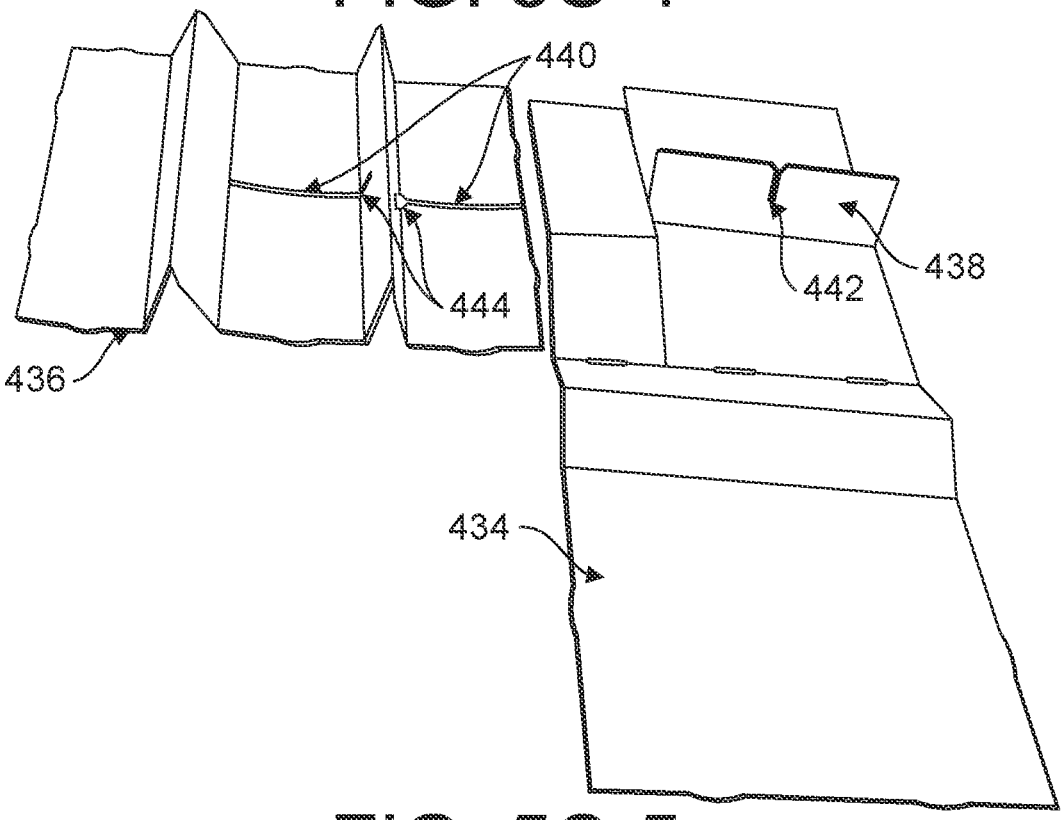
Figures 5, 5C, 6:
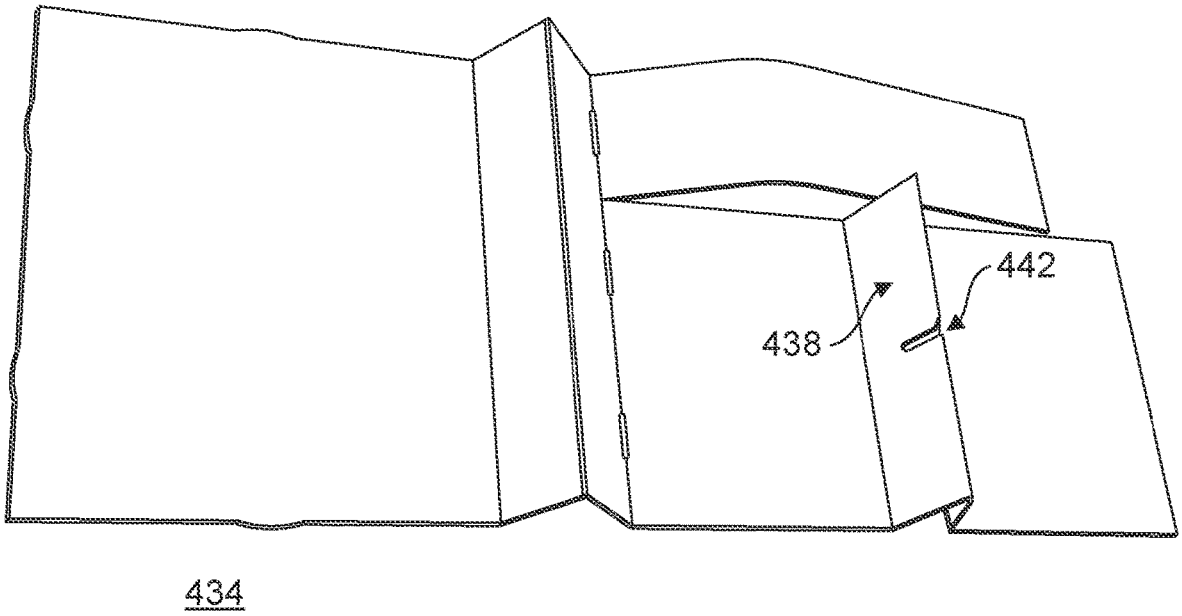
Figures 5, 5C, 6, 7:
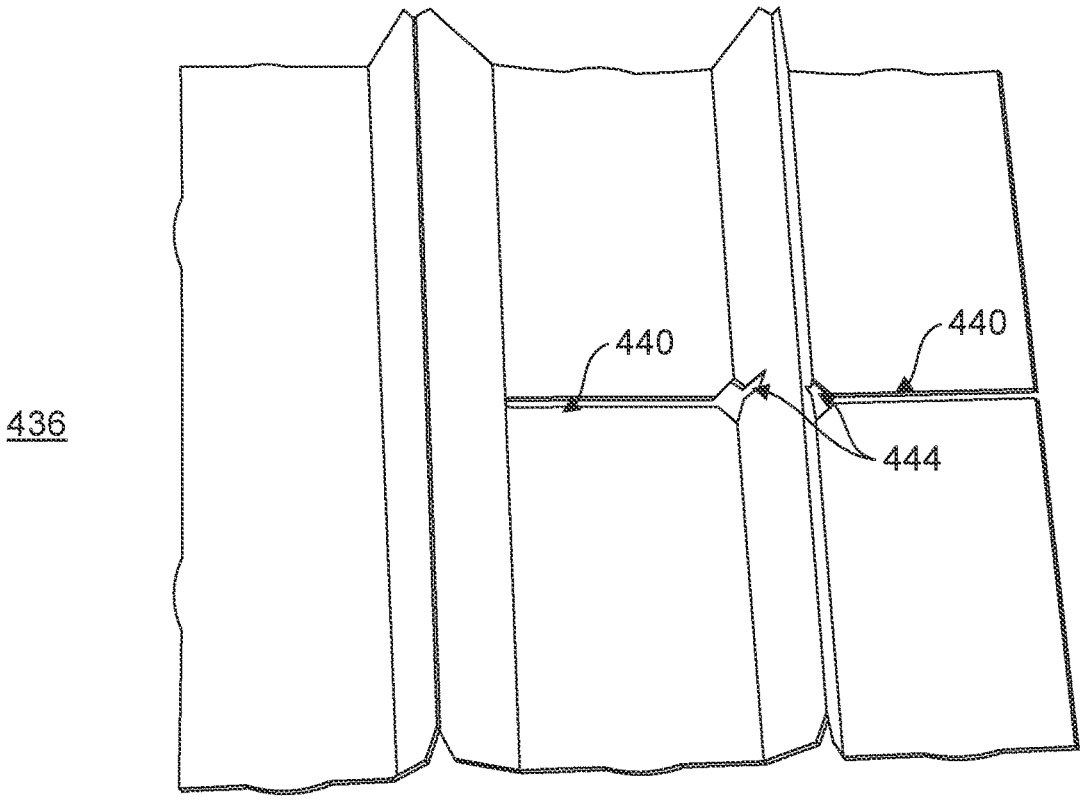

FIGS. 5C-1 to 5C-7 are a non-limiting, exemplary illustrations of other types of dividers that may be used in accordance with one or more embodiments of the present invention, which are shown to better illustrate the large number of ways possible to compartmentalize tray. FIG. 5C-1 shows the final compartmentalization using two inserts or dividers 434 and 436.

FIG. 5C-2 to 5C-7 illustrate the same dividers 434 and 436 shown in FIG. 5C-1, but pulled out of tray 102 and progressively separated to shown method of reassembly. As illustrated, first divider 434 is the "bottom" insert and second divider 436 is the "top" divider that interlocks with first divider 434.

First divider 434 includes an interlocking divider fold 438 that is inserted into divided opening 440 of second divider 436. Interlocking divider fold 438 of first divider 434 further includes a top facing interlock structure 442 that cross-connect or interlock with a bottom facing interlock structure 444 of second divider 436.

Figure 6A:
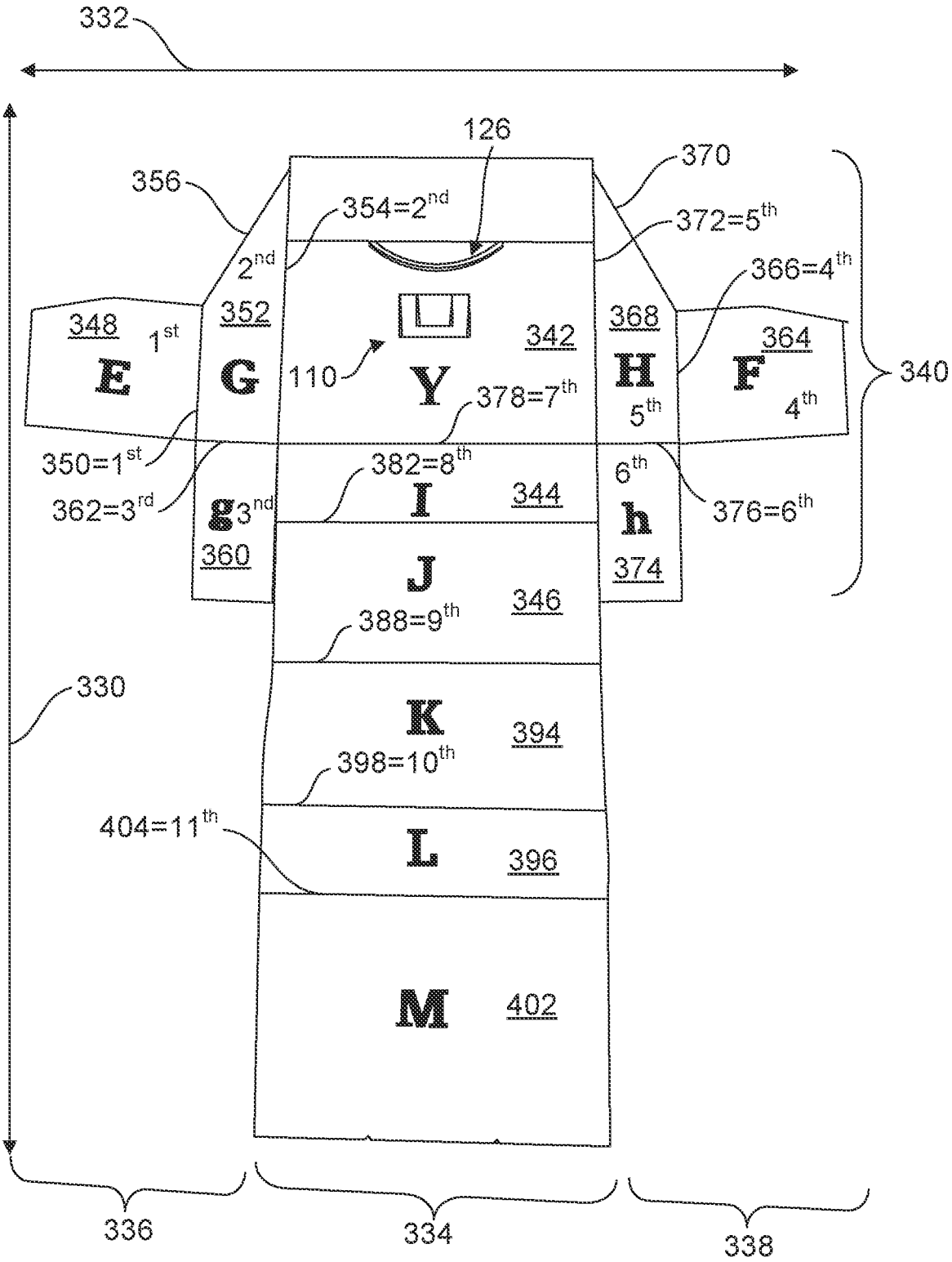
FIGS. 6A to 6S are non-limiting, exemplary illustrations of a sleeve cover piece, progressively illustrating a non-limiting, exemplary method of assembly thereof in accordance with one or more embodiments of the present invention.
Figure 6B:
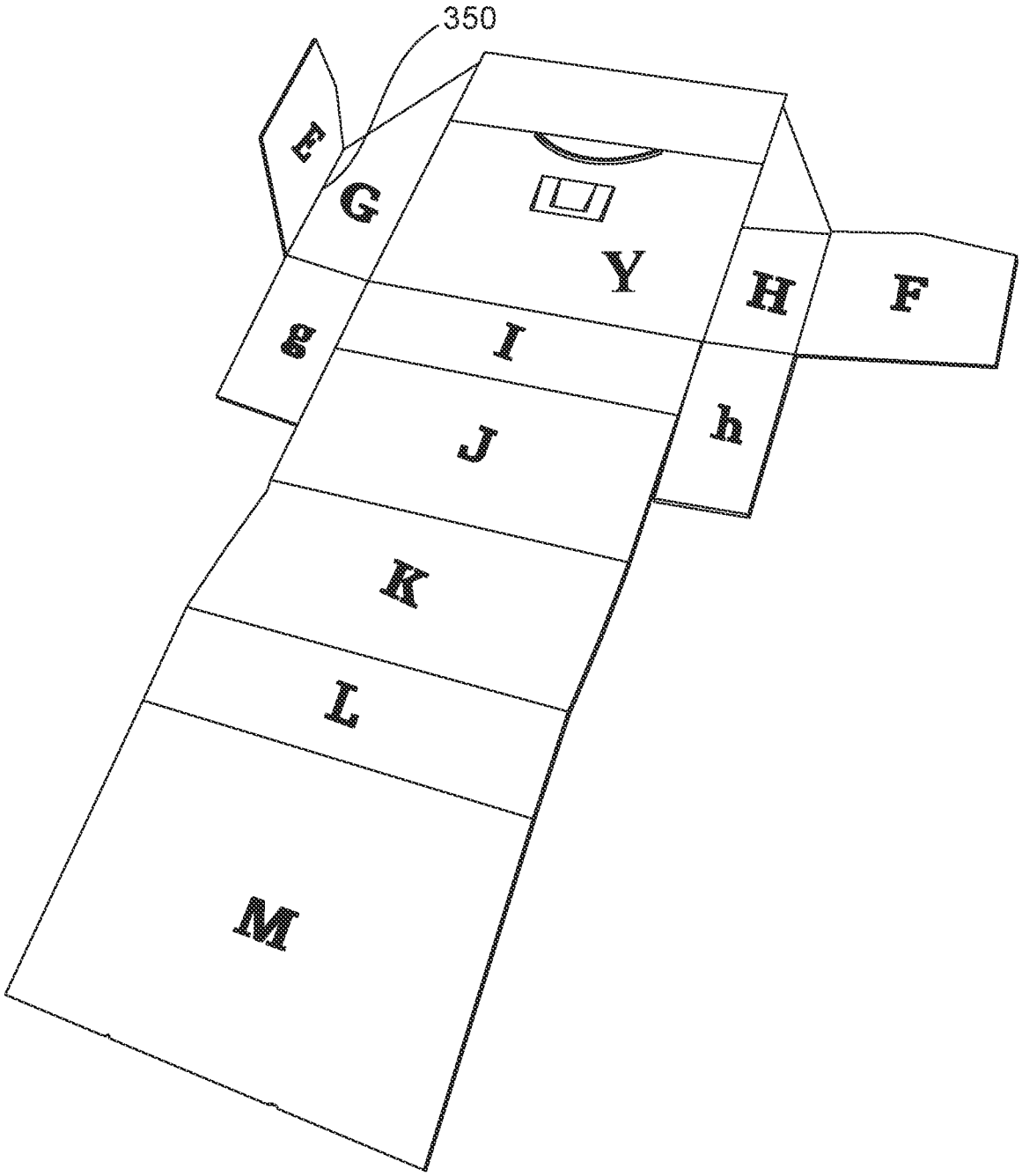
Figure 6C:
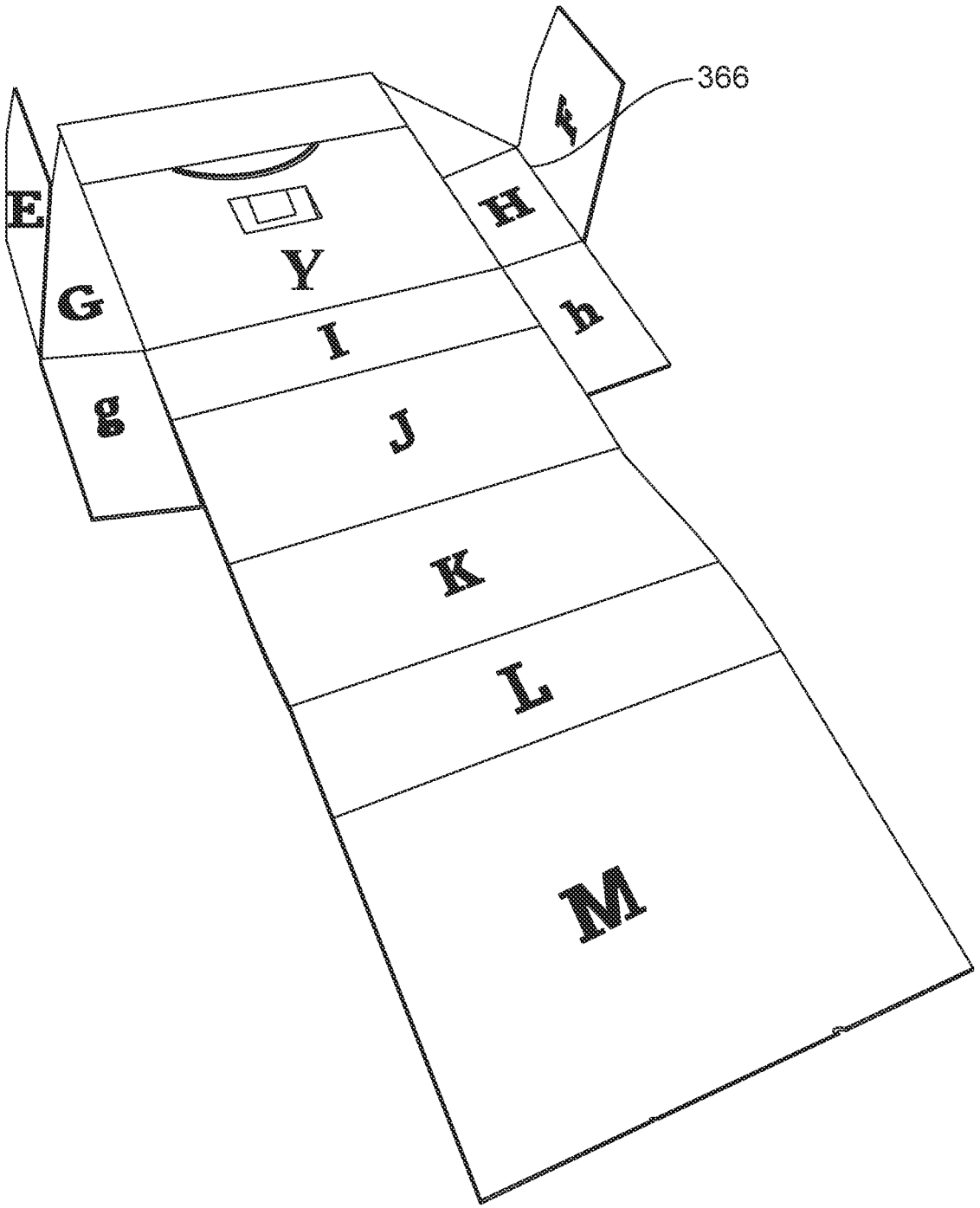
Figure 6D:
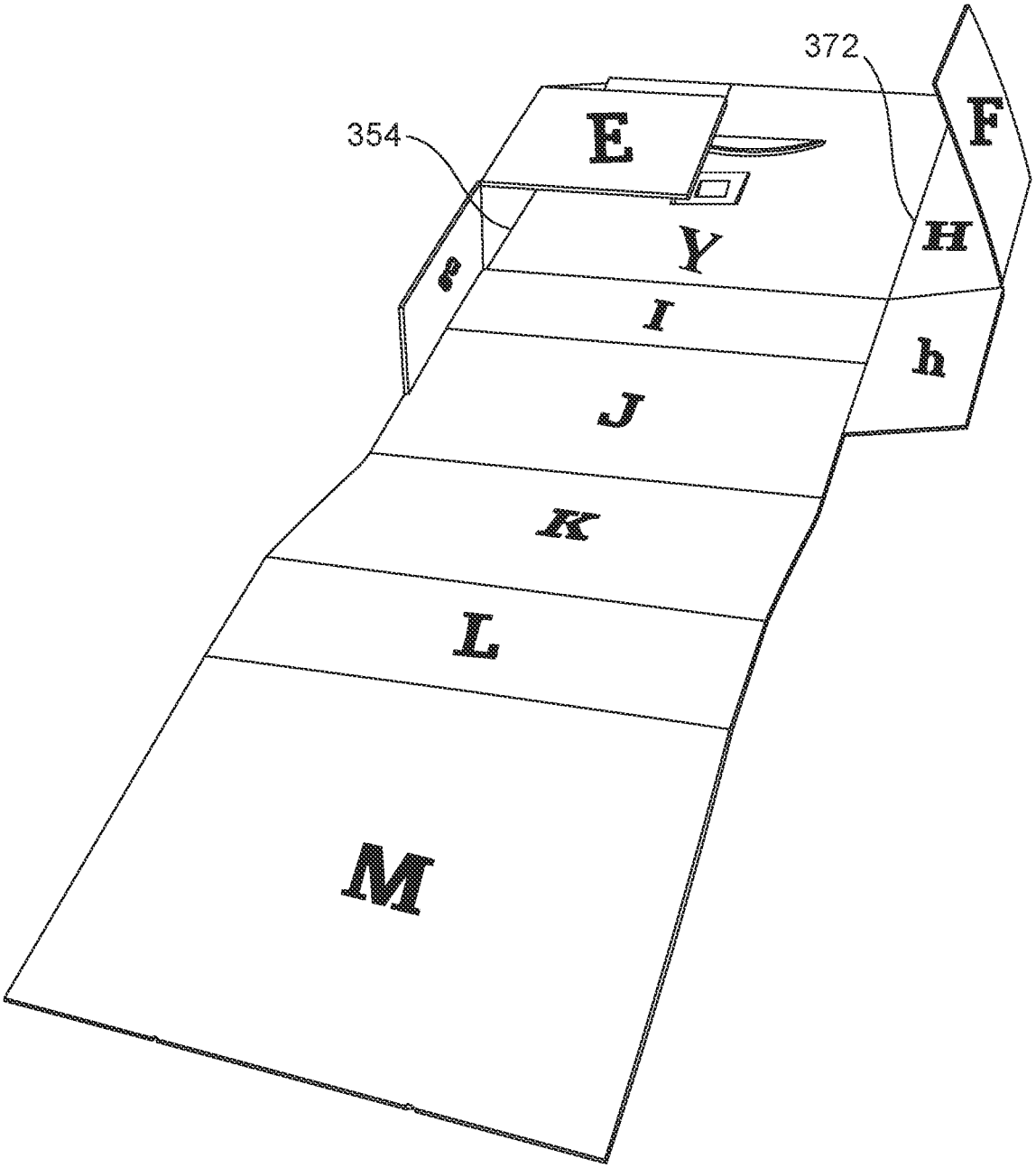
Figure 6E:
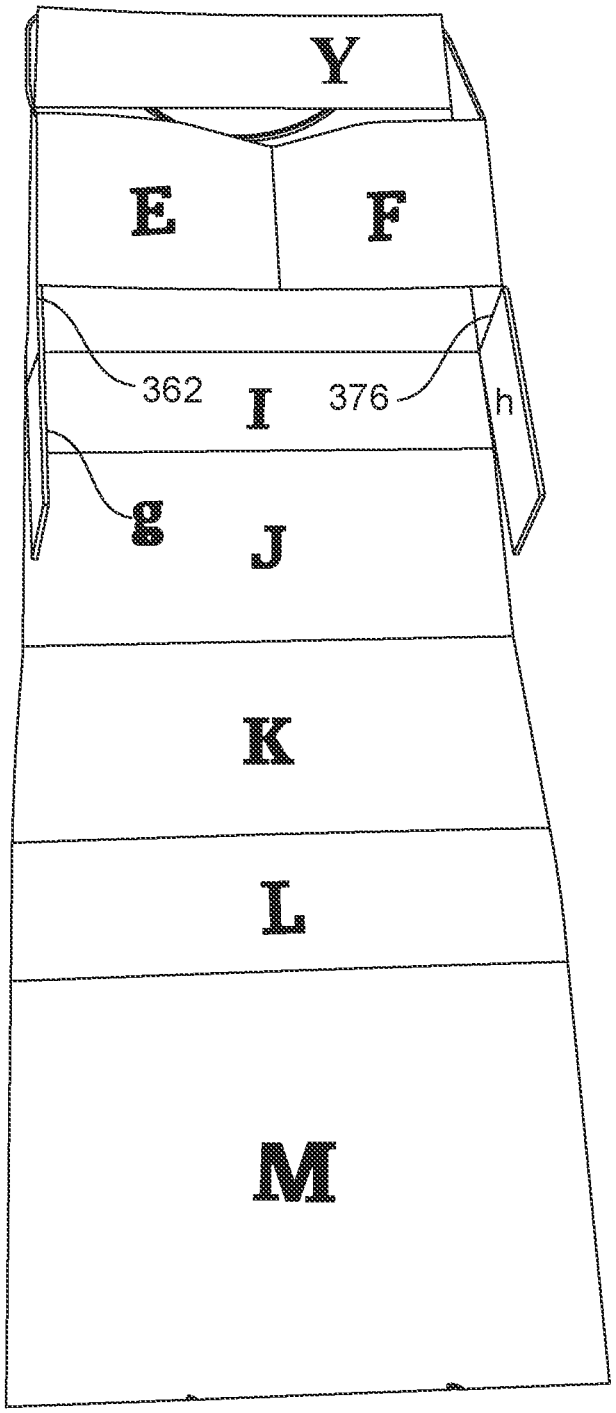
Figure 6F:
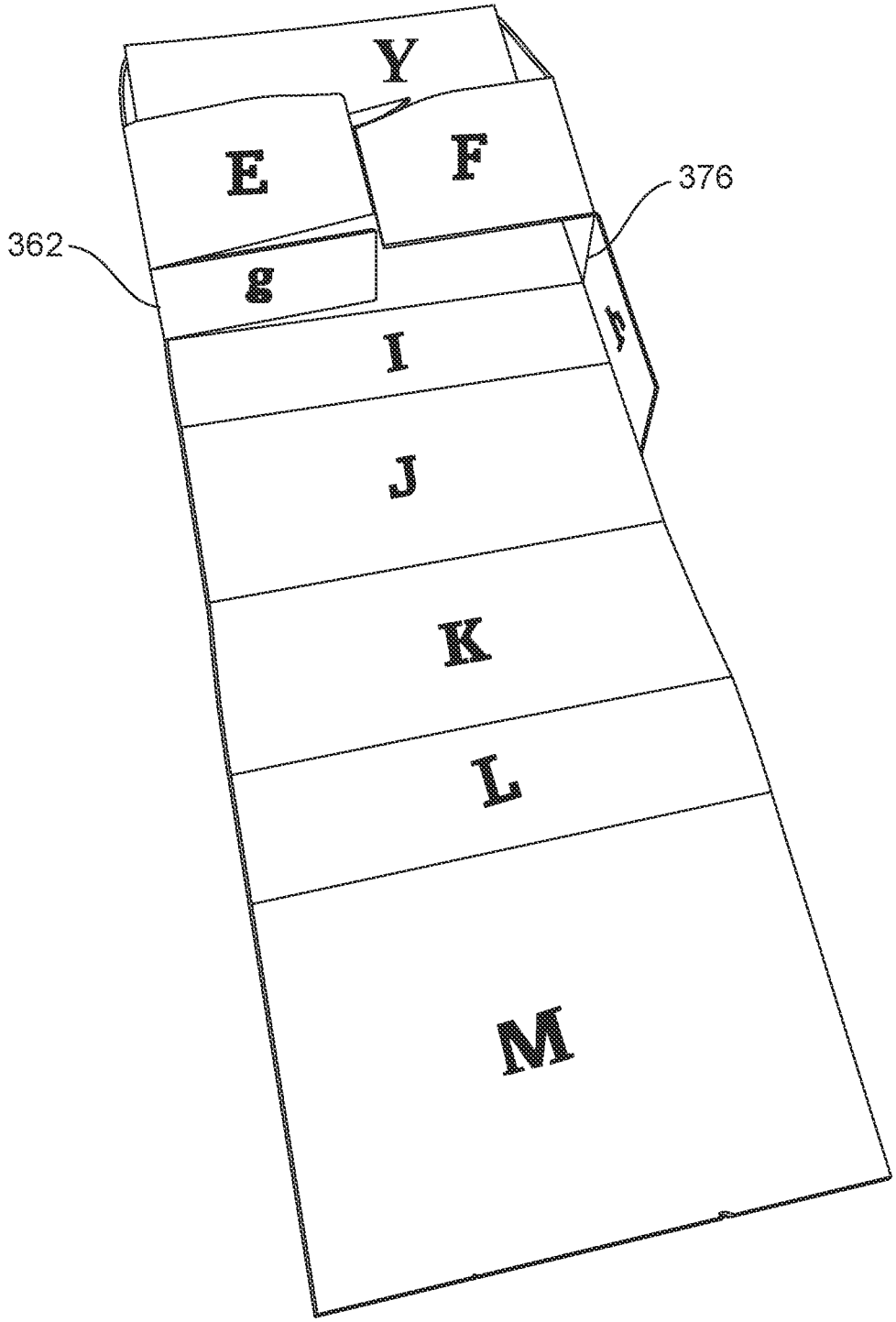
Figure 6G:
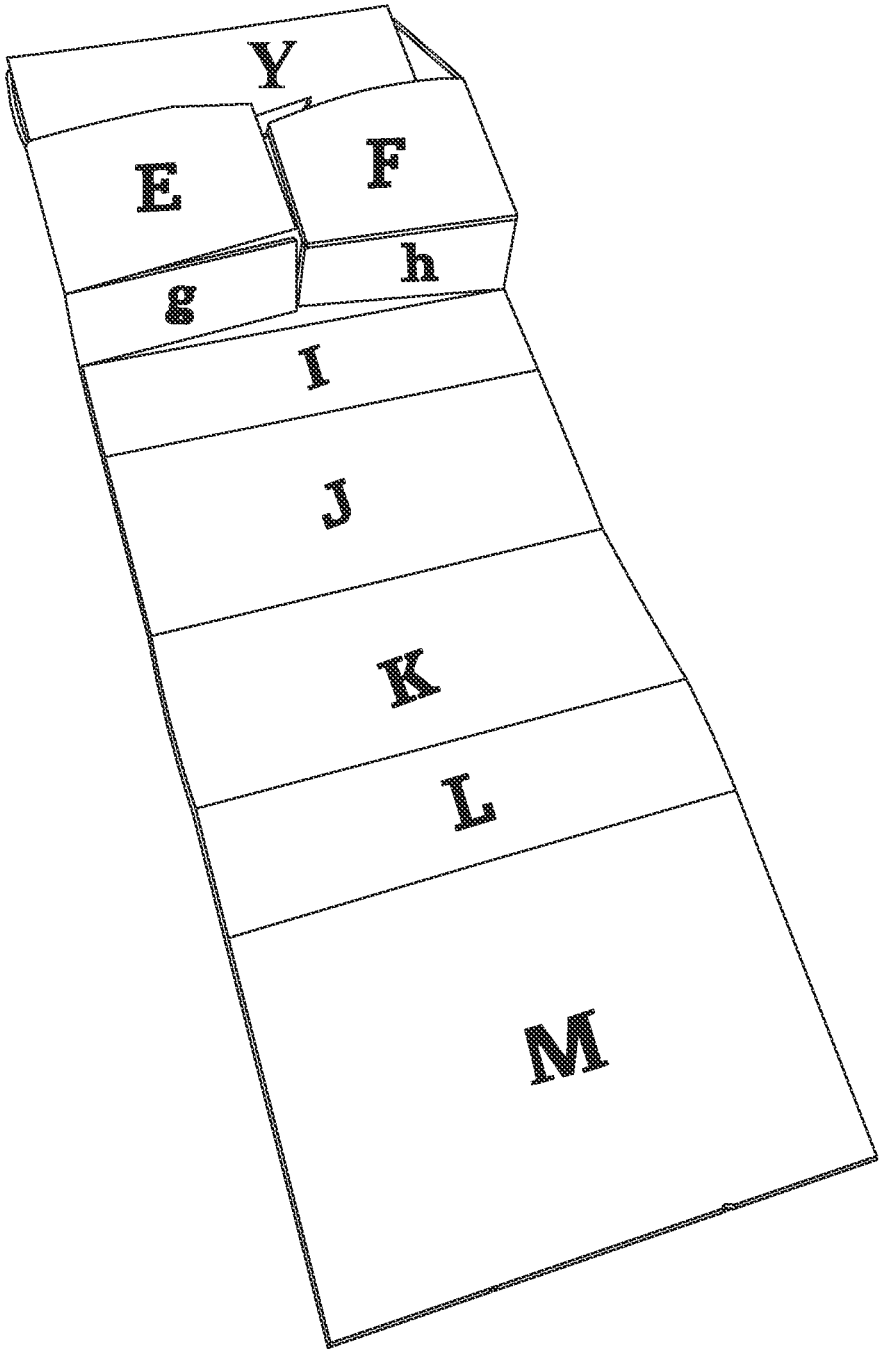
Figure 6H:
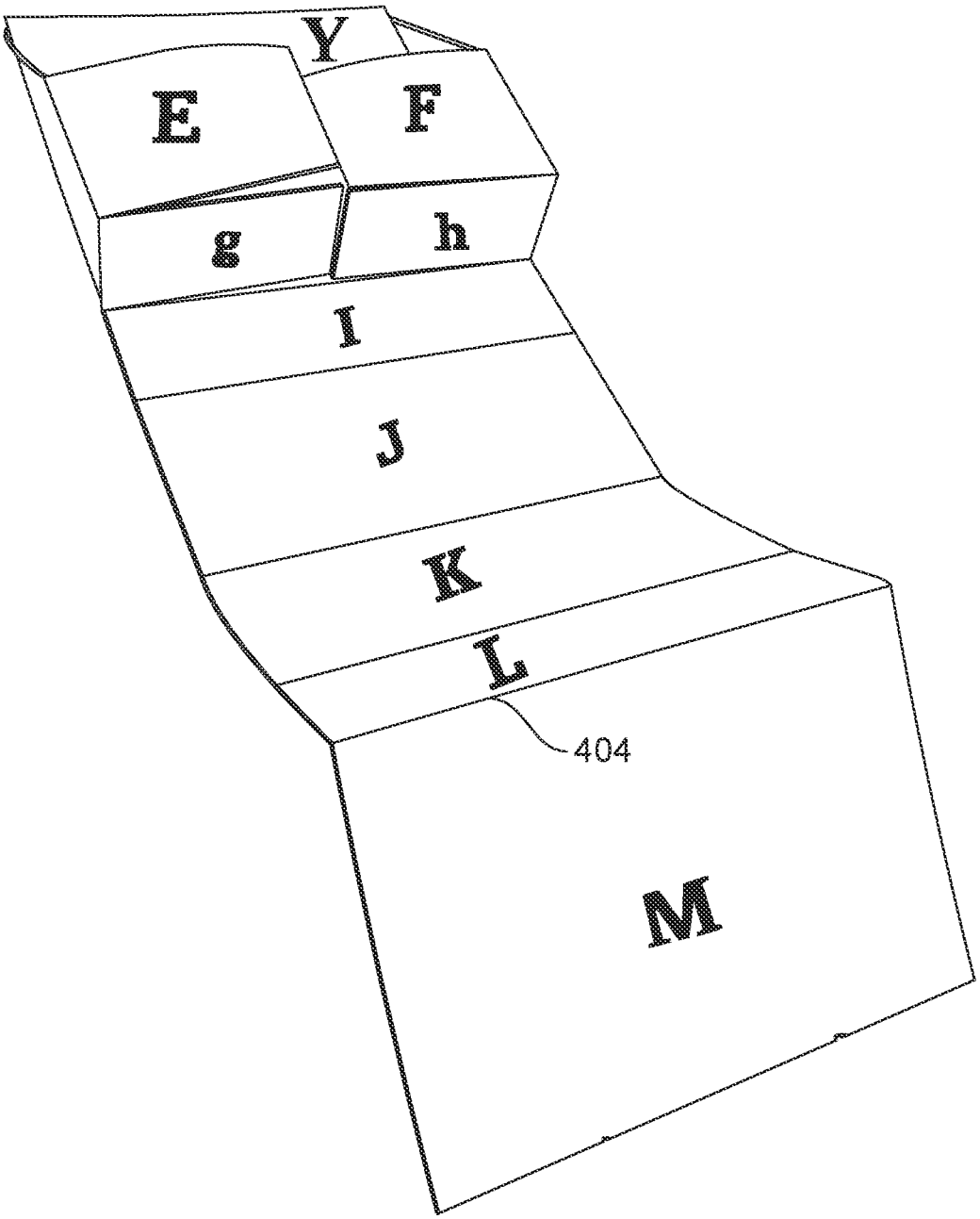
Figure 6I:
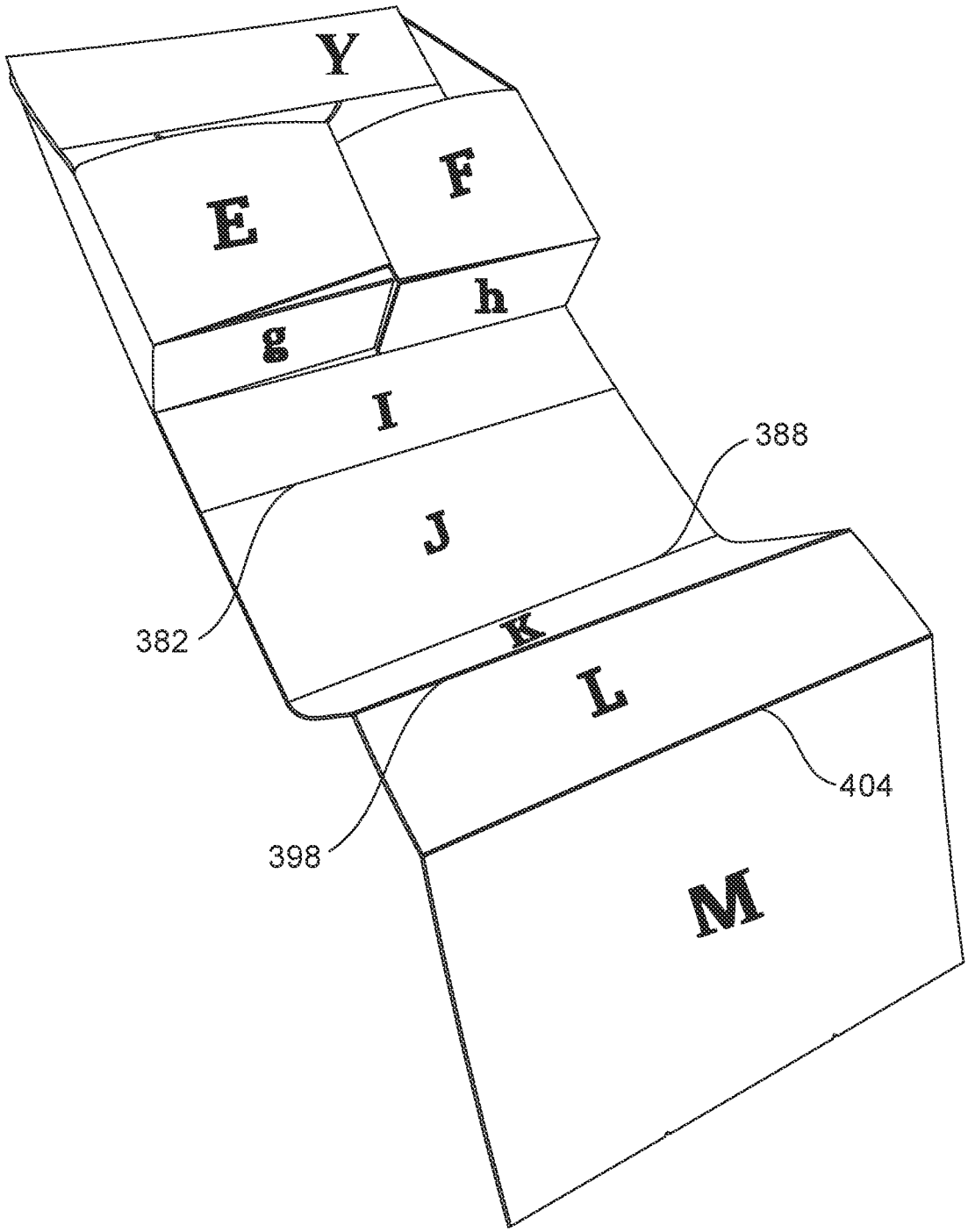
Figure 6J:
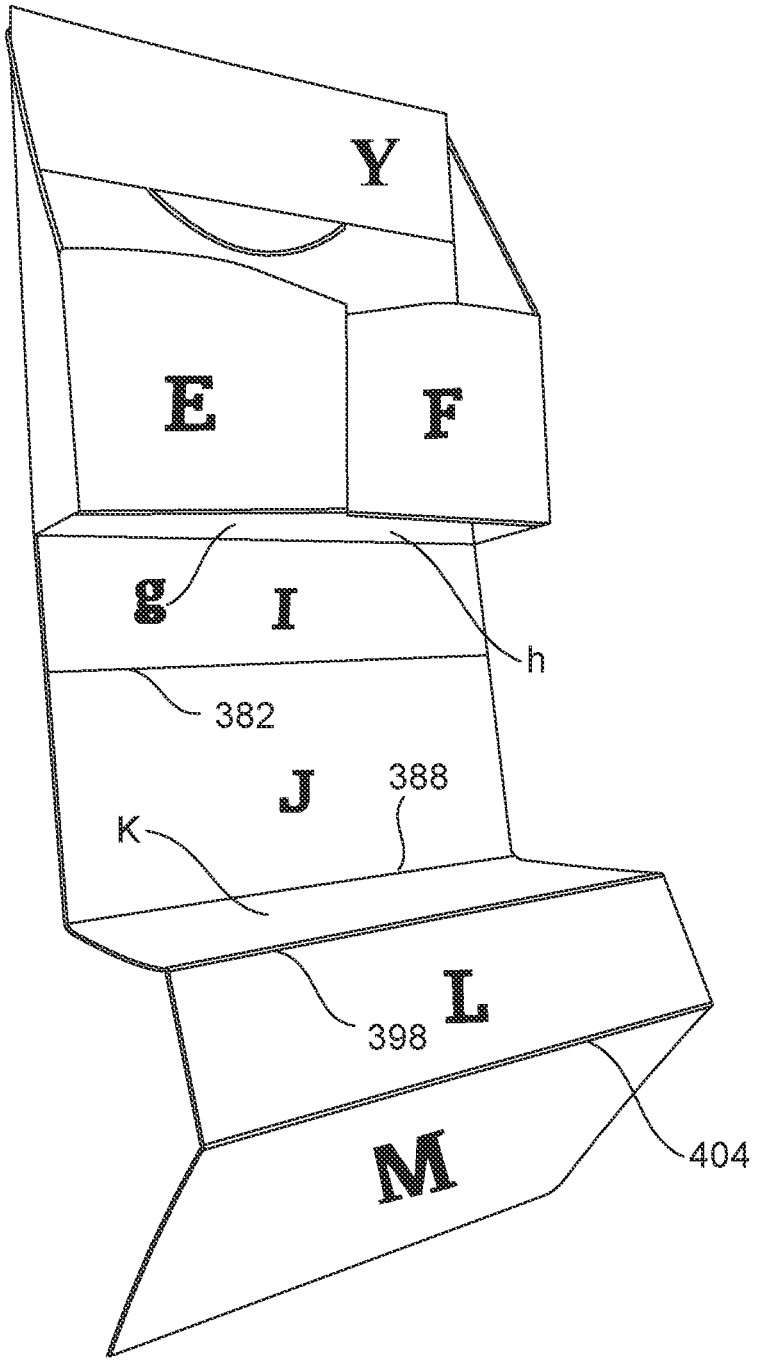
Figure 6K:
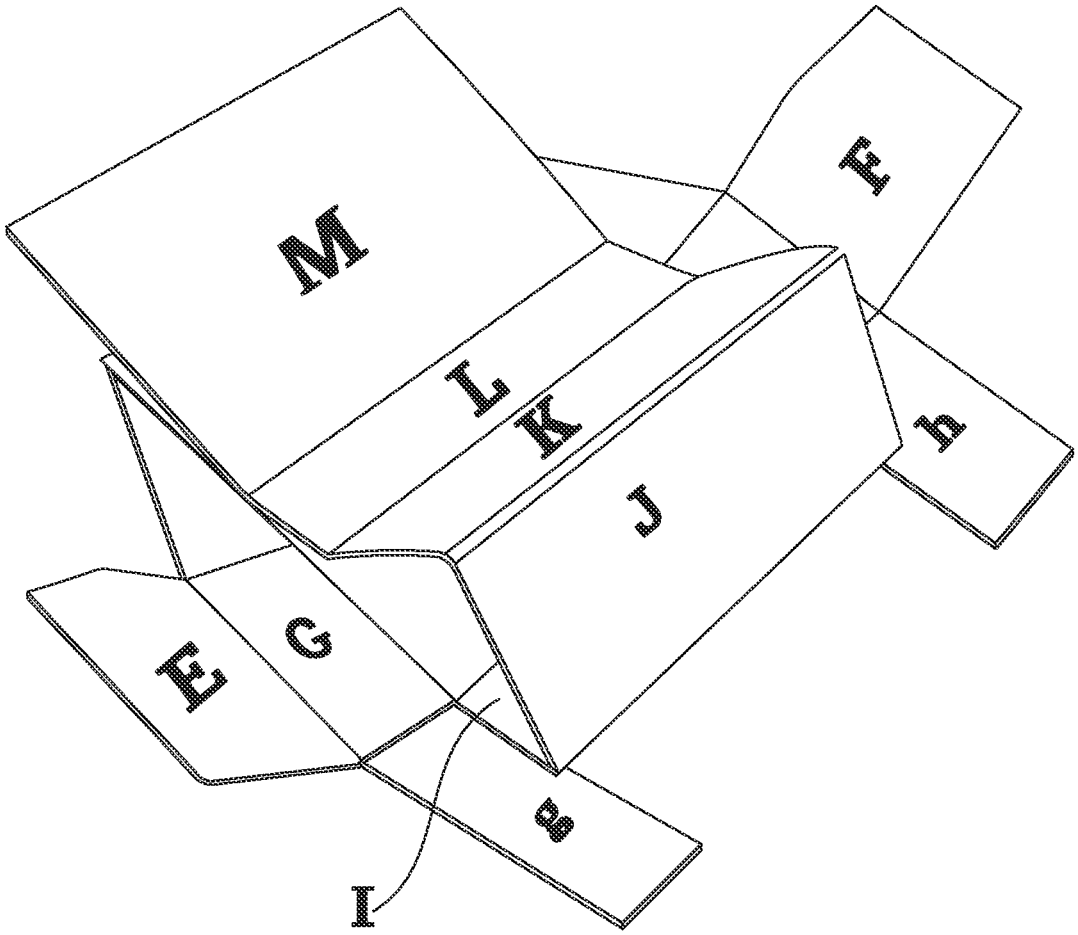
Figure 6L:
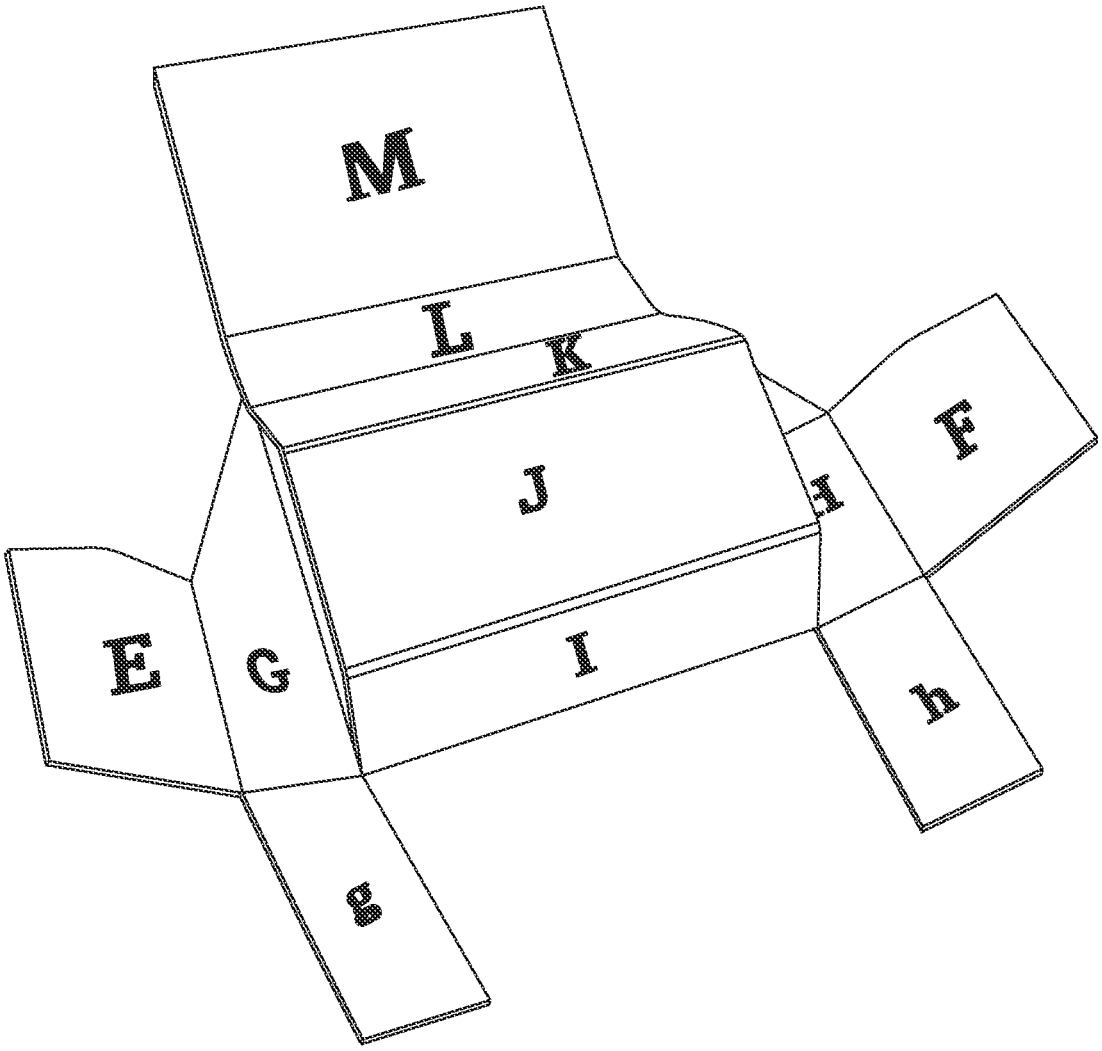
Figure 6M:
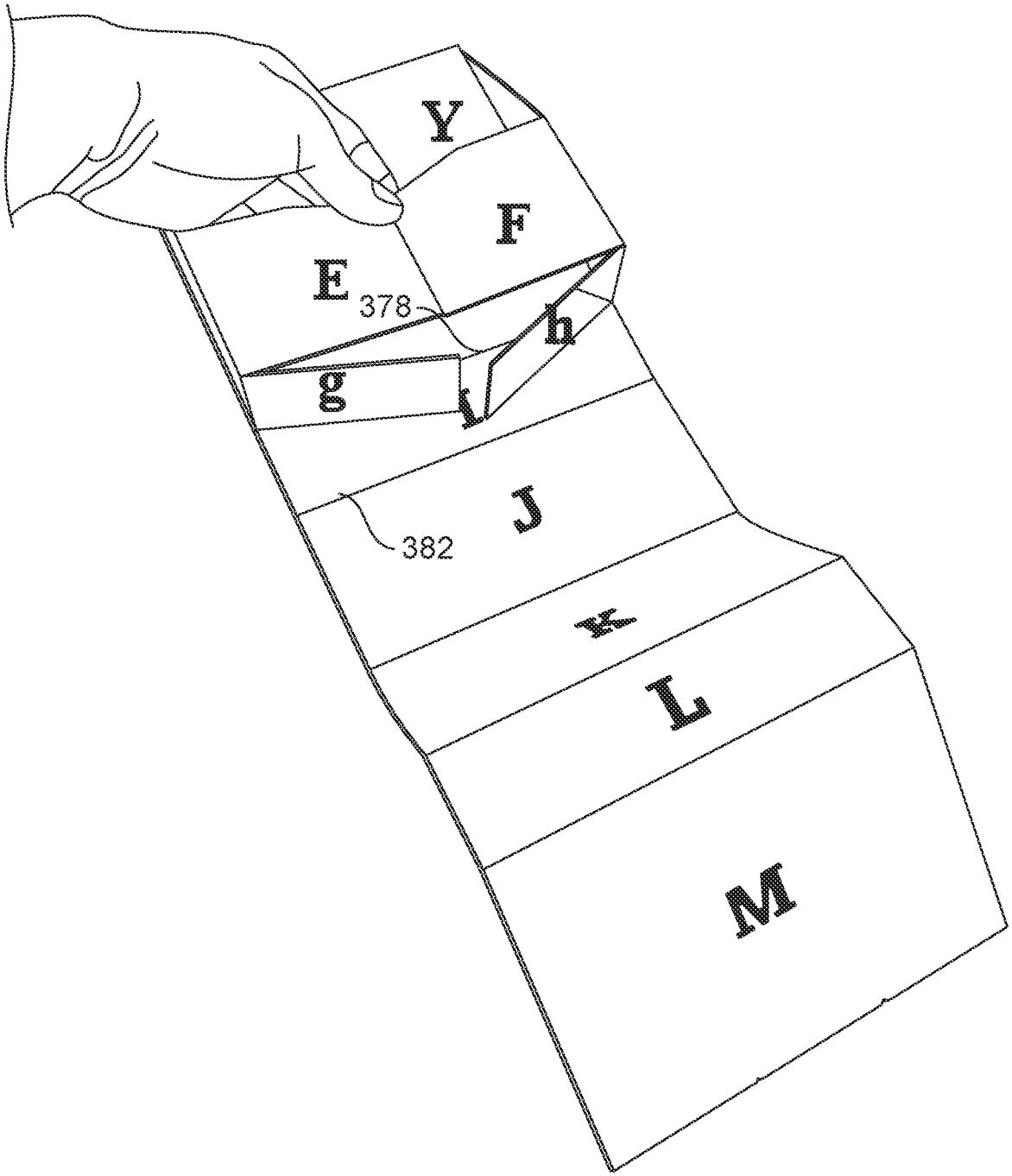
Figure 6N:
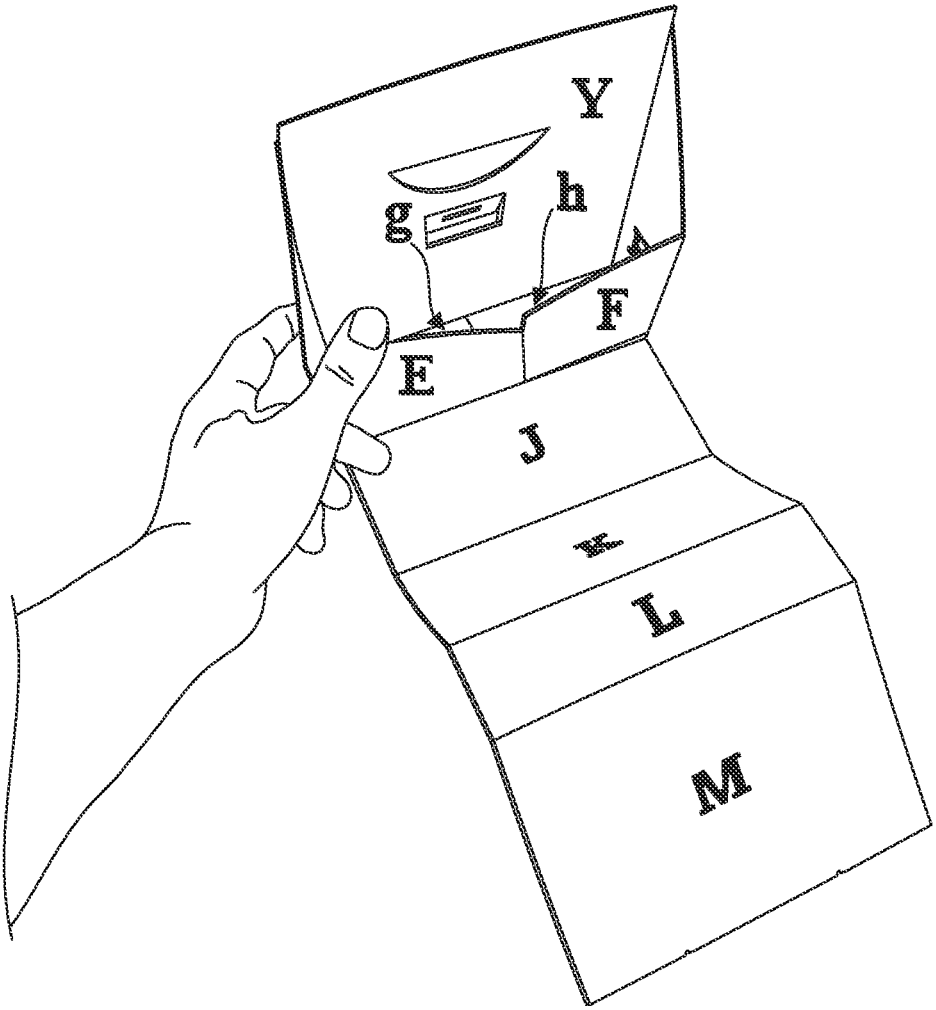
Figure 6O:
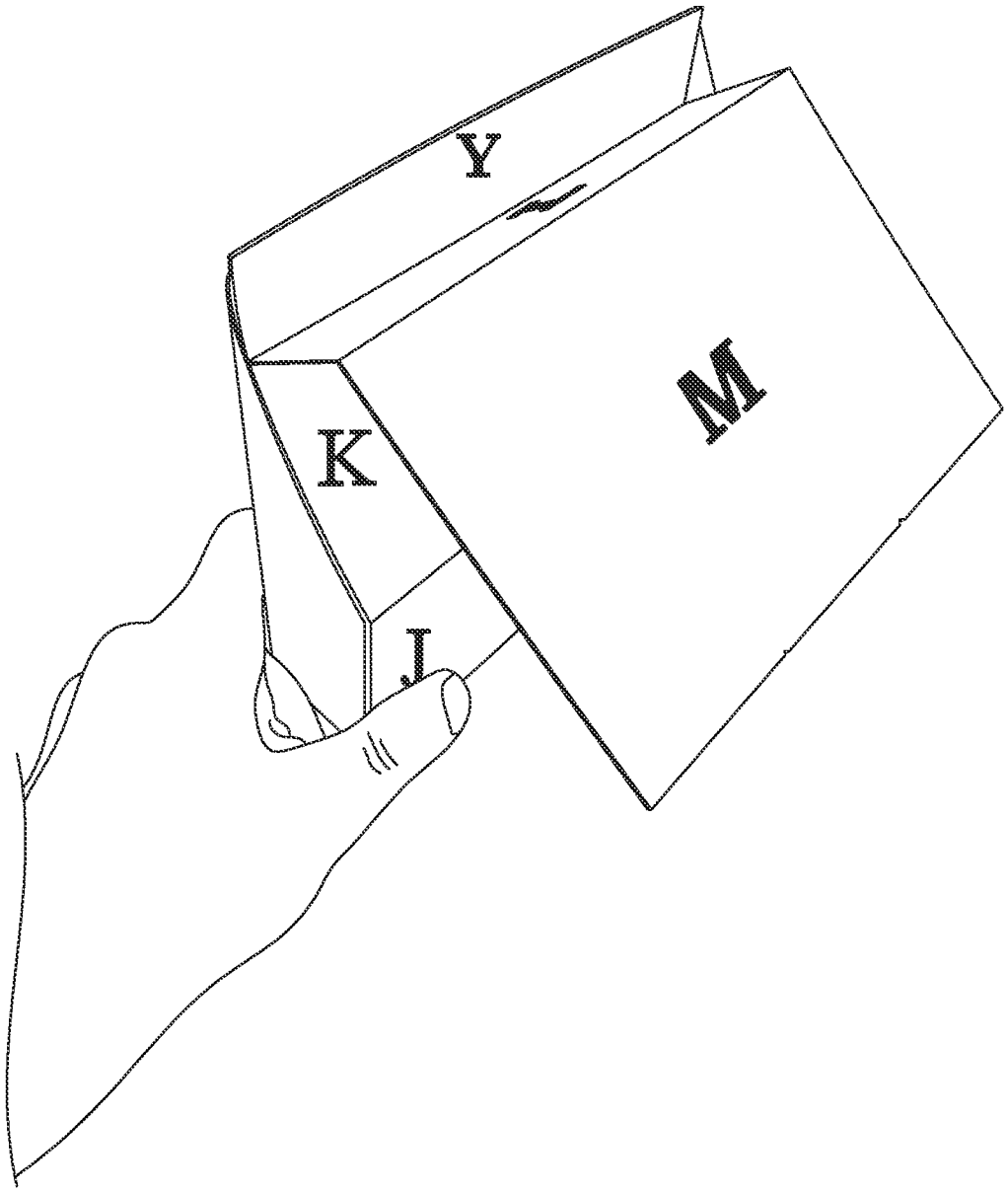
Figure 6P:
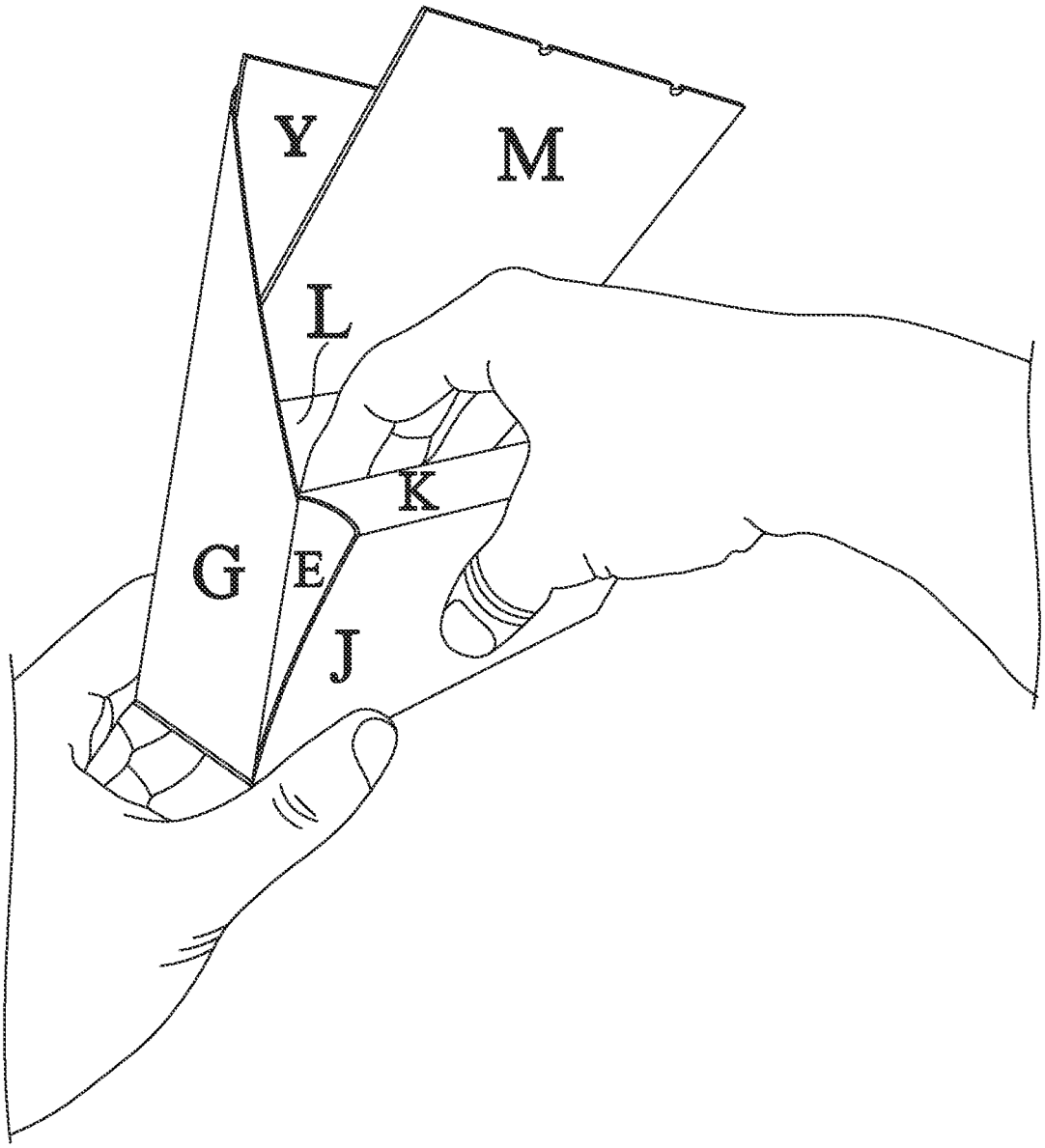
Figure 6Q:
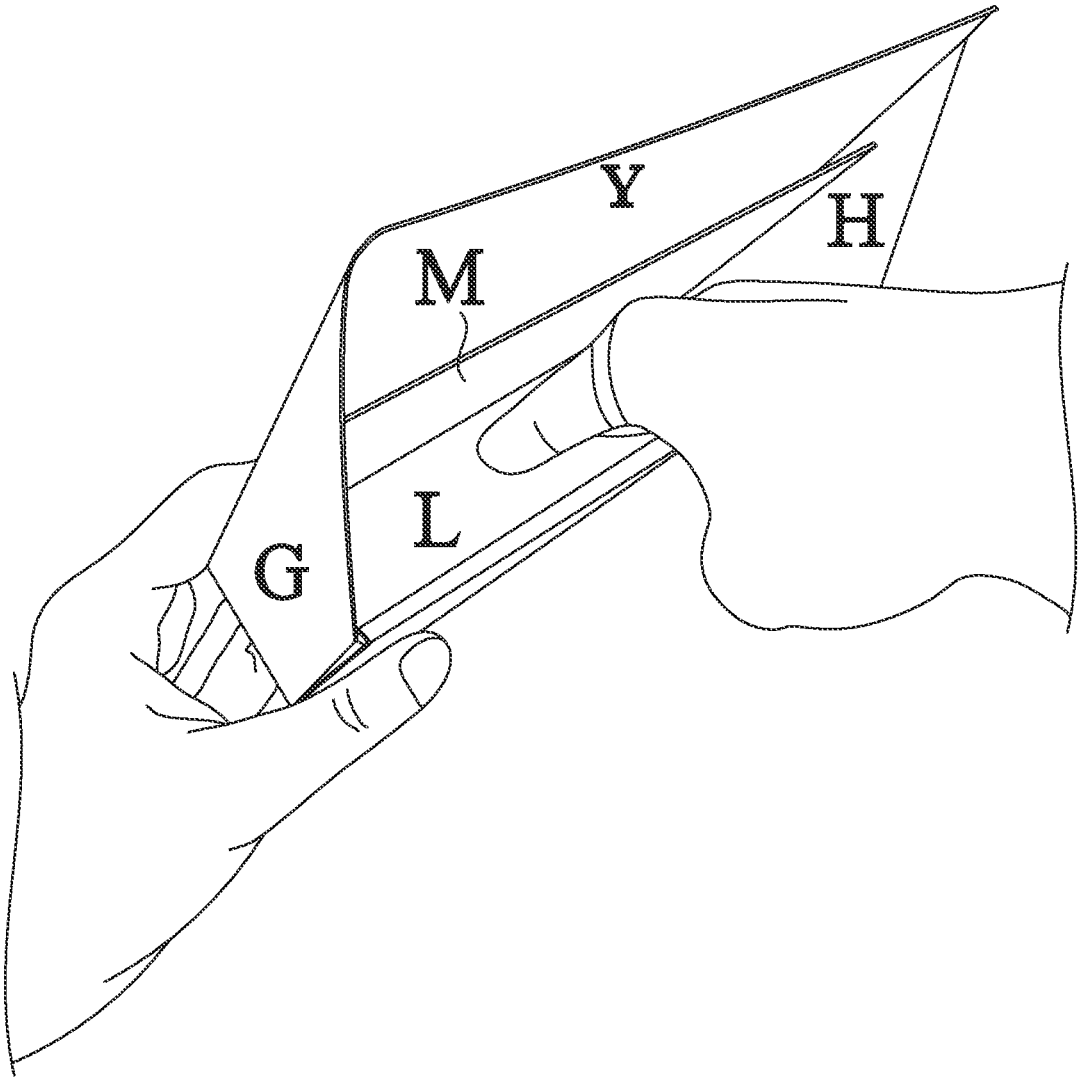
Figure 6R:
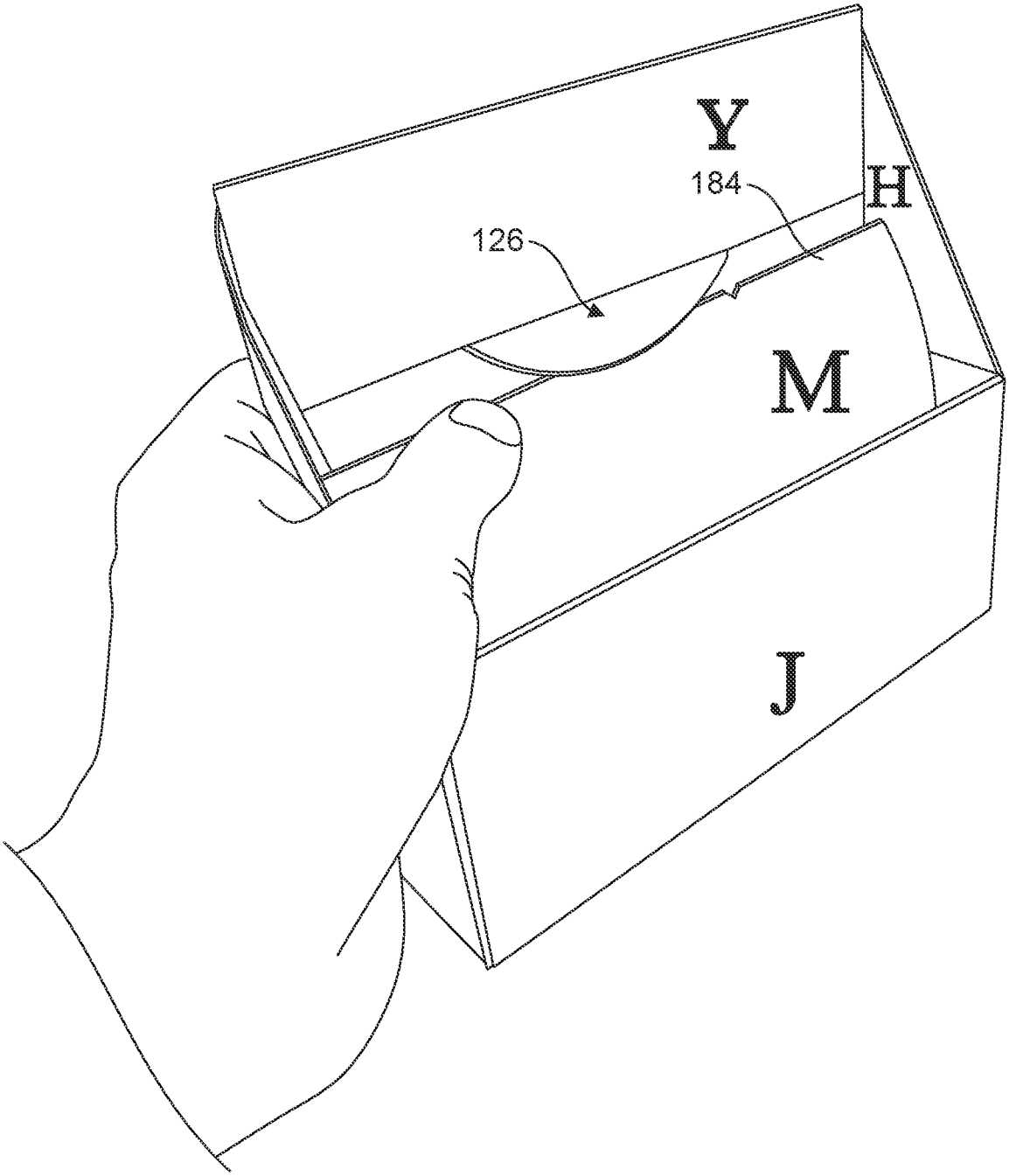
Figure 6S:
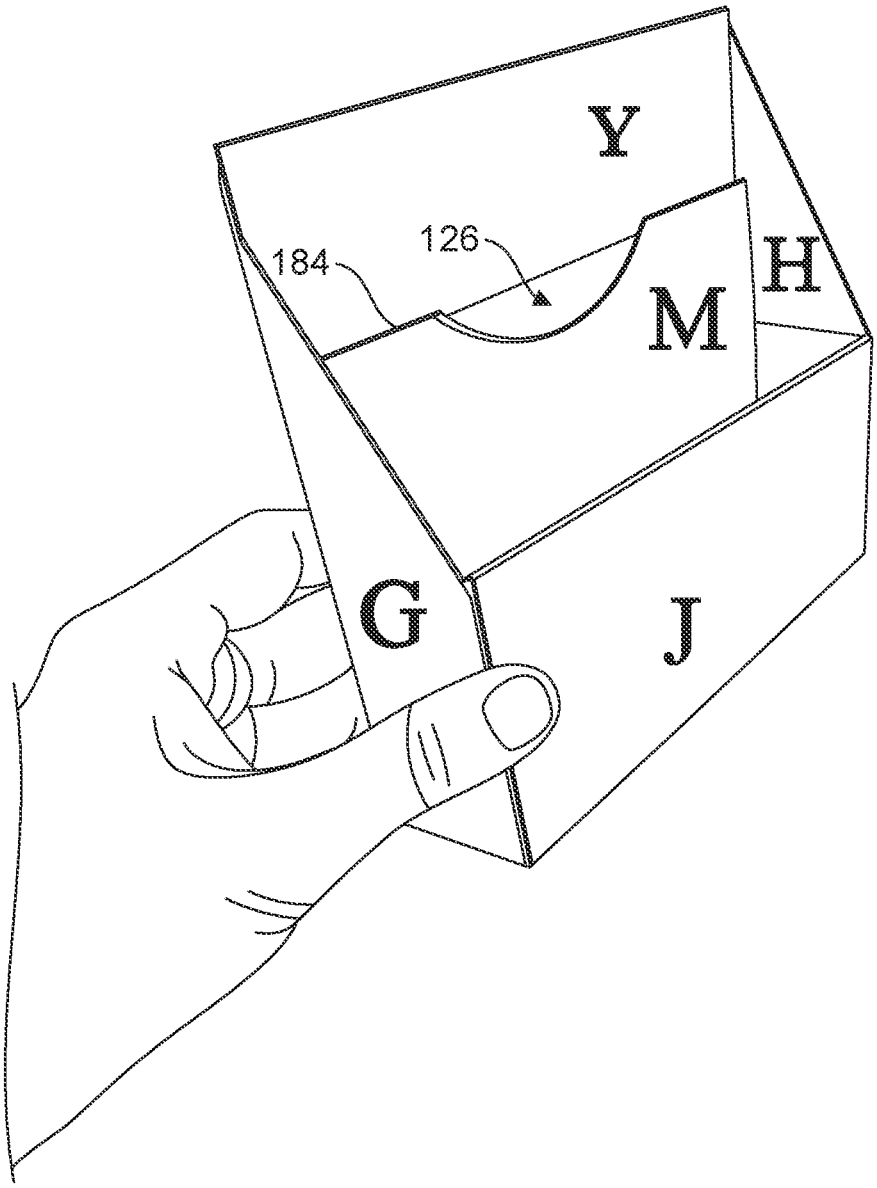

FIGS. 6A to 6S are non-limiting, exemplary illustrations of a sleeve cover piece, progressively illustrating a non-limiting, exemplary method of assembly thereof in accordance with one or more embodiments of the present invention.

As illustrated in FIGS. 3 and 6A to 6S, both sleeve covers 104 and 106 are comprised of identical, single-piece, planar sheet cut-outs (sleeve cover pieces 208 and 210), with each folded about fold-marks to form the sleeve covers 104 and 106. Only one sleeve cover piece is shown representing both sleeve cover pieces 208/210 in FIGS. 6A to 6S and detailed below as both sleeve covers pieces 280/210 are identical.

The sleeve cover piece includes a middle portion 334, a first laterally extending flange 336 that extends laterally from a first side of an upper portion 340 of middle portion 334, and a second laterally extending flange 338 that extends laterally from a second side of upper portion 340 of middle portion 338. First and second laterally extending flanges 336 and 338 are identical.

First laterally extending flange 336 is comprised of a first outer most flange 348 also labeled as E, with a first polygonal configuration.

First outer most flange 348 E is cantilevered along a shared first fold mark 350 that is oriented parallel a longitudinal axis 330 of the sleeve cover piece, delineating first outer most flange 348 E from an adjacent first upper flange 352 also labeled as G.

First laterally extending flange 336 is further comprised of first upper flange 352 G with a second polygonal configuration that forms a first lateral side 162 of the sleeve cover, with a free side 356 of first upper flange 352 G forming a tapered and slanted edge 358 of an extended lateral portion 172 of the first lateral side 162 of the sleeve cover.

First upper flange 352 G includes a shared second fold mark 354 that is oriented parallel longitudinal axis 330 of the sleeve cover piece, delineating the first upper flange 352 G from an adjacent first middle section 342 also labeled as Y.

First laterally extending flange 336 is further comprised of a first lower flange 360 also labeled as g with a third polygonal configuration that is cantilevered along a shared third fold mark 362 that is oriented parallel a transverse axis 332 of the sleeve cover piece, delineating the first lower flange 360 g from adjacent first upper flange 352 G.

Second laterally extending flange 338 is comprised of a second outer most flange 364 also labeled as F, with a fourth polygonal configuration.

Second outer most flange 364 F is cantilevered along a shared fourth fold mark 366 that is oriented parallel a longitudinal axis 330 of the sleeve cover piece, delineating the second outer most flange 364 from an adjacent second upper flange 368 also labeled as H.

Second laterally extending flange 338 is further comprised of a second upper flange 368 H with a fifth polygonal configuration that forms a second lateral side 164 of the sleeve cover, with a free side 370 of second upper flange 368 H forming a tapered and slanted edge 358 of an extended lateral portion 172 of the second lateral side 162 of sleeve cover.

Second upper flange 368 H includes a shared fifth fold mark 372 that is oriented parallel a longitudinal axis 330 of the sleeve cover piece, delineating the second upper flange 368 H from an adjacent first middle section 342 Y.

Second laterally extending flange 338 is further comprised of a second lower flange 374 also labeled as h with a sixth polygonal configuration that is cantilevered along a shared sixth fold mark 376 that is oriented parallel a transverse axis 332 of the sleeve cover piece, delineating second lower flange 374 h from an adjacent second upper flange 368 H.

Middle portion 334 includes first middle section 342 Y that is positioned between the first and second upper flanges 352 G and 368 H, delineated by respective second and fifth fold marks 354 and 372 of first and second upper flanges 352 G and 368 H.

First middle section 342 Y forms a top side 120 of the sleeve cover that includes a utensil holder 110 and an interlock mechanism 126.

Middle portion 334 further includes a second middle section 344 also labeled as I, positioned between a first and a second lower flanges 360 g and 374 h, and delineated by a shared seventh fold mark 378 from first middle section 342 Y. Second middle section 344 I forms a sleeve base 160 of the sleeve cover.

Middle portion 334 further includes a third middle section 346 also labeled as J, positioned between the first and the second lower flanges 360 g and 374 h, and delineated by a shared eighth fold mark 382 from second middle section 344 I. Third middle section 346 J forms an exterior bottom side portion 384 of bottom side 158 of the sleeve cover.

Middle portion 334 further includes a fourth middle section 394 also labeled as K, delineated by a shared ninth fold mark 388 from third middle section 346 J. Fourth middle section 394 K forms an interior facing bottom side portion 386 of bottom side 158 of the sleeve cover.

Middle portion 334 further includes a fifth middle section 396 also labeled as L, delineated by a shared tenth fold mark 398 from fourth middle section 346 J. Fifth middle section 396 L forms sleeve base support 380 of the sleeve cover.

Middle portion 334 further includes a sixth middle section 402 also labeled as M, delineated by a shared eleventh fold mark 404 from fifth middle section 394 L. Sixth middle section 396 L forms a secondary interior facing top side support 400 of the sleeve cover.

As illustrated in FIGS. 6A to 6G, to assemble a sleeve cover, sections E, F, G, and H are folded inward toward section Y along fold marks 350/366 and 354/372, and sections g and h are folded inward toward section Y along respective fold marks 362/376.

As shown in FIGS. 6H to 6L, section M is folded outward along fold line 404, L is folded outward along fold line 398, K is folded inward along fold line 388, J is folded inward along fold line 382, and I is folded inward along fold line 378. These folding operations flex the various sections to folded positions as shown in FIG. 6M.

Thereafter, as shown in FIGS. 6M and N, while holding sections E and F at the center, section I is folded under sections g and h along fold line 378. As shown in FIG. 6O, section J is folded over sections E and F along fold line 382, and section L is inserted over sections E and F, where section L is aligned over section I underneath (FIGS. 6P and 6Q). As best shown in FIGS. 6R and 6S, top edge 184 of section M is inserted into the interlock section 126 and held in place. The same process may be used to assemble the second sleeve cover piece.

As indicated above, takeout food container shown in FIGS. 2A to 2K is similar to takeout food container shown in FIGS. 1A to 1R, and 3 to 6S with the exception of additional features that are detailed below in FIGS. 7A to 8D.

FIGS. 7A to 8F are non-limiting, exemplary illustrations of a takeout food container that includes additional optional features in accordance with one or more embodiments of the present invention. The takeout food container illustrated in FIGS. 7A to 8F includes similar corresponding or equivalent components, pieces, methods, interconnections, assemblies, functional, operational, and or cooperative relationships as the takeout food container that is shown in FIGS. 1A to 6S, and described above. Therefore, for the sake of brevity, clarity, convenience, and to avoid duplication, the general description of FIGS. 7A to 8F will not repeat every corresponding or equivalent component, pieces, methods, interconnections, assemblies, functional, operational, and or cooperative relationships that has already been described above in relation to takeout food container that is shown in FIGS. 1A to 6S but instead, are incorporated by reference herein.

Figure 7A:
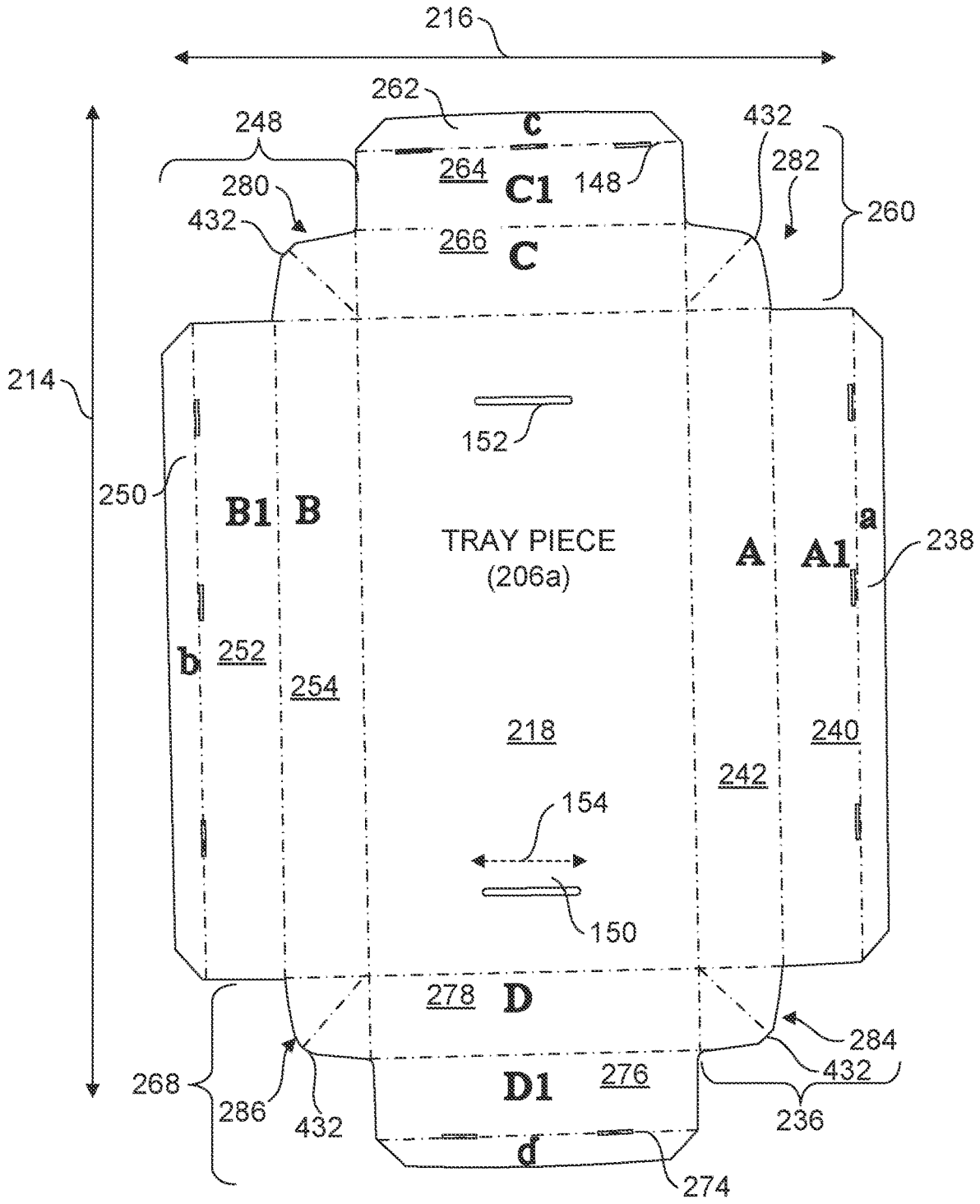

FIG. 7A is a non-limiting, exemplary illustration of a tray piece a takeout food container shown in FIGS. 2A to 2K in accordance with one or more embodiments of the present invention. As illustrated, tray piece 206*a* shown in FIG. 7A is similar to tray piece 206 shown in FIG. 4 with the exception of the additional optional features of first elongated opening 150 near first transverse side 144 and an optional second elongated opening 152 near second transvers side 146.

Optional first and second elongated openings 150 and 152 are identical, and are oriented longitudinally (along their longitudinal axis 154) parallel first and second transverse sides 144 and 146 of tray 102. First and second elongated openings 152 and 154 function as interlocking recesses or slots to interlock with optional first and second interlocking projections 168 and 170 of first and second sleeve covers 104 and 106.

In this non-limiting, exemplary instance, the rectangular core section 218 also includes four corner sections 280, 282, 284, 286, but with outer edges 432 that are linear (flat) rather than a pointed vertex. "Pointy" edges are prone to damage during assembly and hence, a flat linear edge 432 is less prone to damage during assembly.

Figure 7B:
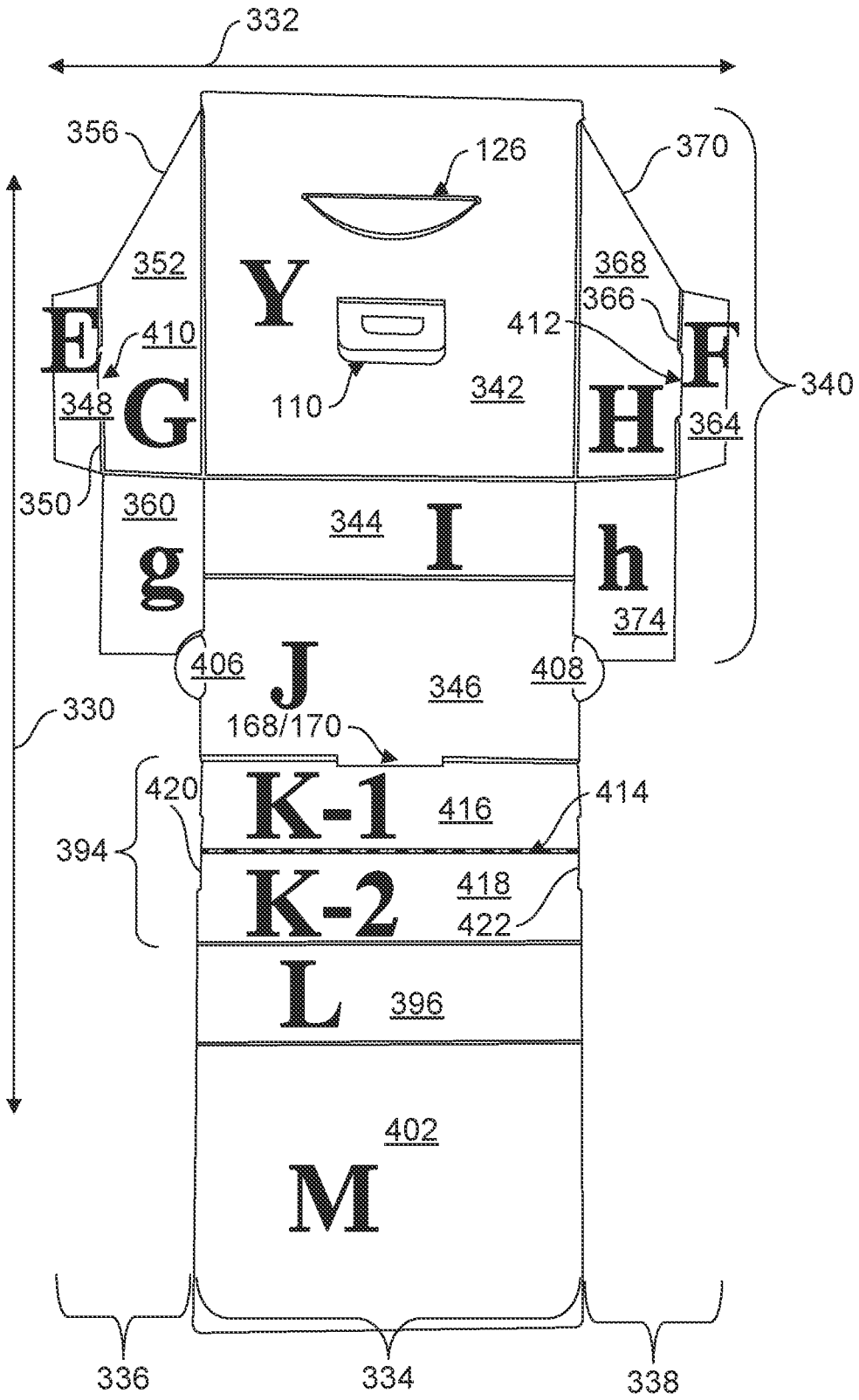

FIG. 7B is a non-limiting, exemplary illustration of a sleeve cover piece of a takeout food container shown in FIGS. 2A to 2K in accordance with one or more embodiments of the present invention. In FIG. 7B only one sleeve cover piece is shown representing both sleeve cover pieces 208*a*/210*a* as both are identical.

In this non-limiting, exemplary embodiment, sleeve cover piece shown in FIG. 7B is similar to sleeve cover piece shown in FIG. 6A with added optional features that are detailed below.

As illustrated in FIG. 7B, in this non-limiting exemplary embodiment third middle section J 346 includes a first laterally extending interlocking projection forming a first sleeve interlocking tab 406 that interlocks with a first elongated slot opening 410 along fold mark 350.

A second laterally extending interlocking projection forming a second sleeve interlocking tab 408 that interlocks with a second elongated slot opening 412 along fold mark 366.

Figures 1, 7C:
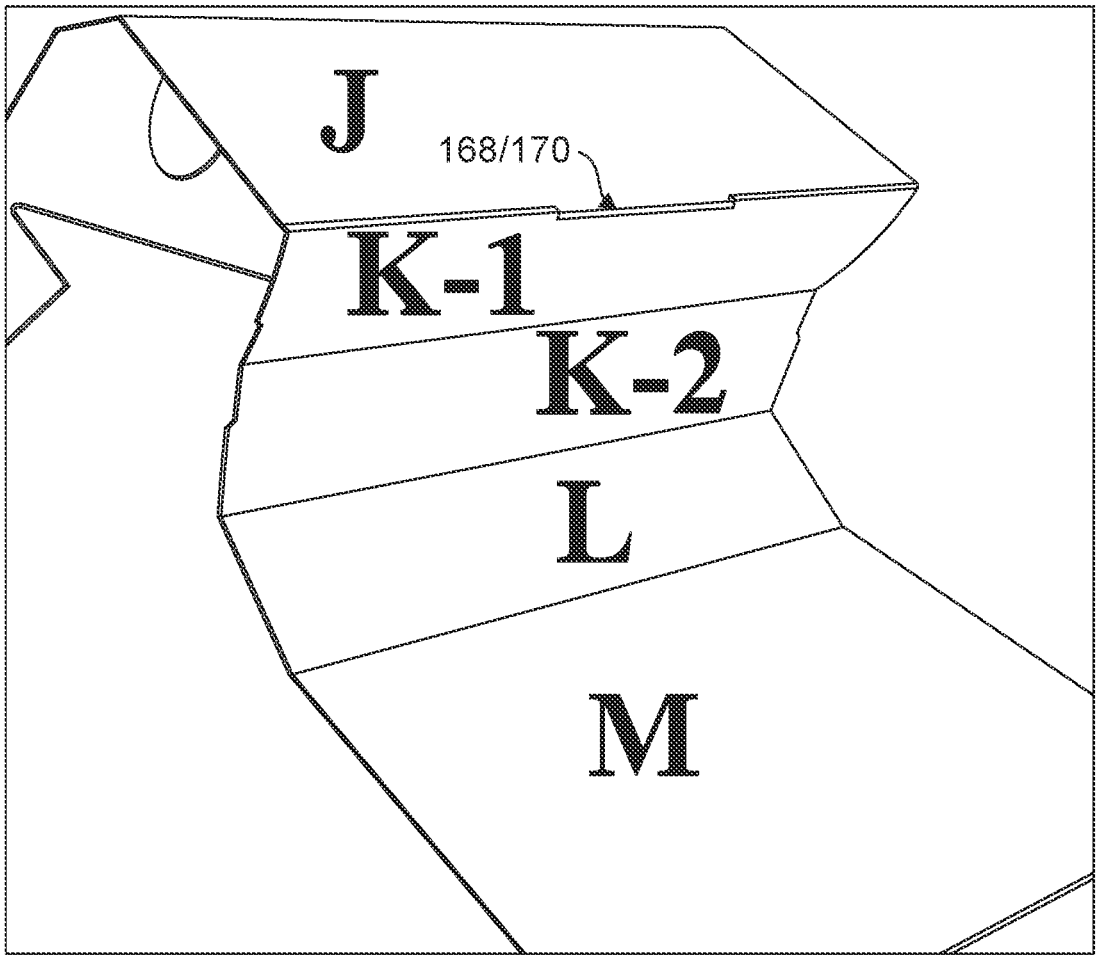
Figures 2, 7C:
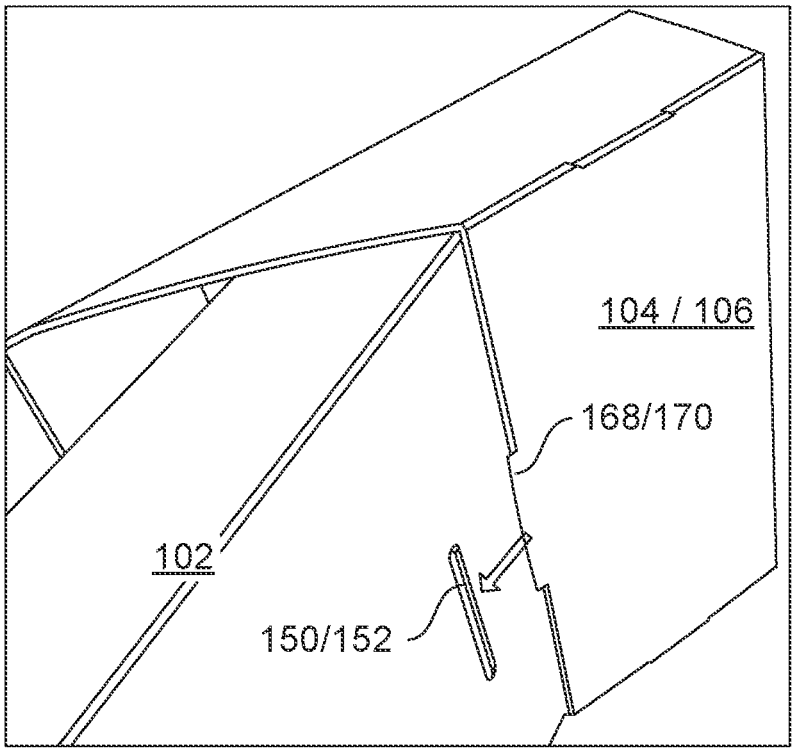
Figures 3, 7C:
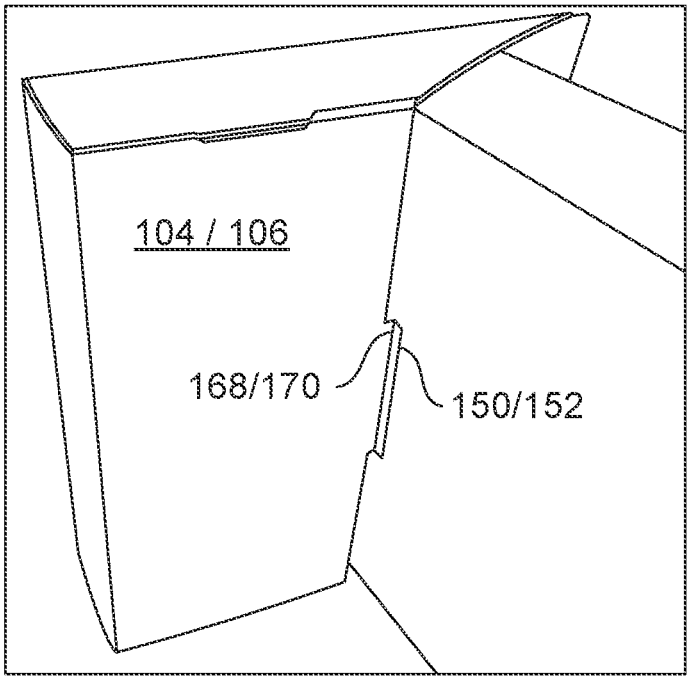
Figures 4, 7C:
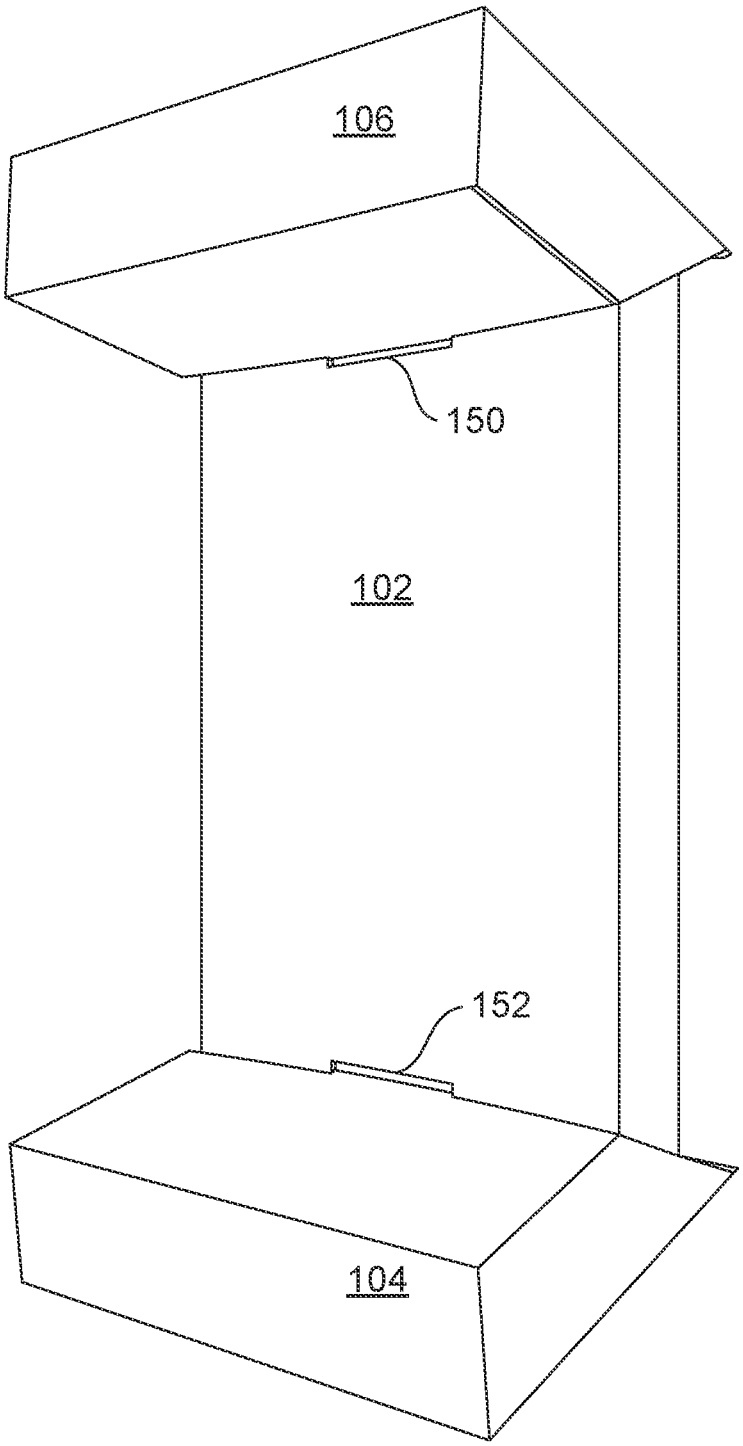

Additionally, a medially extending projection forming the interlocking projection 168/170 that interlocks with a corresponding elongated opening 150/152 that forms the interlocking recesses of the tray (as best shown in FIGS. 7C-1 to 7C-4).

As further illustrated in FIGS. 7A to 7D-4, in this non-limiting, exemplary instance, fourth middle section 394 is further split into two subsections 416 and 418 (also labeled as K-1 and K-2 respectively) by a fold mark 414. This additional folding enables easier fold and assembly of the sleeve cover.

As further shown, both subsections 416 and 418 of the fourth middle section 394 having lateral indentations 420 and 422 the enable passage and interlocking of first sleeve interlocking tab 406 and second sleeve interlocking tab 408 with a first and a second elongated slot opening 410/412.

Figures 1, 7D:
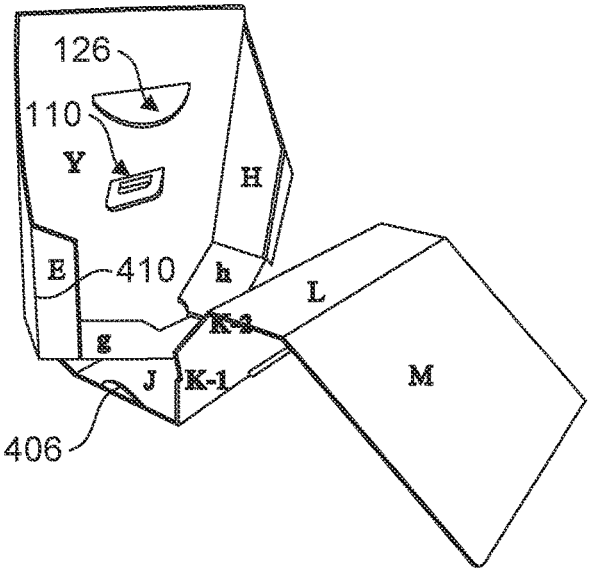
Figures 2, 7D:
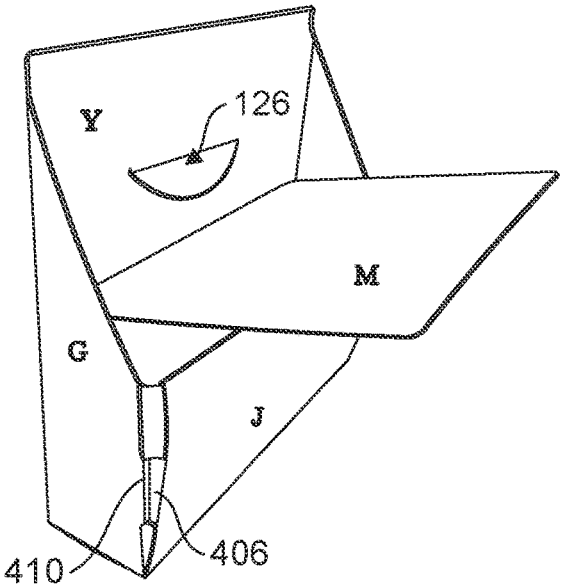
Figures 3, 7D:
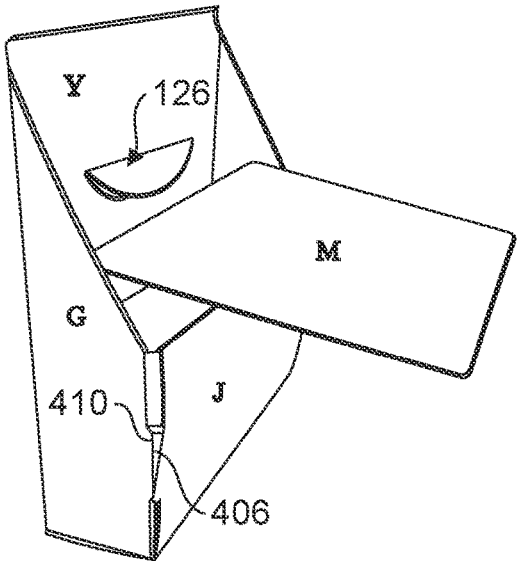
Figures 4, 7D:
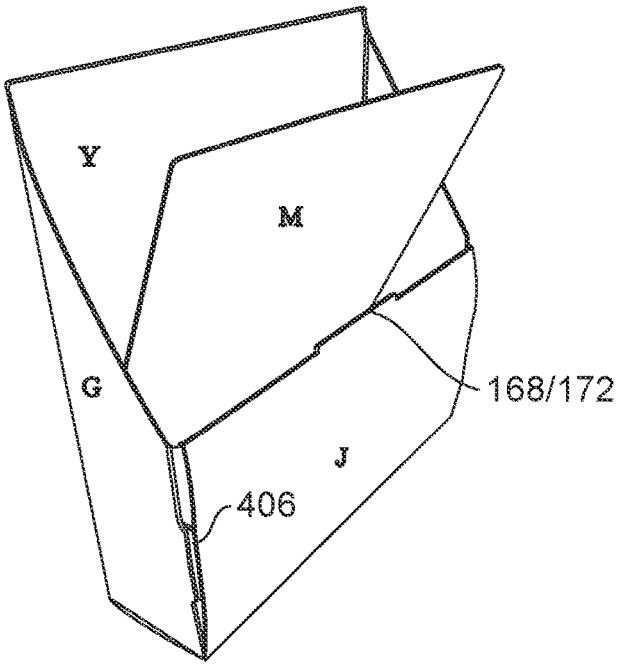
Figure 8A:
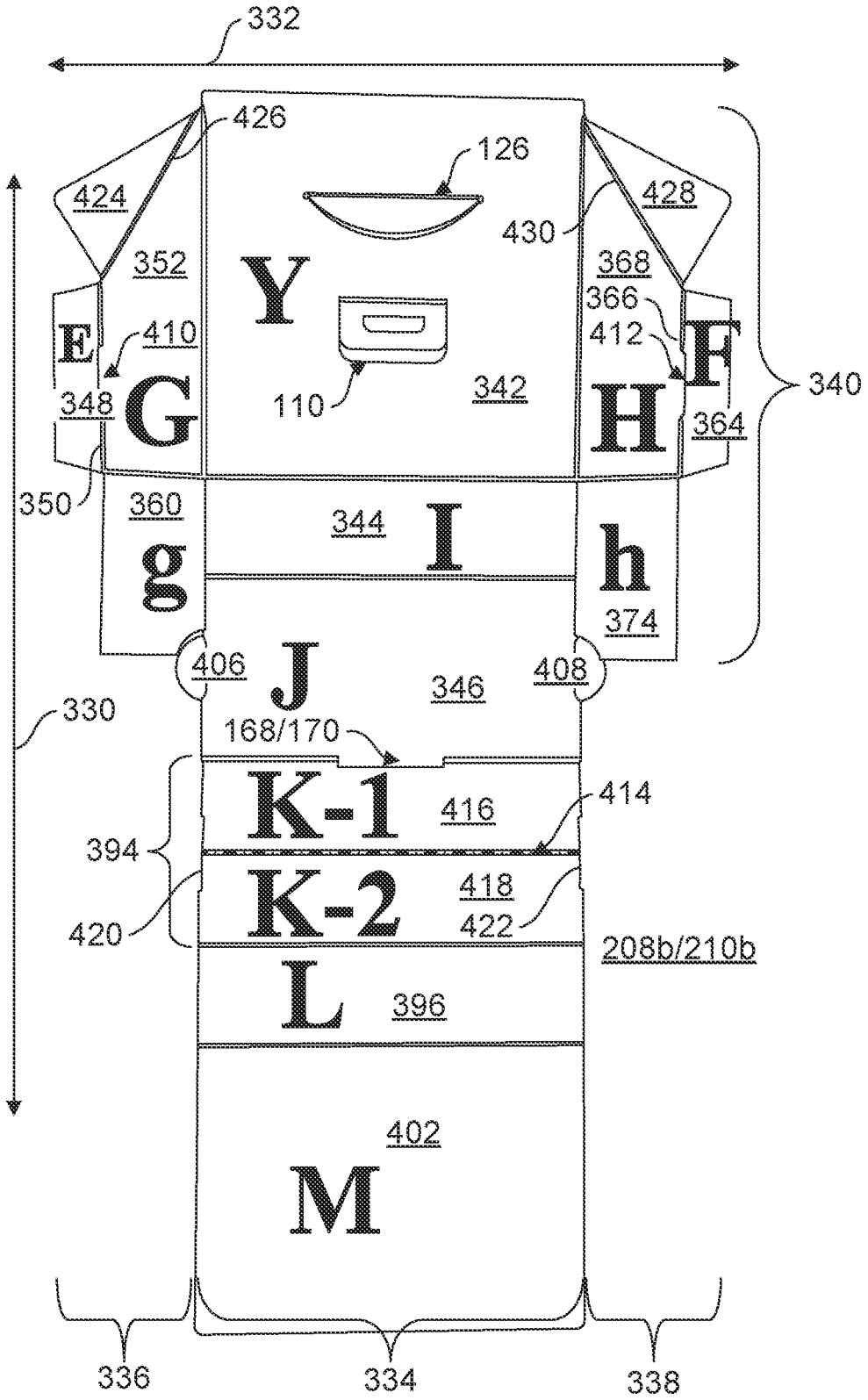
Figure 8B:
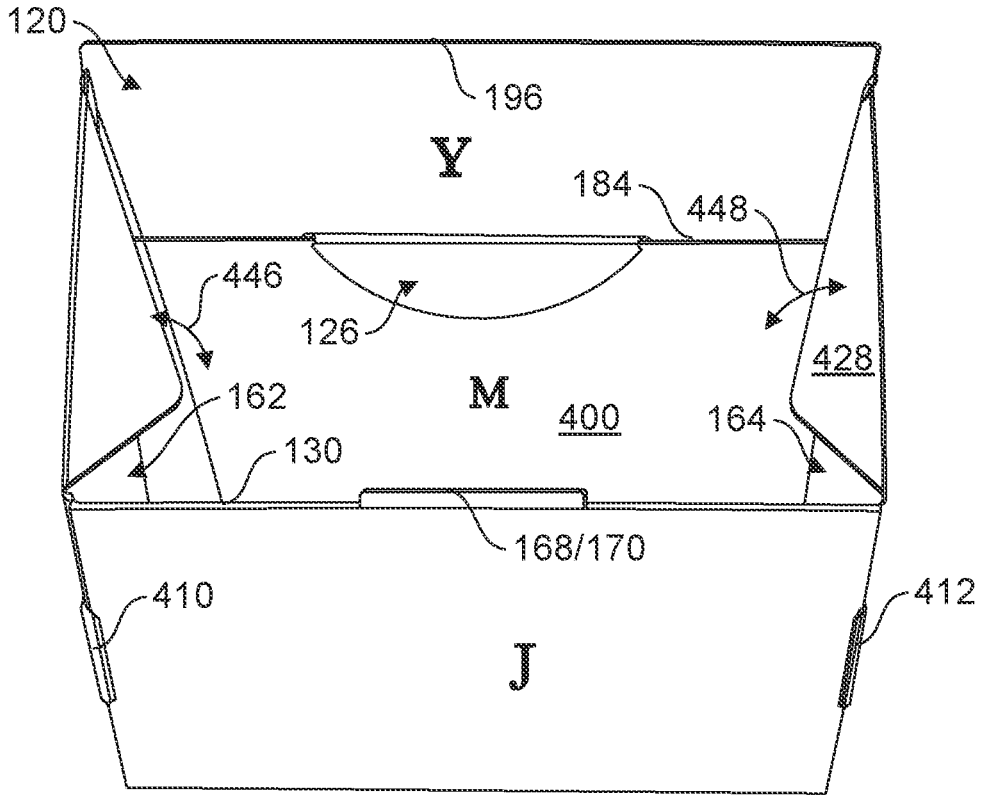
Figure 8C:
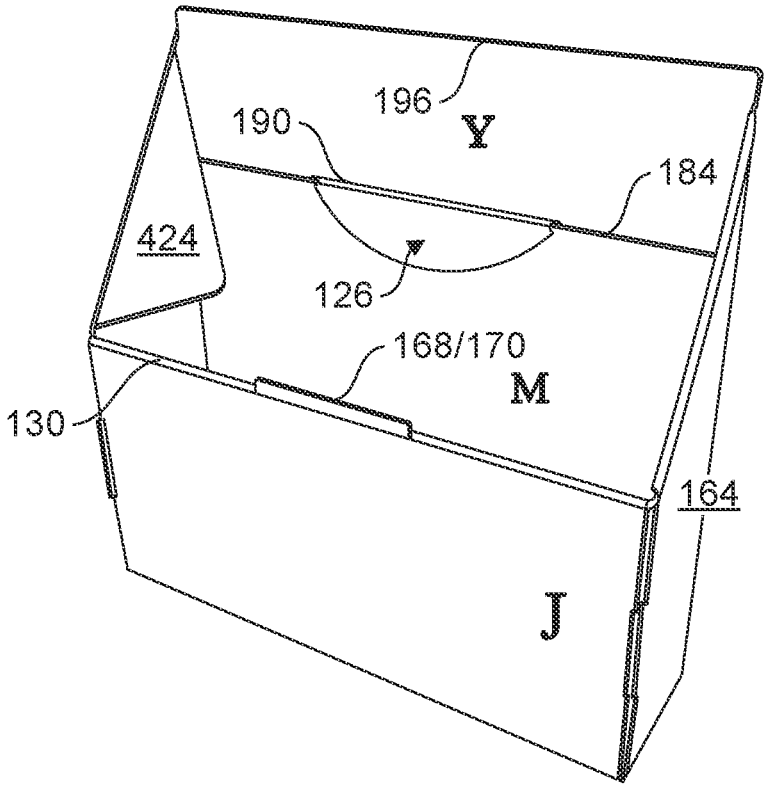
Figure 8D:
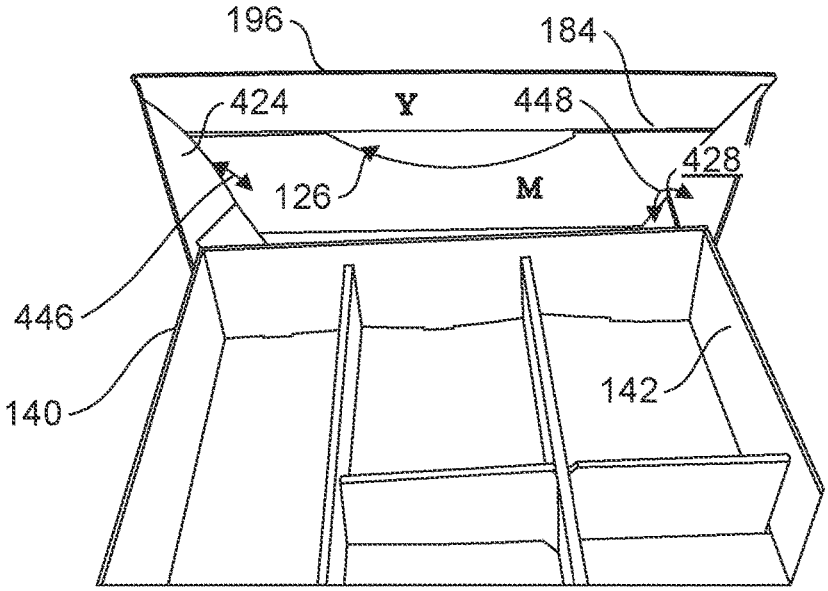
Figure 8E:
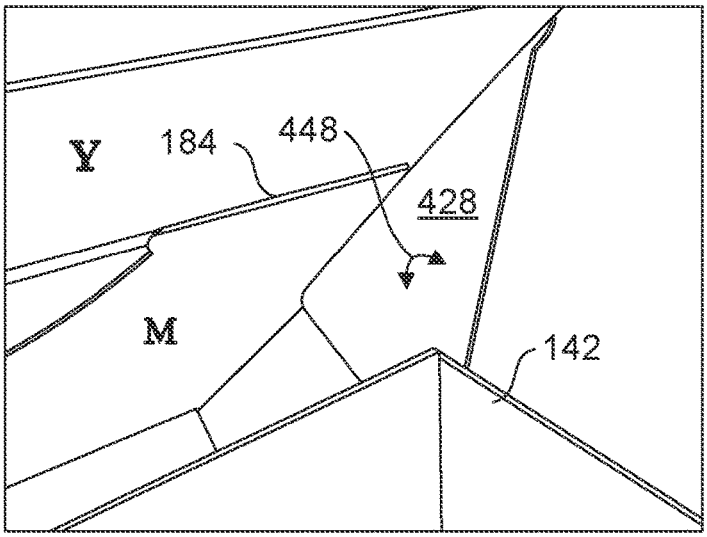
Figure 8F:
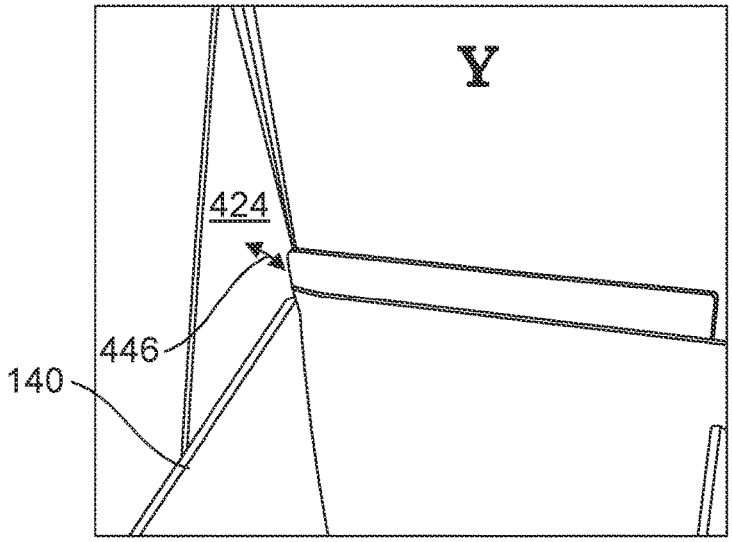

The assembly process of sleeve cover shown in FIG. 7B is similar to that shown in FIGS. 6A to 6S and in fact, the optional features detailed above automatically align and are interlocked as the sleeve cover is folded for assembly. As shown in FIG. 7D-1 to 7D-4, all that is required is folding of tabs 406 and 408 to align them with slots 410 and 412 and inserting them through slots 410 and 412 (equivalent to operational stage shown in FIG. 6O).

FIGS. 8A to 8F are a non-limiting, exemplary illustration of a sleeve cover piece of a takeout food container shown in FIGS. 1A to 7D-4 in accordance with one or more embodiments of the present invention. In FIGS. 8A to 8F only one sleeve cover piece is shown representing both sleeve cover pieces 208*b*/210*b* as both are identical.

In this non-limiting, exemplary embodiment, sleeve cover piece shown in FIGS. 8A to 8F is similar to sleeve cover piece shown in FIGS. 6A and 7B with added optional features that are detailed below.

As further illustrated in FIGS. 8A to 8F, in this non-limiting, exemplary instance, a third outer most flange 424 with seventh polygonal configuration is provided.

Third outer most flange forming a flap 424 is cantilevered along a shared twelfth fold mark 426 that is oriented diagonally at an angle in relation to longitudinal axis 330 and transverse axis 332 of the sleeve cover piece, delineating the third outer most flange 324 from the adjacent first upper flange 352 G.

The shared twelfth fold mark 426 forms the tapered and slanted edge 358 of an extended lateral portion 172 of the first lateral side 162 of sleeve cover. Flap 424 forms a resilient (spring like) portion that functions (or biases against as shown by arrow 446) to press against exterior lateral sides 140/142 of tray 102 for added hold and stability.

As further illustrated in FIGS. 8A to 8F, in this non-limiting, exemplary instance a fourth outer most flange 428 with eighth polygonal configuration is provided.

Third outer most flange forming a flap 428 is cantilevered along a shared thirteenth fold mark 430 that is oriented diagonally at an angle in relation to longitudinal axis 330 and transverse axis 332 of the sleeve cover piece, delineating the fourth outer most flange 324 from an adjacent second upper flange 368 H.

The shared thirteenth fold mark 430 forms a tapered and slanted edge 358 of an extended lateral portion 172 of the second lateral side 164 of sleeve cover. Flap 428 forms a resilient (spring like) portion that functions (or biases against as shown by arrow 448) to press against exterior lateral sides 142/140 of the tray for added hold and stability.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, any one of the disclosed cover pieces are fully compatible with any one of the disclosed tray pieces. Further, any one of the disclosed inserts or dividers are fully compatible with any one of the disclosed tray pieces. Such variations and alternate embodiments are contemplated, and can be made without departing from the spirit and scope of the invention.

It should further be noted that throughout the entire disclosure, the labels such as left, right, front, back, top, inside, outside, bottom, forward, reverse, clockwise, counter clockwise, up, down, or other similar terms such as upper, lower, aft, fore, vertical, horizontal, lateral, oblique, proximal, distal, parallel, perpendicular, transverse, longitudinal, etc. have been used for convenience purposes only and are not intended to imply any particular fixed direction, orientation, or position. Instead, they are used to reflect relative locations/positions and/or directions/orientations between various portions of an object.

In addition, reference to "first," "second," "third," and etc. members, sections, portions, etc. throughout the disclosure (and in particular, claims) is not used to show a serial or numerical limitation but instead is used to distinguish or identify the various members, sections, portions, etc.

Further the terms "a" and "an" throughout the disclosure (and in particular, claims) do not denote a limitation of quantity, but rather denote the presence of at least one of the referenced item.

The use of the phrases "and or," or "and/or" throughout the specification (if any used) indicate an inclusive "or" where for example, A and or B should be interpreted as "A," "B," or both "A and B."

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A disposable takeout food container, comprising:

a tray that is comprised of a single-piece, planar sheet cut-out that is folded about one or more markings to form the tray;

a first sleeve cover; and a second sleeve cover;

the first sleeve cover and the second sleeve cover fully cover over the tray when in a closed position;

the first sleeve cover and the second sleeve cover slide apart and move away from one another to an open position to uncover and provide access to the tray, the first sleeve cover and the second sleeve cover when oriented perpendicular to the tray and engaged with the tray, support and secure the entire tray at an elevated position, a first end of a bottom side of the tray rests upon a first supporting edge of the first sleeve cover, with the first supporting edge of the first sleeve cover having a first height, with a top edge of a first side of the tray interlocked with a first interlock mechanism of the first sleeve cover; and a second end of the bottom side of the tray rests upon a second supporting edge of the second sleeve cover, with the second supporting edge of the second sleeve cover having a second height, with a top edge of a second side of the tray interlocked with a second interlock mechanism of the second sleeve cover;

the first height of the first supporting edge of the first sleeve cover and the second height of the second supporting edge of the second sleeve cover define the elevated position of the tray, with the first interlock mechanism of the first sleeve cover and the second interlock mechanism of the second sleeve cover securing the tray at the elevated position;

the first sleeve cover and the second sleeve cover functioning as serving tray stands to form a stable table-tray.

2. The disposable takeout food container as set forth in claim 1, wherein:

the first sleeve cover and the second sleeve cover include: a utensil holder;

wherein: when a utensil is retained by the utensil holder of the first sleeve cover and the second sleeve cover, the utensil functions as a handle for the disposable takeout food container.

3. The disposable takeout food container as set forth in claim 1, wherein:

the first sleeve cover is formed from a first single-piece, planar sheet cut-out that is folded about one or more markings; and the second sleeve cover is formed from a second single-piece, planar sheet cut-out that is folded about one or more markings.

4. The disposable takeout food container as set forth in claim 1, further comprising:

a divider that is comprised of a single-piece, planar sheet cut-out that is folded about one or more markings, which may then be inserted in the tray to compartmentalize the tray.

5. A disposable takeout food container, comprising:

a first sleeve cover; and a second sleeve cover;

the first sleeve cover and the second sleeve cover are identical, with each formed from:

a single-piece, planar sheet cut-out that is folded about one or more fold-mark;

the first sleeve cover and the second sleeve cover when oriented perpendicular to a tray and engaged with the tray, support the entire tray at an elevated position, functioning as serving tray stands to form a stable table-tray;

a first end of a bottom side of the tray rests upon a first supporting edge of the first sleeve cover, with the first supporting edge of the first sleeve cover having a first height, with a top edge of a first side of the tray interlocked with a first interlock mechanism of the first sleeve cover; and a second end of the bottom side of the tray rests upon a second supporting edge of the second sleeve cover, with the second supporting edge of the second sleeve cover having a second height, with a top edge of a second side of the tray interlocked with a second interlock mechanism of the second sleeve cover;

the first height of the first supporting edge of the first sleeve cover and the second height of the second supporting edge of the second sleeve cover define the elevated position of the tray, with the first interlock mechanism of the first sleeve cover and the second interlock mechanism of the second sleeve cover securing the tray at the elevated position.

6. The disposable takeout food container as set forth in claim 5, wherein:

the first side of the tray is a first transverse side of the tray and the second side of the tray is a second transverse side of the tray.

7. The disposable takeout food container as set forth in claim 6, wherein:

the first interlock mechanism is comprised of a first exterior cutout, forming a first semi-circular flap that overlap the top edge of the first transverse side of the tray;

the second interlock mechanism is comprised of a second exterior cutout, forming a second semi-circular flap that overlap the top edge of the second transverse side of the tray.

8. The disposable takeout food container as set forth in claim 5, wherein:

extended lateral portions of lateral sides of the first and the second sleeve covers engage longitudinal sides of the tray to thereby prevent tray from in-plane motion and lateral twisting.

9. The disposable takeout food container as set forth in claim 8, wherein:

the extended lateral portions are sloped and taper from the supporting edge towards a top free edge, ending below the top free edge.

* * * * *